US009005855B2

(12) United States Patent
Iwadate et al.

(10) Patent No.: US 9,005,855 B2
(45) Date of Patent: Apr. 14, 2015

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Yuko Iwadate, Kanagawa (JP); Katsumi Nukada, Kanagawa (JP); Wataru Yamada, Kanagawa (JP); Hidekazu Hirose, Kanagawa (JP); Tomoya Sasaki, Kanagawa (JP); Kenji Kajiwara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/867,604

(22) Filed: Apr. 22, 2013

(65) Prior Publication Data

US 2014/0072906 A1 Mar. 13, 2014

(30) Foreign Application Priority Data

Sep. 12, 2012 (JP) ..... 2012-200984

(51) Int. Cl.

| | |
|---|---|
| ***G03G 5/00*** | (2006.01) |
| ***G03G 5/047*** | (2006.01) |
| ***G03G 21/18*** | (2006.01) |
| ***G03G 5/05*** | (2006.01) |
| ***G03G 5/06*** | (2006.01) |

(Continued)

(52) U.S. Cl.

CPC ..... *G03G 5/047* (2013.01); *G03G 21/1814* (2013.01); *G03G 5/0514* (2013.01); *G03G 5/0539* (2013.01); *G03G 5/0564* (2013.01); *G03G 5/0596* (2013.01); *G03G 5/0614* (2013.01); *G03G 5/075* (2013.01); *G03G 5/14726* (2013.01); *G03G 5/14756* (2013.01); *G03G 5/14795* (2013.01)

(58) Field of Classification Search

CPC .... G03G 5/0564; G03G 5/0592; G03G 5/147
USPC ..... 430/59.6, 66; 399/159
See application file for complete search history.

(56) References Cited

U.S. PATENT DOCUMENTS

| | | | |
|---|---|---|---|
| 5,411,827 | A | 5/1995 | Tamura et al. |
| 5,427,880 | A | 6/1995 | Tamura et al. |
| 5,456,989 | A | 10/1995 | Nogami et al. |

(Continued)

FOREIGN PATENT DOCUMENTS

| | | |
|---|---|---|
| JP | A-62-251757 | 11/1987 |
| JP | A-5-40360 | 2/1993 |

(Continued)

OTHER PUBLICATIONS

Dec. 17, 2014 Office Action issued in U.S. Appl. No. 14/036,510.

*Primary Examiner* — Mark A Chapman
(74) *Attorney, Agent, or Firm* — Oliff PLC

(57) ABSTRACT

Provided is an electrophotographic photoreceptor including a conductive substrate; a charge generating layer provided on the conductive substrate; a charge transporting layer provided on the charge generating layer; and an outermost surface layer provided on the charge transporting layer, wherein the charge transporting layer includes a charge transporting material and a polycarbonate copolymer having a solubility parameter as calculated by a Feders method of from 11.40 to 11.75, and the outermost surface layer includes a charge transporting material, fluorine-containing resin particles, and a fluorine-containing dispersant.

14 Claims, 8 Drawing Sheets

(51) Int. Cl.
*G03G 5/07* (2006.01)
*G03G 5/147* (2006.01)

(56) References Cited

U.S. PATENT DOCUMENTS

| | | | |
|---|---|---|---|
| 5,496,671 | A | 3/1996 | Tamura et al. |
| 5,695,898 | A | 12/1997 | Go et al. |
| 7,893,185 | B2 | 2/2011 | Hikosaka et al. |
| 2002/0119382 | A1 | 8/2002 | Nakata et al. |
| 2004/0043312 | A1 | 3/2004 | Kikuchi et al. |
| 2004/0248024 | A1 | 12/2004 | Suzuki et al. |
| 2004/0253527 | A1 | 12/2004 | Suzuki et al. |
| 2007/0122724 | A1 | 5/2007 | Suzuki et al. |
| 2007/0178400 | A1 | 8/2007 | Kikuchi et al. |
| 2008/0020305 | A1 | 1/2008 | Suzuki et al. |
| 2011/0229809 | A1 | 9/2011 | Nukada et al. |
| 2013/0052572 | A1 | 2/2013 | Nukada et al. |

FOREIGN PATENT DOCUMENTS

| | | |
|---|---|---|
| JP | A-5-216249 | 8/1993 |
| JP | A-7-72640 | 3/1995 |
| JP | A-7-146564 | 6/1995 |
| JP | B2-2852464 | 2/1999 |
| JP | A-2000-19749 | 1/2000 |
| JP | A-2000-206715 | 7/2000 |
| JP | A-2001-166509 | 6/2001 |
| JP | A-2001-175016 | 6/2001 |
| JP | A-2002-82469 | 3/2002 |
| JP | B2-3287678 | 6/2002 |
| JP | A-2004-012986 | 1/2004 |
| JP | A-2004-302450 | 10/2004 |
| JP | A-2005-62301 | 3/2005 |
| JP | A-2005-62302 | 3/2005 |
| JP | A-2006-84711 | 3/2006 |
| JP | A-2006-98728 | 4/2006 |
| JP | A-2006-138956 | 6/2006 |
| JP | A-2007-86522 | 4/2007 |
| JP | B2-4717665 | 7/2011 |

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-200984 filed on Sep. 12, 2012.

BACKGROUND

1. Technical Field

The present invention relates to an electrophotographic photoreceptor, a process cartridge, and an image forming apparatus.

2. Related Art

Generally, an electrophotographic image forming apparatus has the following configurations and processes. That is, the surface of an electrophotographic photoreceptor is charged by a charging apparatus to defined polarity and potential, and the charge is selectively removed from the charged surface of the electrophotographic photoreceptor by image-wise exposure to form an electrostatic latent image. The latent image is then developed into a toner image by attaching a toner to the electrostatic latent image by a developing unit, the toner image is transferred onto an transfer medium by a transfer unit, and then the transfer medium is discharged as an image formed material.

It has been proposed, for example, to provide the surface of an electrophotographic photoreceptor with a protective layer to increase the strength.

Recently, protective layers formed of acrylic materials has been attracting attention.

The acrylic materials are strongly affected by a curing condition, a curing atmosphere, and the like.

SUMMARY

According to an aspect of the invention, there is provided an electrophotographic photoreceptor including a conductive substrate; a charge generating layer provided on the conductive substrate; a charge transporting layer provided on the charge generating layer; and an outermost surface layer provided on the charge transporting layer, wherein the charge transporting layer includes a charge transporting material and a polycarbonate copolymer having a solubility parameter as calculated by a Feders method of from 11.40 to 11.75, and the outermost surface layer contains a charge transporting material, fluorine-containing resin particles, and a fluorine-containing dispersant.

BRIEF DESCRIPTION OF THE DRAWINGS

Exemplary embodiments of the present invention will be described in detail based on the following figures, wherein.

DETAILED DESCRIPTION

Figure 1:
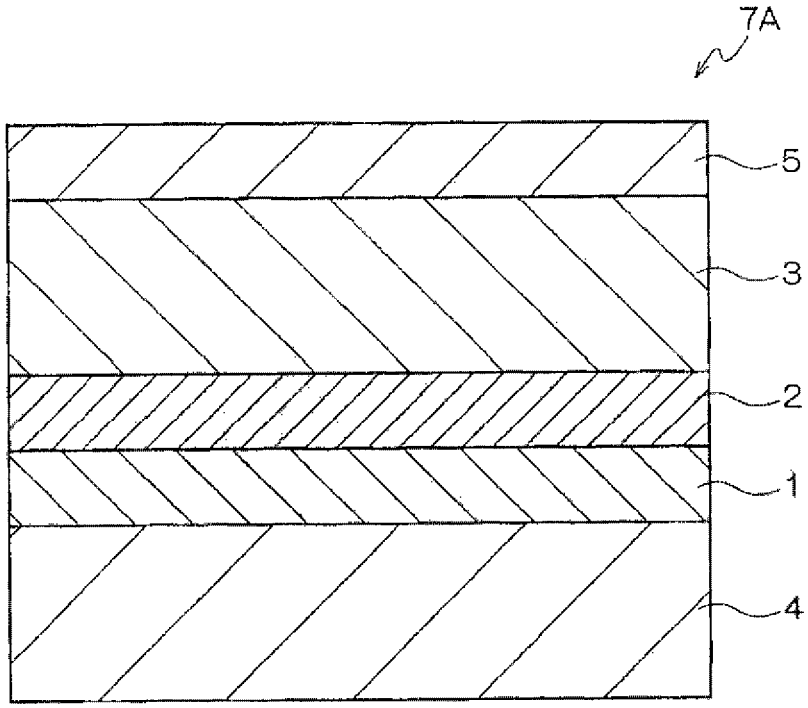
FIG. 1 is a schematic partial cross-sectional diagram showing an example of the layer configuration of the electrophotographic photoreceptor according to the present exemplary embodiment.

Hereinbelow, the present exemplary embodiment which is one example of the invention will be described.

Electrophotographic Photoreceptor

The electrophotographic photoreceptor according to the present exemplary embodiment has a conductive substrate, a charge generating layer provided on the conductive substrate, a charge transporting layer provided on the charge generating layer, and an outermost surface layer provided on the charge transporting layer.

The charge transporting layer is configured to include a charge transporting material and a polycarbonate copolymer with a solubility parameter as calculated by a Feders method of from 11.40 to 11.75.

Further, the outermost surface layer is constituted with a film containing a charge transporting material, fluorine-containing resin particles, and a fluorine-containing dispersant.

Here, it is known to internally add fluorine-containing resin particles to an outermost surface layer in order to decrease the friction coefficient of the surface of an electrophotographic photoreceptor. The photoreceptor in which the fluorine-containing resin particles are internally added to the outermost surface layer is formed by coating a charge transporting layer with a coating liquid having the fluorine-containing resin particles dispersed therein. However, depending on the type of the solvent used for the preparation of the coating liquid, when the outermost surface layer is coated and formed, the binder resin of the charge transporting layer is swollen by the solvent of the coating liquid, and as a result, the fluorine-containing resin particles may be unevenly distributed on the surface layer side of the outermost surface layer (that is, unevenly present at a high density) in some cases.

If the fluorine-containing resin particles are unevenly distributed (unevenly present at a high density) on the surface layer side of the outermost surface layer, for example, the ratio of the resin components in the surface layer part of the outermost surface layer is decreased and the abrasion resistance at the initial time of use is decreased. Further, the inside (in particular, the side of the lower layer) of the outermost surface layer has a low density of the fluorine-containing resin particles, and therefore, when the electrophotographic photoreceptor is used for a long period of time, the outermost surface layer is abraded and reaches a low-density zone of the fluorine-containing resin particles, cleaning failure occurs due to an increase in a load (torque) applied to a cleaning blade, which may deteriorate the image quality.

Therefore, for the electrophotographic photoreceptor according to the present exemplary embodiment, a charge transporting layer, which is the lower layer of an outermost surface layer constituted with a film containing a charge transporting material, fluorine-containing resin particles, and a fluorine-containing dispersant, is configured to include a polycarbonate copolymer with a solubility parameter as calculated by a Feders method of from 11.40 to 11.75 as a binder resin.

Thus, with the electrophotographic photoreceptor according to the present exemplary embodiment, uneven distribution of the fluorine-containing resin particles on the surface layer side of the outermost surface layer is suppressed. That is, the amount of fluorine contained in the outermost surface layer is easily in a uniformly dispersed state.

The reason therefor is not clear, but is thought to be that if a polycarbonate copolymer with a solubility parameter in the above range is included as a binder resin in the charge transporting layer which is a lower layer, the solubility of the polycarbonate copolymer in the solvent in the coating liquid is low when the outermost surface layer is formed, and thus, the binder resin by the solvent is suppressed from being swollen.

As a result, with the electrophotographic photoreceptor according to the present exemplary embodiment, a decrease in the abrasion resistance at the initial time of use of the outermost surface layer is easily suppressed. Further, the increase in the load (torque) applied to the cleaning blade occurring when the electrophotographic photoreceptor is used for a long period of time, and thus, the outermost surface layer is abraded is suppressed, and the generation of the cleaning failure is easily suppressed.

In addition, there is attained a long-life image forming apparatus (or a process cartridge) including the electrophotographic photoreceptor according to the present exemplary embodiment.

Hereinafter, a configuration of the photoreceptor according to the exemplary embodiment will be described in detail with reference to Figs.

FIG. 1 is a cross-sectional view schematically illustrating a preferred example of the electrophotographic photoreceptor according to the exemplary embodiment. An electrophotographic photoreceptor 7A illustrated in FIG. 1 is a so-called functional separation type photoreceptor (or layered photoreceptor) in which an undercoat layer 1 is provided on a substrate 4; a photosensitive layer in which a charge generating layer 2 and a charge transporting layer 3 are formed in this order is provided thereon; and a protective layer 5 is provided thereon. In the electrophotographic photoreceptor 7A, the photosensitive layer composed of the charge generating layer 2 and the charge transporting layer 3 correspond to the photosensitive layer. In the electrophotographic photoreceptors shown in FIG. 1, the undercoat layer 1 may or may not be provided.

Hereinafter, the respective elements will be described on the basis of the electrophotographic photoreceptors 7A shown in the FIG. 1 as representative examples. The reference numbers will be omitted.

Conductive Substrate

The conductive substrate may be freely selected from existing ones, such as plastic films having thereon a thin film (for example, a metal such as aluminum, nickel, chromium, stainless steel, or a film of aluminum, titanium, nickel, chromium, stainless steel, gold, vanadium, tin oxide, indium oxide, or indium tin oxide (ITO)), paper coated or impregnated with a conductivity-imparting agent, and plastic films coated or impregnated with a conductivity-imparting agent. The substrate may be in the form of a cylinder, a sheet, or a plate. The conductive substrate particles preferably have a volume resistivity of, for example, less than $10^7$ Ω·cm.

When the conductive substrate is a metal pipe, the surface thereof may be untreated or treated by mirror finishing, etching, anodic oxidation, rough cutting, centerless grinding, sandblast, or wet honing.

Undercoat Layer

The undercoat layer is formed if necessary for the purpose of preventing light reflection on the conductive substrate surface, and inflow of unnecessary carriers from the conductive substrate into the photosensitive layer.

The undercoat layer is configured to contain, for example, a binder resin and other optional additives.

Examples of the binder resin contained in the undercoat layer include known polymer resin compounds such as acetal resins e.g. polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, unsaturated urethane resins, polyester resins, alkyd resins, and epoxy resins, charge transporting resins having a charge transporting group, and conductive resins such as polyaniline.

Among them, as the binder resin, resins which are insoluble in the coating solvent for the upper layer (charge generating layer) are preferable, and resins which are obtained by the reaction of a curing agent and at least one selected from the group consisting of thermosetting resins such as urea resins, phenol resins, phenol-formaldehyde resins, melamine resins, urethane resins, unsaturated polyester resins, alkyd resins, and epoxy resins, polyamide resins, polyester resins, polyether resins, acrylic resins, polyvinyl alcohol resins, and polyvinyl acetal resins are particularly preferable.

When using the binder resins in combination of two or more kinds thereof, the mixing ratio is set as necessary.

The undercoat layer may contain a metal compound such as a silicon compound, an organozirconium compound, an organotitanium compound, or an organoaluminum compound.

The ratio of the metal compound to the binder resin is not specified, and is selected so as to achieve intended electrophotographic photoreceptor properties.

The undercoat layer may contain resin particles for controlling the surface roughness. Examples of the resin particles include silicone resin particles and crosslinked poly(methyl methacrylate) (PMMA) resin particles. For the purpose of controlling the surface roughness, the surface of the undercoat layer provided on a conductive substrate may be polished by, for example, buff polishing, sandblasting, wet honing, or grinding.

The undercoat layer may contain, for example, at least a binder resin and conductive particles. The conductive particles preferably have, for example, a volume resistivity of less than $10^7$ Ω·cm.

Examples of the conductive particles include metallic particles (for example, aluminum, copper, nickel, and silver particles), conductive metallic oxide particles (for examples, antimony oxide, indium oxide, tin oxide, and zinc oxide particles), and conductive substance particles (carbon fiber, carbon black, and graphite powder particles). Among them, conductive metal oxide particles are preferred. The conductive particles may be used in combination of two or more thereof. The conductive particles may be subjected to surface treatment with a hydrophobizing agent (for example, a coupling agent), thereby controlling the resistance. The content of the conductive particles is, for example, preferably from 10% by weight to 80% by weight with respect to the binder resin, and more preferably from 40% by weight to 80% by weight.

The formation of the undercoat layer is not particularly limited, and a well-known formation method is used. For example, the undercoat layer is formed by forming a coating film of an undercoat layer-forming coating solution obtained by adding the above-described components to a solvent; and drying (optionally, heating) the coating solution.

Examples of the method for coating the undercoat layer forming coating liquid to the conductive substrate include dip coating, push-up coating, wire-bar coating, spray coating, blade coating, knife coating, and curtain coating.

Examples of the method for dispersing particles in the undercoat layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

The thickness of the undercoat layer is preferably 15 μm or more, and more preferably from 20 μm to 50 μm.

Here, although omitted in the drawings, an intermediate layer may be further provided between the undercoat layer and the photosensitive layer. Examples of the binder resins for use in the intermediate layer include polymeric resin compounds e.g., acetal resins such as polyvinyl butyral, polyvinyl alcohol resins, casein, polyimide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organic metallic compounds containing zirconium, titanium, aluminum, manganese, and silicon atoms. These compounds may be used singly or as a mixture or polycondensate of the plural compounds. Among them, an organic metallic compound containing zirconium or silicon is preferable because it has a low residual potential, and thus a change in potential due to the environment is small, and a change in potential due to the repeated use is small.

The formation of the intermediate layer is not particularly limited, and a well-known formation method is used. For example, the intermediate layer is formed by forming a coating film of an intermediate layer-forming coating solution obtained by adding the above-described components to a solvent; and drying (optionally, heating) the coating solution.

As a coating method for forming the intermediate layer, a general method is used such as a dipping coating method, an extrusion coating method, a wire bar coating method, a spray coating method, a blade coating method, a knife coating method, or a curtain coating method.

The intermediate layer improves the coating property of the upper layer and also functions as an electric blocking layer. However, when the thickness is excessively large, an electric barrier becomes excessively strong, which may cause desensitization or an increase in potential due to the repeated use. Accordingly, when an intermediate layer is formed, the thickness may be set to from 0.1 μm to 3 μm. In this case, the intermediate layer may be used as the undercoat layer.

Charge Generating Layer

The charge generating layer includes, for example, a charge generating material and a binder resin. Also the charge generating layer may include a vapor deposition film of a charge generating material.

Examples of the charge generating material include phthalocyanine pigments such as metal-free phthalocyanine, chlorogallium phthalocyanine, hydroxygallium phthalocyanine, dichlorotin phthalocyanine, and titanyl phthalocyanine. Particularly, there are exemplified a chlorogallium phthalocyanine crystal having strong diffraction peaks at least at Bragg angles (2θ±0.2° of 7.4°, 16.6°, 25.5°, and 28.3° with respect to CuKα characteristic X-ray, a metal-free phthalocyanine crystal having strong diffraction peaks at least at Bragg angles (2θ±0.2° of 7.7°, 9.3°, 16.9°, 17.5°, 22.4°, and 28.8° with respect to CuKα characteristic X-ray, a hydroxygallium phthalocyanine crystal having strong diffraction peaks at least at Bragg angles (2θ±0.2° of 7.5°, 9.9°, 12.5°, 16.3°, 18.6°, 25.1°, and 28.3° with respect to CuKα characteristic X-ray, and a titanyl phthalocyanine crystal having strong diffraction peaks at least at Bragg angles (2θ±0.2° of 9.6°, 24.1°, and 27.2° with respect to CuKα characteristic X-ray. Other examples of the charge generating material include quinone pigments, perylene pigments, indigo pigments, bisbenzimidazole pigments, anthrone pigments, and quinacridone pigments. These charge generating materials may be used singly or in mixture of two or more types.

Examples of the binder resin constituting the charge generating layer include polycarbonate resins such as a bisphenol-A type and a bisphenol-Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used singly or in mixture of two or more types.

The blending ratio of the charge generating material to the binder resin is, for example, preferably from 10:1 to 1:10.

The charge generating layer may contain other known additives.

The formation of the charge generating layer is not particularly limited, and a well-known formation method is used. For example, the charge generating layer is formed by forming a coating film of a charge generating layer-forming coating solution obtained by adding the above-described components to a solvent; and drying (optionally, heating) the coating solution. Also the charge generating layer may be formed by deposition of the charge generating materials.

Examples of the method of coating the undercoat layer with the coating liquid for charge generating layer formation include a dipping coating method, an extrusion coating method, a wire bar coating method, a spray coating method, a blade coating method, a knife coating method, and a curtain coating method.

As a method of dispersing the particles (for example, charge generating material) in the coating liquid for charge generating layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

The thickness of the charge generating layer is preferably set to from 0.0 μm to 5 μm, and more preferably from 0.05 μm to 2.0 μm.

Charge Transporting Layer

The charge transporting layer includes a charge transporting material, and if necessary, a binder resin.

Examples of the charge transporting material include hole transporting substances e.g., oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, tris[4-(4,4-diphenyl-1,3-butadienyl)phenyl]amine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinylcarbazole and derivatives thereof; electron transporting substances e.g., quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group composed of the above-described compounds as a main chain or side chain thereof. These charge transporting materials may be used singly or in combination of two or more types.

As the binder resin, a polycarbonate copolymer (hereinafter also referred to as a "specific polycarbonate copolymer") with a solubility parameter (hereinafter also referred to as "SP value") as calculated by a Feders method of from 11.40 to 11.75 (preferably from 11.40 to 11.70) is applied.

When the SP value of the specific polycarbonate copolymer is 11.40 or more, the uneven distribution of the fluorine-containing resin particles on the side of the surface layer of the protective layer (outermost surface layer) is suppressed. On the other hand, when the SP value of the specific polycarbonate copolymer is 11.75 or less, the deterioration of the compatibility with the charge transporting material of the charge transporting layer is suppressed, and a decrease in the electrical characteristics of the electrophotographic photoreceptor (particularly an increase in the residual potential due to the repeated use) is easily suppressed.

The specific polycarbonate copolymer preferably has repeating structural units having an SP value of from 12.2 to 12.4. It is thought that if the repeating structural units having a high SP value in the above range are included as at least one of the repeating structural units of the polycarbonate copolymer, the entire specific polycarbonate copolymer easily has a decrease in the compatibility with the resin component of a protective layer (outermost surface layer), and thus, the diffusion of the charge transporting material of the charge transporting layer into the protective layer is easily suppressed. As a result, a decrease in the electrical characteristics of the electrophotographic photoreceptor (in particular, an increase in the residual potential due to the repeated used) is easily suppressed.

Here, the Feders method refers to a convenient method for calculating a solubility parameter (SP value) from a structural formula. Specifically, in the Feders method, when the cohesive energy density is denoted as ΔE and the molar volume is denoted as V, and the solubility parameter is calculated from SP Value $\delta=(\Delta E/V)^{1/2}=(\Sigma\Delta_{ei}/\Sigma\Delta_{vi})^{1/2}$. Further, ei and vi are the cohesive energy and the molar volume of the unit of the structural formula, respectively, and the list thereof is described in, for example, "Fundamentals and Engineering of Coating" (Processing Technology Study Association), p. 55".

Further, $(cal/cm^3)^{1/2}$ is employed as a unit of the solubility parameter (SP value), but according to the customary practice, the solubility parameter is denoted without a dimension with the omission of the unit.

Moreover, the method for calculating the solubility parameter (SP value) according to the Feders method is defined as follows. That is, the solubility parameter of the repeating structural unit constituting the copolymer is denoted as on and the presence ratio (molar ratio) of the repeating structural unit in the copolymer is denoted as χn, and the solubility parameter (SP value) of the copolymer is denoted as $\delta=\Sigma(\delta n\cdot\chi n)$. When the solubility parameter (SP value) of the repeating structural unit is calculated, as the cohesive energy and the molar volume of the carbonate group, the values of $\Delta e_i=4200$ cal/mol and $\Delta v_i=22.0\ cm^3/mol$, shown in the list of "Fundamentals and Engineering of Coating" (Processing Technology Study Association), p. 55, are used. For example, the copolymer is a polycarbonate copolymer formed by the polymerization of bisphenol Z monomers and bisphenol F monomers, and in the case where the molar ratio of the respective repeating units is 70% of Z units/30% of F units, the repeating unit structure of the Z unit has the following Z unit (I): $\delta_Z=((1180\times5+350\times1+7630\times2+4200\times1+250\times1)/(16.1\times5+(-19.2)\times1+52.4\times2+22.0\times1+16\times1))^{1/2}=11.28$; the repeating unit structure of the F unit has the following F unit (I): $\delta_F=((1180\times1+7630\times2+4200\times1)/(16.1\times1+52.4\times2+22.0\times1))^{1/2}=12.02$; and the solubility parameter $\delta_{Z70F30}$ of the polycarbonate copolymer is as follows: $\delta_{Z70F30}=11.28\times0.7+12.02\times0.3=11.50$.

Z unit (I)

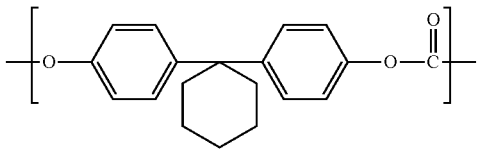

F unit (I)

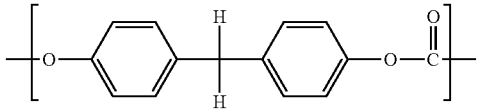

Specific examples of the specific polycarbonate copolymer include a copolymer of at least two or more divalent monomers (hereinafter referred to as a "divalent phenol") selected from a biphenyl monomer and a bisphenol monomer.

Particularly, from the viewpoint of inhibition of the uneven distribution of the fluorine-containing resin particles on the surface layer side of the outermost surface layer, specific suitable examples of the polycarbonate copolymer include a polycarbonate copolymer having the repeating structural units represented by the following general formula (PC-1) and a polycarbonate copolymer having the repeating structural units represented by the following general formula (PC-2).

Specifically, examples of the specific polycarbonate copolymer include:

1) a polycarbonate copolymer having two or more repeating structural units represented by the following general formula (PC-1), having different structures from each other, 2) a polycarbonate copolymer having two or more repeating structural units represented by the following general formula (PC-2), having different structures from each other, and 3) a polycarbonate copolymer having one or two or more repeating structural units represented by the following general formula (PC-1), having different structures from each other, and one or two or more repeating structural units represented by the following general formula (PC-2), having different structures from each other.

Further, for the specific polycarbonate copolymer, each repeating structural unit (monomer) is selected so as to allow the SP value to be in the above range.

(PC-1)

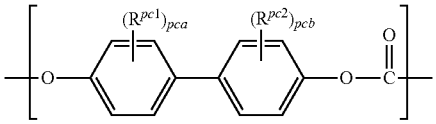

In the general formula (PC-1), $R^{pc1}$ and $R^{pc2}$ each independently represent a halogen atom, an alkyl group having 1 to 6 carbon atoms, a cycloalkyl group having 5 to carbon atoms, or an aryl group having 6 to 12 carbon atoms.

pca and pcb each independently represent an integer of 0 to 4.

In the general formula (PC-1), $R^{pc1}$ and $R^{pc2}$ each independently preferably represent an alkyl group having 1 to 6 carbon atoms, and more preferably a methyl group.

In the general formula (A), pca and pcb each independently represent an integer of 0 to 2, and in particular, most preferably 0.

(PC-2)

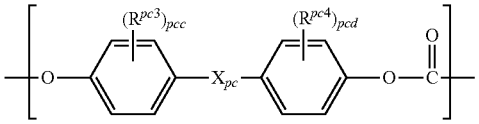

In the general formula (PC-2), $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms. pcc and pcd each independently represent an integer of 0 to 4. $X_{pc}$ represents —$CR^{pc5}R^{pc6}$— (provided that $R^{pc5}$ and $R^{pc6}$ each independently represent a hydrogen atom, a trifluoromethyl group, an alkyl group having 1 to 6 carbon atoms, or an aryl group having 6 to 12 carbon atoms), a 1,1-cycloalkylene group having 5 to 11 carbon atoms, an α,ω-alkylene group having 2 to 10 carbon atoms, —O—, —S—, —SO—, or —$SO_2$—.

In the general formula (PC-2), $R^{pc3}$ and $R^{pc4}$ each independently preferably represent an alkyl group having 1 to 6 carbon atoms, and more preferably a methyl group.

pcc and pcd each independently preferably represent an integer of 0 to 2.

$X_{pc}$ preferably represents —$CR^{pc5}R^{pc6}$— (provided that $R^{pc5}$ and $R^{pc6}$ each independently represent a hydrogen atom or an alkyl group having 1 to 6 carbon atoms), or a 1,1-cycloalkylene group having 5 to 11 carbon atoms.

For the specific polycarbonate copolymer, from the viewpoint of the inhibition of uneven distribution of the fluorine-containing resin particles on the surface layer side of the outermost surface layer, the ratio (molar ratio) of the repeating structural unit represented by the general formula (PC-1) may be from 20% by mole to 40% by mole, and preferably from 23% by mole to 37% by mole, based on the specific polycarbonate copolymer (the entire repeating structural units).

Furthermore, from the viewpoint of the inhibition of uneven distribution of the fluorine-containing resin particles on the surface layer side of the outermost surface layer, the ratio (molar ratio) of the repeating structural unit represented by the general formula (PC-2) may be from 35% by mole to 55% by mole, and preferably from 38% by mole to 52% by mole, based on the polycarbonate copolymer (the entire repeating structural units).

Specific examples of the repeating unit constituting the specific polycarbonate copolymer are shown below. Further, specific examples (units) of the repeating structural unit are shown by exemplifying the structures of the X moiety of the divalent phenol HO—(X)—OH that forms the repeating unit. Specifically, for example, the repeating structural unit represented by "(BP)-0" in the column of Unit No. represents a structural unit represented by [—O— (the structure shown in the column of the structure) —O—C(═O)—].

| Unit No. | Structure | Solubility parameter (SP value) |
|---|---|---|
| (BP)-0 | 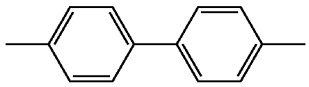 | 12.39 |
| (BP)-1 | 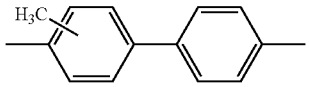 | 12.07 |
| (BP)-2-a | 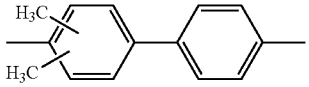 | 11.80 |
| (BP)-2-b | 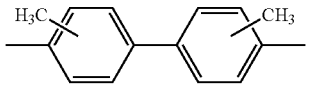 | 11.80 |
| (BP)-3 | 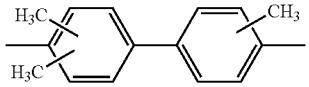 | 11.58 |
| (BP)-4 | 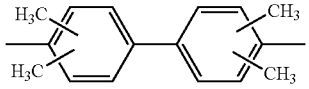 | 11.39 |
| (F)-0 | 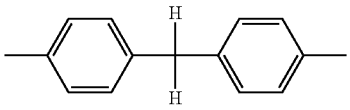 | 12.02 |

-continued
| Unit No. | Structure | Solubility parameter (SP value) |
|---|---|---|
| (F)-1 | 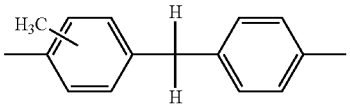 | 11.76 |
| (F)-2-a | 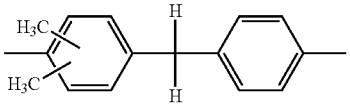 | 11.54 |
| (F)-2-b | 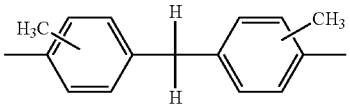 | 11.54 |
| (F)-3 | 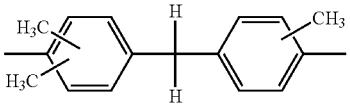 | 11.35 |
| (F)-4 | 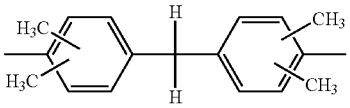 | 11.19 |
| (E)-0 | 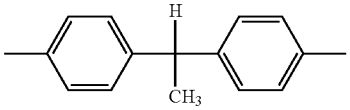 | 11.59 |
| (E)-1 | 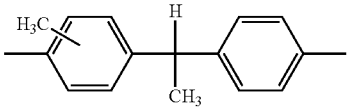 | 11.39 |
| (E)-2-a | 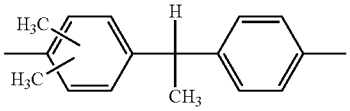 | 11.21 |
| (E)-2-b | 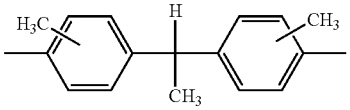 | 11.21 |
| (E)-3 | 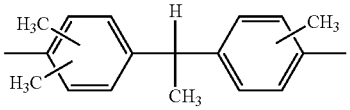 | 11.05 |
| (E)-4 | 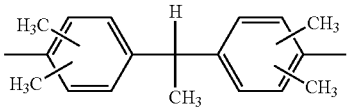 | 10.92 |
| (A)-0 | 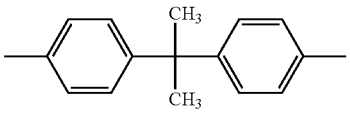 | 11.24 |
-continued
| Unit No. | Structure | Solubility parameter (SP value) |
|---|---|---|
| (A)-1 | 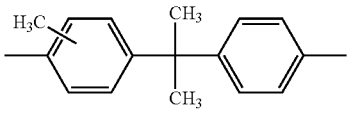 | 11.07 |
| (A)-2-b | 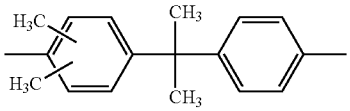 | 10.93 |
| (C)-0 | 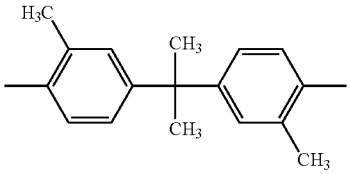 | 10.93 |
| (A)-2-a | 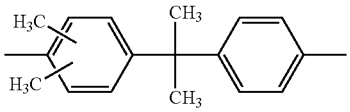 | 10.93 |
| (A)-3 | 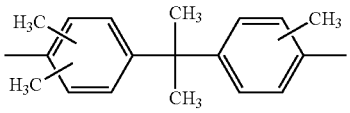 | 10.80 |
| (A)-4 | 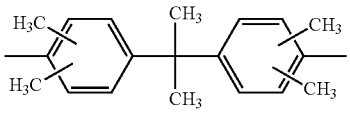 | 10.69 |
| (Oth)-1 | 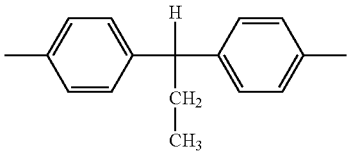 | 11.35 |
| (Oth)-2 | 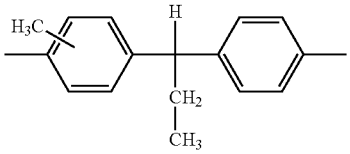 | 11.17 |
| (Oth)-3 | 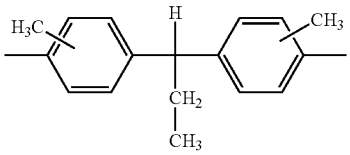 | 11.02 |
| (Oth)-4 | 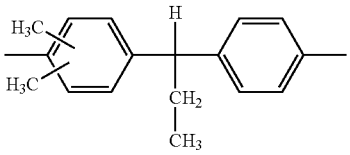 | 10.54 |

-continued
| Unit No. | Structure | Solubility parameter (SP value) |
|---|---|---|
| (B)-0 | 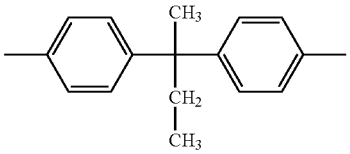 | 11.04 |
| (Oth)-5 | 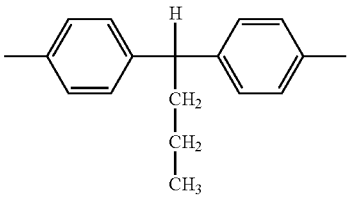 | 11.14 |
| (Oth)-6 | 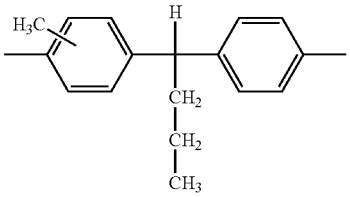 | 10.99 |
| (Oth)-7 | 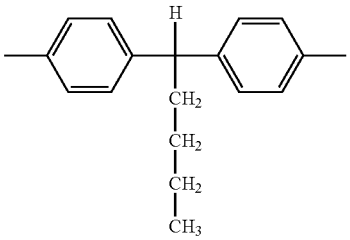 | 10.96 |
| (Oth)-8 | 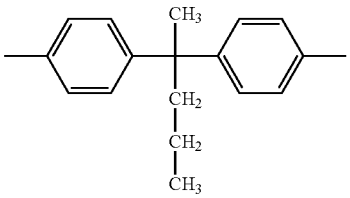 | 10.87 |
| (Oth)-9 | 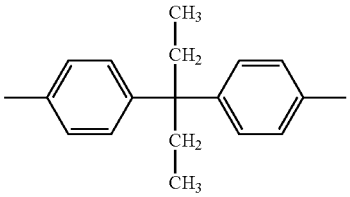 | 10.87 |
| (Oth)-10 | 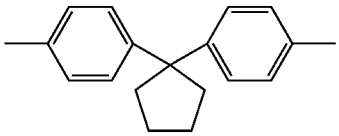 | 11.48 |
| (Oth)-11 | 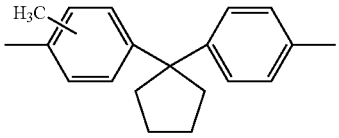 | 11.31 |
-continued
| Unit No. | Structure | Solubility parameter (SP value) |
|---|---|---|
| (Oth)-12 | 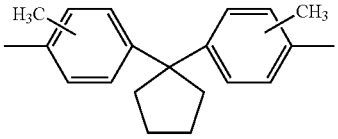 | 11.16 |
| (Oth)-13 | 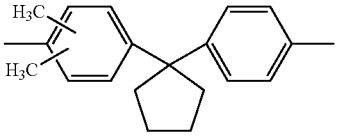 | 11.16 |
| (Oth)-14 | 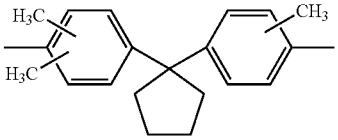 | 11.03 |
| (Oth)-15 | 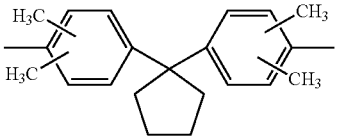 | 10.91 |
| (Z)-0 | 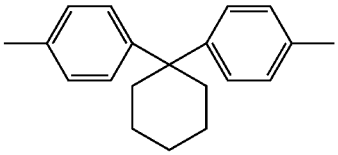 | 11.28 |
| (Z)-1 | 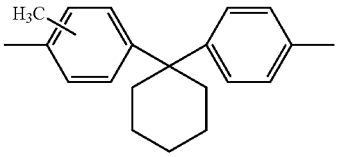 | 11.13 |
| (Z)-2-b | 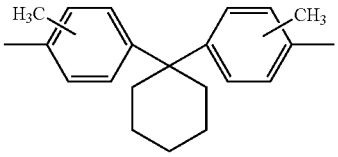 | 11.00 |
| (Z)-2-a | 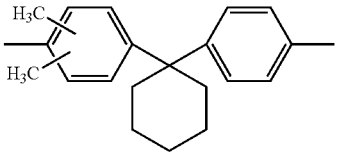 | 11.00 |
| (Z)-3 | 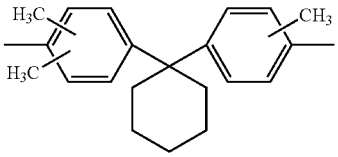 | 10.88 |

-continued

| Unit No. | Structure | Solubility parameter (SP value) |
|---|---|---|
| (Z)-4 | 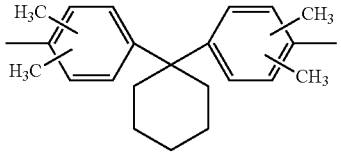 | 10.78 |
| (AP)-0 | 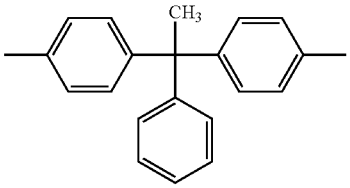 | 11.59 |
| (TP)-0 | 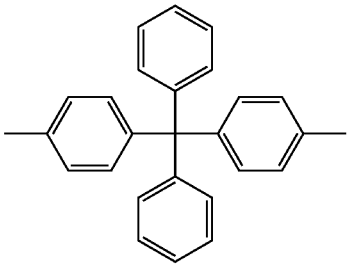 | 11.83 |

The specific polycarbonate copolymers may be used singly or in combination of two or more kinds thereof.

The viscosity average molecular weight of the specific polycarbonate copolymer is preferably 30000 or more, and more preferably 45000 or more. The upper limit of the viscosity average molecular weight of the specific polycarbonate copolymer is preferably 100000 or less.

Here, the viscosity average molecular weight is a value measured by a capillary viscometer.

The specific polycarbonate copolymer is synthesized by a well-known method, for example, by using a method in which a divalent phenol is reacted with a carbonate precursor material such as phosgene and carbonate diesters. Hereinafter, the basic method for this synthesis method will be briefly described.

For example, in the reaction using, for example, phosgene as a carbonate precursor material, the reaction is usually carried out in the presence of an acid binder and a solvent. As the acid binder, for example, pyridine, alkali metal hydroxides such as sodium hydroxide and potassium hydroxide, and the like are used. As the solvent, for example, halogenated hydrocarbons such as methylene chloride and chlorobenzene are used. Further, in order to promote the reaction, for example, a catalyst such as a tertiary amine and a quaternary ammonium salt may be used. The reaction temperature is usually from 0° C. to 40° C., the reaction time is from several minutes to 5 hours, and the pH during the reaction may be usually 10 or more.

In the polymerization reaction, monofunctional phenols that are usually used as a chain terminator may be used. Examples of these monofunctional phenols include phenol, p-tert-butylphenol, p-cumylphenol, and isooctylphenol.

For the specific polycarbonate copolymer, binder resins other than the specific polycarbonate copolymers may be used in combination. However, the content of the specific polycarbonate copolymers in the binder resin is, for example, 10% by weight or less, based on the entire binder resins.

Examples of the binder resin other than the specific polycarbonate copolymer include insulating resins such as polycarbonate resins other than the specific polycarbonate copolymer, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinylacetate resins, polyvinylformal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber, and organic photoconductive polymers such as a polyvinylcarbazole, a polyvinylanthracene, and a polyvinylpyrene. These binder resins may be used singly or in a mixture of two or more kinds thereof.

The blending ratio of the charge transporting material to the binder resin is, for example, preferably 10:1 to 1:5 in terms of the weight ratio.

The charge transporting layer may contain other known additives.

The formation of the charge transporting layer is not particularly limited, and a well-known formation method is used. For example, the charge transporting layer is formed by forming a coating film of a charge transporting layer-forming coating solution obtained by adding the above-described components to a solvent; and drying (optionally, heating) the coating solution.

As a method of coating the charge transporting layer with the coating liquid for charge transporting layer formation, a general method is used such as a dipping coating method, an extrusion coating method, a wire bar coating method, a spray coating method, a blade coating method, a knife coating method, or a curtain coating method.

As a method of dispersing the particles (for example, fluorine resin particles) in the coating liquid for charge transporting layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

The thickness of the charge transporting layer is preferably set to from 5 μm to 50 and more preferably from 10 μm to 40 μm.

Protective Layer

The protective layer is the outermost surface layer in the electrophotographic photoreceptor and constituted with a film formed of a composition including a charge transporting material, fluorine-containing resin particles, and a fluorine-containing dispersant.

Specifically, the protective layer may be constituted with an uncured film formed of a composition including a non-reactive charge transporting material, a binder resin, fluorine-containing resin particles, and a fluorine-containing dispersant, or may be constituted with a cured film formed of a composition including a reactive group-containing charge transporting material, fluorine-containing resin particles, and fluorine-containing dispersant.

However, particularly, the protective layer may be constituted with a cured film. That is, the protective layer may preferably be configured to include a polymer or crosslinked form of a reactive group-containing charge transporting material, fluorine-containing resin particles, and a fluorine-containing dispersant.

Furthermore, the curing method for the cured film involves performing radical polymerization with heat, light, radioactive rays, or the like. If the reaction is controlled not to proceed too quickly, the mechanic strength and the electrical characteristics of the protective layer (outermost surface layer) are improved, and further, unevenness of the film and generation of folds are suppressed, and accordingly, it is preferable to perform the polymerization under the condition where the generation of radicals occurs relatively slowly. From this viewpoint, thermal polymerization that allows the polymerization speed to be easily adjusted is suitable. That is, the composition for forming a cured film constituting the protective layer (outermost surface layer) may preferably include a thermal radical generator or a derivative thereof.

Here, the details of the respective elements of the protective layer (outermost surface layer) constituted with the cured film will be described.

Reactive Group-Containing Charge Transporting Material

As the reactive group-containing charge transporting material, a well-known material is applied, but at least one reactive compound selected from the reactive compounds represented by the general formulae (I) and (II) (hereinafter also referred to as "specific reactive group-containing charge transporting materials") is preferable, from the viewpoints of the electrical characteristics and the mechanic strength.

The reason therefor is not clear, but it is thought to be derived from the reasons shown below.

The reason is thought to be that if a cured film of a composition including at least one selected from the specific reactive group-containing charge transporting material (a film including a polymer or crosslinked form of the specific reactive group-containing charge transporting material) is included as the outermost surface layer, the electrical characteristics and the mechanic strength of the outermost surface layer are both satisfied. The reason therefor is also thought to be that the thickness of the outermost surface layer is increased (for example, 10 μm or more).

The reason is thought to be that the specific reactive group-containing charge transporting material itself is excellent in the charge transporting performance and has a small number of polar groups disturbing the carrier transport, such as —OH and —NH—, and further, the material is linked with a styryl group having a π Electron effective for the carrier transport by polymerization. Therefore, the residual strain is suppressed, and accordingly, formation of a structural trap capturing charges is suppressed.

Furthermore, it is thought that the specific reactive group-containing charge transporting material tends to be more hydrophobic, and thus, moisture is hardly attached thereto, as compared with an acrylic material, and accordingly, the electrical characteristics are maintained for a long period of time.

(I)

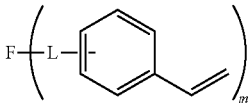

In the general formula (I), F represents a charge transporting skeleton.

L represents a divalent linking group including two or more selected from the group consisting of an alkylene group, an alkenylene group, —C(=O)—, —N(R)—, —S—, and —O—. R represents a hydrogen atom, an alkyl group, an aryl group, or an aralkyl group.

m represents an integer of 1 to 8.

(II)

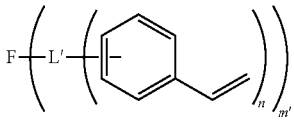

In the general formula (II), F represents a charge transporting skeleton.

L' represents an (n+1)-valent linking group including two or more selected from the group consisting of a trivalent or tetravalent group derived from an alkane or an alkene, an alkylene group, an alkenylene group, —C(=O)—, —N(R)—, —S—, and —O—. R represents a hydrogen atom, an alkyl group, an aryl group, or an aralkyl group. Further, the trivalent or tetravalent group derived from an alkane or an alkene means a group formed by the removal of 3 or 4 hydrogen atoms from an alkane or an alkene. The same shall apply hereinafter.

m' represents an integer of 1 to 6. n represents an integer of 2 to 3.

In the general formulae (I) and (II), F represents a charge transporting skeleton, that is, a structure having a charge transporting property, specifically, structures having a charge transporting property, such as a phthalocyanine compound, a phorphyrin compound, an azobenzene compound, a triarylamine compound, a benzidine compound, an arylalkane compound, an aryl-substituted ethylene compound, a stilbene compound, an anthracene compound, a hydrazone compound, a quinone compound, and a fluorenone compound.

In the general formula (I), examples of the linking group represented by L include:

a divalent linking group having —C(=O)—O— interposed in an alkylene group, a divalent linking group having —C(=O)—N(R)—0 interposed in an alkylene group, a divalent linking group having —C(=O)—S— interposed in an alkylene group, a divalent linking group having —O— interposed in an alkylene group, a divalent linking group having —N(R)— interposed in an alkylene group, and a divalent linking group having —S— interposed in an alkylene group.

Furthermore, the linking group represented by L may have two groups of —C(=O)—O—, —C(=O)—N(R)—, —C(=O)—S—, —O—, or —S— interposed in an alkylene group.

In the general formula (I), specific examples of the linking group represented by L include:

$*—(CH_2)_p—C(=O)—O—(CH_2)_q—$, $*—(CH_2)_p—O—C(=O)—(CH_2)_r—C(=O)—O—(CH_2)_q—$, $*—(CH_2)_p—C(=O)—N(R)—(CH_2)_q—$, $*—(CH_2)_p—C(=O)—S—(CH_2)_q—$, $*—(CH_2)_p—O—(CH_2)_q—$, $*—(CH_2)_p—N(R)—(CH_2)_q—$, $*—(CH_2)_p—S—(CH_2)_q—$, and $*—(CH_2)_p—O—(CH_2)_r—O—(CH_2)_q—$.

Here, in the linking group represented by L, p represents 0, or an integer of 1 to 6 (preferably 1 to 5). q represents an integer of 1 to 6 (preferably 1 to 5). represents an integer of 1 to 6 (preferably 1 to 5).

Further, in the linking group represented by L, "*" represents a site linked to F.

On the other hand, in the general formula (II), examples of the linking group represented by L' include:

an (n+1)-valent linking group having —C(=O)—O— interposed in an alkylene group linked to the branch, an (n+1)-valent linking group having —C(=O)—N(R)— interposed in an alkylene group linked to the branch, an (n+1)-valent linking group having —C(=O)—S— interposed in an alkylene group linked to the branch, an (n+1)-valent linking group having —O— interposed in an alkylene group linked to the branch, an (n+1)-valent linking group having —N(R)— interposed in an alkylene group linked to the branch, and an (n+1)-valent linking group having —S— interposed in an alkylene group linked to the branch.

Furthermore, the linkage represented by L' may have two groups of —C(=O)—O—, —C(=O)—N(R)—, —C(=O)—S—, —O—, or —S— interposed in an alkylene group linked to the branch.

In the general formula (II), specific examples of the linking group represented by L' include:

$*—(CH_2)_p—CH[C(=O)—O—(CH_2)_q—]_2$, $*—(CH_2)_p—CH=C[C(=O)—O—(CH_2)_q—]_2$, $*—(CH_2)_p—CH[C(=O)—N(R)—(CH_2)_q—]_2$, $*—(CH_2)_p—CH[C(=O)—S—(CH_2)_q—]_2$, $*—(CH_2)_p—CH[(CH_2)_r—O—(CH_2)_q—]_2$, $*—(CH_2)_p—CH=C[(CH_2)_r—O—(CH_2)_q—]_2$, $*—(CH_2)_p—CH[(CH_2)_r—N(R)—(CH_2)_q—]_2$, $*—(CH_2)_p—CH[(CH_2)_r—S—(CH_2)_q—]_2$,

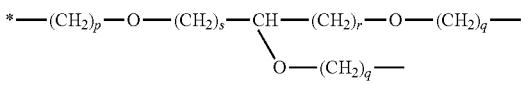

$*—(CH_2)_p—O—C[(CH_2)_r—O—(CH_2)_q—]_3$, and $*—(CH_2)_p—C(=O)—O—C[(CH_2)_r—O—(CH_2)_q—]_3$.

Here, in the linking group represented by L', p represents 0, or an integer of 1 to 6 (preferably 1 to 5). q represents an integer of 1 to 6 (preferably 1 to 5). represents an integer of 1 to 6 (preferably 1 to 5). represents an integer of 1 to 6 (preferably 1 to 5).

Further, in the linking group represented by L', "*" represents a site linked to F.

Among these, in the general formula (II), the linking group represented by L' is preferably $*—(CH_2)_p—CH[C(=O)—O—(CH_2)_q—]_2$, $*—(CH_2)_p—CH=C[C(=O)—O—(CH_2)_q—]_2$, $*—(CH_2)_p—CH[(CH_2)_r—O—(CH_2)_q—]_2$, or $*—(CH_2)_p—CH=C[(CH_2)_r—O—(CH_2)_q—]_2$.

Specifically, the group (corresponding to a group represented by the general formula (IIA-a)) linked to the charge transporting skeleton represented by F of the compound represented by the general formula (II) may preferably be a group represented by the following general formula (IIA-a1), the following general formula (IIA-a2), the following general formula (IIA-a3), or the following general formula (IIA-a-4).

(IIA-a1)

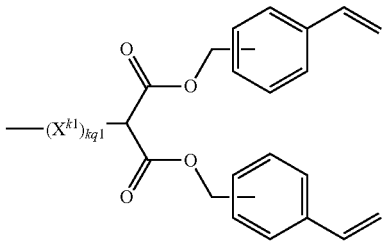

(IIA-a2)

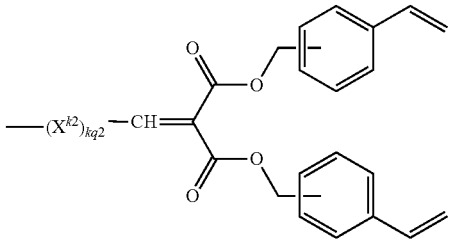

In the general formula (IIA-a1) or (IIA-a2), $X^{k1}$ represents a divalent linking group. Kq1 represents an integer of 0 or 1. $X^{k2}$ represents a divalent linking group. Kq2 represents an integer of 0 or 1.

Here, examples of the divalent linking group represented by $X^{k1}$ and $X^{k2}$ include $—(CH_2)_p—$ (provided that p represents an integer of 1 to 6 (preferably 1 to 5)). Examples of the divalent linking group include an alkyleneoxy group.

(IIA-a3)

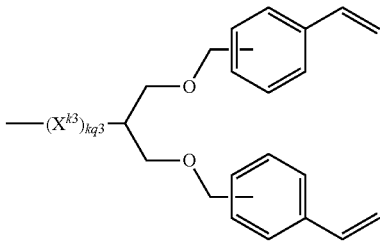

(IIA-a4)

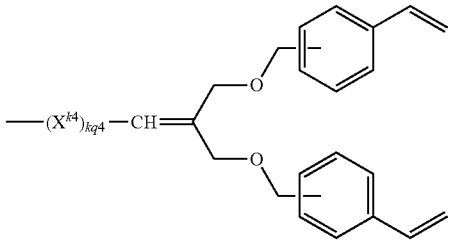

In the general formula (IIA-a3) or (IIA-a4), $X^{k3}$ represents a divalent linking group. Kq3 represents an integer of 0 or 1.

$X^{k4}$ represents a divalent linking group. Kq4 represents an integer of 0 or 1. Here, examples of the divalent linking group represented by $X^{k3}$ and $X^{k4}$ include —$(CH_2)_p$— (provided that p represents an integer of to 6 (preferably 1 to 5)). Examples of the divalent linking group include an alkyleneoxy group.

In the general formulae (I) and (II), in the linking groups represented by L and examples of the alkyl group represented by R of "—N(R)—" include linear or branched alkyl groups having 1 to 5 carbon atoms (preferably 1 to 4 carbon atoms), and specifically, a methyl group, an ethyl group, a propyl group, and a butyl group.

Examples of the aryl group represented by R of "—N(R)—" include aryl groups having 6 to 15 carbon atoms (preferably 6 to 12 carbon atoms), and specifically, a phenyl group, a tolyl group, a xylidyl group, and a naphthyl group.

Examples of the aralkyl group include aralkyl groups having 7 to 15 carbon atoms (preferably 7 to 14 carbon atoms), and specifically, a benzyl group, a phenethyl group, and a biphenylmethylene group.

In the general formulae (I) and (II), m preferably represents an integer of 1 to 6.

m' preferably represents an integer of 1 to 6.

n preferably represents an integer of 2 to 3.

Next, suitable compounds of the reactive compounds represented by the general formulae (I) and (II) will be described.

The reactive compounds represented by the general formulae (I) and (II) are preferably reactive compounds having a charge transporting skeleton (structure having a charge transporting property) derived from a triarylamine compound as F.

Specifically, as the reactive compound represented by the general formula (I), at least one compound selected from the reactive compounds represented by the general formula (I-a), the general formula (I-b), the general formula (I-c), and the general formula (I-d) are suitable.

On the other hand, as the reactive compound represented by the general formula (II), the reactive compound represented by the general formula (II-a) is suitable.

Reactive Compound Represented by General Formula (I-a)

The reactive compound represented by the general formula (I-a) will be described.

If the reactive compound represented by the general formula (I-a) is applied as the specific reactive group-containing charge transporting material, the deterioration of the electrical characteristics due to the environmental change is easily suppressed. The reason is not clear, but is thought to be as follows.

First, it may be thought that for the reactive compound having a (meth)acryl group used in the related art, the (meth) acryl group is highly hydrophilic with respect to the skeleton site exhibiting the charge transporting performance during the polymerization. As a result, a certain kind of layer separation state is formed, and thus, the hopping conduction is disturbed. Therefore, it is thought that the charge transporting film including a polymer or crosslinked form of a (meth)acryl group-containing reactive compound exhibits deterioration of the efficiency in the charge transport, and further, the partial moisture adsorption or the like causes a decrease in the environmental stability.

Meanwhile, the reactive compound represented by the general formula (I-a) has a vinyl chain polymerizable group having low hydrophilicity, and further, has plural skeletons exhibiting the charge transporting performance in one molecule, and the skeletons are linked to each other with a flexible linking group having no conjugate bond such as an aromatic ring and a conjugate double bond. It is thought that such a structure promotes efficient charge transporting performance and high strength, and suppresses the formation of the layer separation state during the polymerization. As a result, it is thought that the protective layer (outermost surface layer) including the polymer or crosslinked form of the reactive compound represented by the general formula (I-a) is excellent in both of the charge transporting performance and the mechanic strength, and further, the environment dependency (temperature and humidity dependency) of the charge transporting performance may be decreased.

As described above, it is thought that if the reactive compound represented by the general formula (I-a) is applied, the deterioration of the electrical characteristics due to the environmental change is easily suppressed.

(I-a)

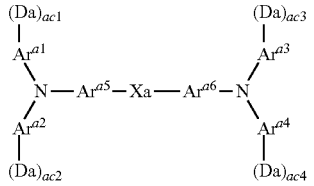

In the general formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group. Xa represents a divalent linking group formed by a combination of the groups selected from an alkylene group, —O—, —S—, and an ester. Da represents a group represented by the following general formula (IA-a). ac1 to ac4 each independently represent an integer of 0 to 2. However, the total number of Da is 1 or 2.

(IA-a)

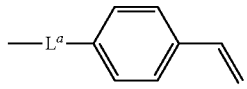

In the general formula (IA-a), $L^a$ is represented by*—$(CH_2)_{a0}$—O—$CH_2$— and represents a divalent linking group linked to a group represented by $Ar^{a1}$ to $Ar^{a4}$ at *. a0 represents an integer of 1 or 2.

Hereinafter, the details of the general formula (I-a) will be described.

In the general formula (I-a), the substituted or unsubstituted aryl groups represented by $Ar^{a1}$ to $Ar^{a4}$ may be the same as or different from each other.

Here, examples of the substituents in the substituted aryl group, those other than "Da" include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom.

In the general formula (I-a), $Ar^{a1}$ to $Ar^{a4}$ are preferably any one of the following structural formulae (1) to (7).

Furthermore, the following structural formulae (1) to (7) are described together with "-$(D)_C$", which totally refers to "-$(Da)_{ac1}$" to "-$(Da)_{ac1}$" that may be linked to each of $Ar^{a1}$ to $Ar^{a4}$.

(1)

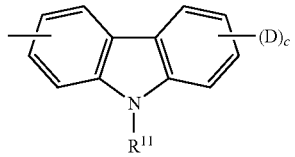

-continued (2)

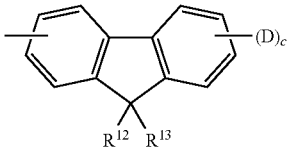

(3)

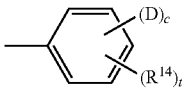

(4)

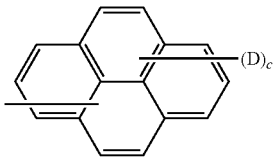

(5)

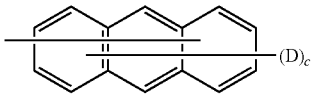

(6)

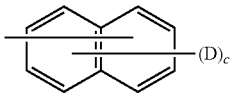

(7)

In the structural formulae (1) to (7), $R^{11}$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms. $R^{12}$ and $R^{13}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. $R^{14}$'s each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group. represents 0 or 1. t represents an integer of 0 to 3. Z' represents a divalent organic linking group.

Here, in the formula (7), Ar is preferably one represented by the following structural formula (8) or (9).

(8)

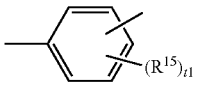

(9)

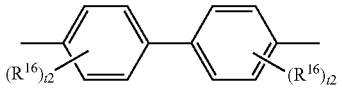

In the structural formulae (8) and (9), $R^{15}$ and $R^{16}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t1 and t2 each represent an integer of 0 to 3.

Furthermore, in the formula (7), Z' preferably represents one represented by any one of the following structural formulae (10) to (17).

(10)

(11)

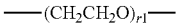

(12)

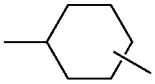

(13)

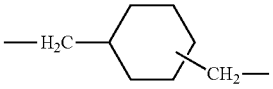

(14)

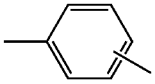

(15)

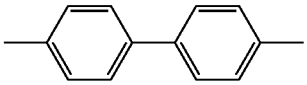

(16)

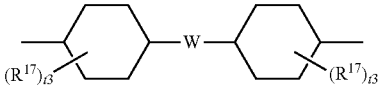

(17)

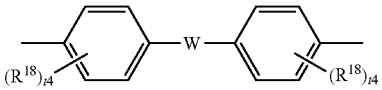

In the structural formulae (10) to (17), $R^{17}$ and $R^{18}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. represents a divalent group. q1 and r1 each independently represent an integer of 1 to 10. t3 and t4 each represent an integer of 0 to 3.

In the structural formulae (16) to (17), W is preferably any one of the divalent groups represented by the following structural formulae (18) to (26). However, in the formula (25), u represents an integer of 0 to 3.

(18)

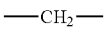

(19)

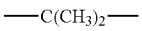

(20)

(21)

(22)

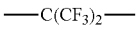

(23)

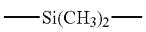

-continued (24)

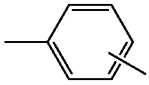

(25)

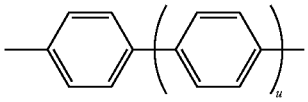

(26)

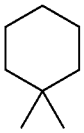

In the general formula (I-a), in the substituted or unsubstituted arylene group represented by $Ar^{a5}$ and $Ar^{a6}$, examples of the arylene group include arylene groups formed by the removal of one hydrogen atom at a desired position from the aryl group exemplified in the description of $Ar^{a1}$ to $Ar^{a4}$.

Furthermore, examples of the substituent in the substituted arylene group include are the same as those exemplified as the substituent other than "Da" in the substituted aryl group in the description of $Ar^{a1}$ to $Ar^{a4}$.

In the general formula (I-a), the divalent linking group represented by Xa is an alkylene group, or a divalent group formed by the combination of the groups selected from alkylene group, —O—, —S—, and an ester, and is a linking group including no conjugate bond such as an aromatic ring and a conjugate double bond.

Specifically, examples of the divalent linking group represented by Xa include an alkylene group having 1 to 10 carbon atoms, as well as a divalent group formed by a combination of an alkylene group having 1 to 10 carbon atoms with a group selected from —O—, —S—, —O—C(═O)—, and —C(═O)—O—.

In addition, in the case where the divalent linking group represented by Xa is an alkylene group, the alkylene group may have a substituent such as alkyl, alkoxy, and halogen, and two of these substituents may be bonded to have the structure such as the divalent linking group represented by the structural formula (26) described as the specific examples of W in the structural formulae (16) to (17).

Reactive Compound Represented by General Formula (I-b)

The reactive compound represented by the general formula (I-b) will be described.

If the reactive compound represented by the general formula (I-b) is applied as the specific reactive group-containing charge transporting material, the abrasion of the protective layer (outermost surface layer) is suppressed, and further, the generation of the uneven density of the image is easily suppressed. The reason is not clear, but is thought to be as follows.

First, when the bulky charge transporting skeleton and the polymerization site (styryl group) are structurally close to each other, and rigid, it is difficult for polymerization moieties to move, residual strain due to a curing reaction easily remains, and the charge transporting skeleton is deformed, and therefore, there occurs a change in the level of HOMO (highest occupied molecular orbital) in charge of carrier transport and as a result, a state where the energy distribution spreads (disorder in energy: large σ) is easily caused.

Meanwhile, through a methylene group or an ether group, it is easy to provide the molecule structure with flexibility and a small σ is easily obtained. Further, the methylene group or the ether group has a small dipole moment, as compared with an ester group, an amide group, or the like, and this effect contributes to a decrease in σ, thereby improving the electrical characteristics. Further, by providing the molecular structure with flexibility, the degree of freedom of the movement of the reactive site is increased and the reaction rate is improved, which is thought to yield a film having a high strength.

From these, a structure where a linking chain having sufficient flexibility is interposed between the charge transporting skeleton and the polymerization site is preferable.

Consequently, it is thought that the reactive compound represented by the general formula (I-b) has an increased molecular weight of the molecule itself by the curing reaction, it becomes difficult for the weight center to move, and the degree of freedom of the styryl group is high. As a result, it is thought that the protective layer (outermost surface layer) including a polymer or crosslinked form of the reactive compound represented by the general formula (I-b) has excellent electrical characteristics and high strength.

From the above, if the reactive compound represented by the general formula (I-b) is applied, the abrasion of the protective layer (outermost surface layer) is suppressed, and further, the generation of the uneven density of the image is easily suppressed.

(I-b)

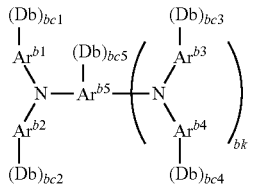

In the general formula (I-b), $Ar^{b1}$ to $Ar^{b4}$ each independently represent a substituted or unsubstituted aryl group. $Ar^{b5}$ represents a substituted or unsubstituted aryl group, or a substituted or unsubstituted arylene group. Db represents a group represented by the following general formula (IA-b). bc1 to bc5 each independently represent an integer of 0 to 2. bk represents 0 or 1. However, the total number of Db is 1 or 2.

(IA-b)

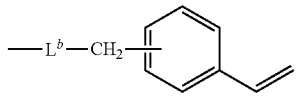

In the general formula (IA-b), $L^b$ includes a group represented by *—$(CH_2)_{bn}$—O— and represents a divalent linking group linked to a group represented by $Ar^{b1}$ to $Ar^{b5}$ at *. bn represents an integer of 3 to 6.

Hereinafter, the details of the general formula (I-b) will be described.

In the general formula (I-b), the substituted or unsubstituted aryl groups represented by $Ar^{b1}$ to $Ar^{b4}$ are the same as the substituted or unsubstituted aryl groups represented by $Ar^{a1}$ to $Ar^{a4}$ in the general formula (I-a).

When bk is 0, $Ar^{b5}$ represents a substituted or unsubstituted aryl group, and the substituted or unsubstituted aryl group is the same as the substituted or unsubstituted aryl groups represented by $Ar^{a1}$ to $Ar^{a4}$ in the general formula (I-a).

When bk is 1, $Ar^{b5}$ represents a substituted or unsubstituted arylene group, and the substituted or unsubstituted arylene group is the same as the substituted or unsubstituted arylene groups represented by $Ar^{a5}$ and $Ar^{a6}$ in the general formula (I-a).

Next, the details of the general formula (IA-b) will be described.

In the general formula (IA-b), examples of the divalent linking group represented by $L^b$ include:

$$*—(CH_2)_{bp}—O—, \text{ and}$$

$$*—(CH_2)_{bp}—O—(CH_2)_{bq}—O—.$$

Here, in the linking group represented by $L^b$, by represents an integer of 3 to 6 (preferably 3 to 5). bq represents an integer of 1 to 6 (preferably 1 to 5).

Further, in the linking group represented by $L^b$, "*" represents a site linked to a group represented by $Ar^{b1}$ to $Ar^{b5}$.

Reactive Compound Represented by General Formula (I-c)

The reactive compound represented by the general formula (I-c) will be described.

If the reactive compound represented by the general formula (I-c) is applied as the specific reactive group-containing charge transporting material, it is difficult to generate scratches on the surface even when used repeatedly, and further, deterioration of the image quality is easily suppressed. The reason therefor is not clear, but is thought to be as follows.

First, it is thought that film shrinkage accompanying a polymerization reaction or a crosslinking reaction, or aggregation of the charge transporting structure, and the structure in the vicinity of a chain polymerizable group occur when an outermost surface layer including a polymer or crosslinked form of the reactive group-containing charge transporting material is formed. Therefore, it is thought that when a mechanic load is applied to an electrophotographic photoreceptor surface due to repeated use, the film itself is abraded or the chemical structure in the molecule is cut, and the film shrinkage or the aggregation state changes, the electrical characteristics as the electrophotographic photoreceptor changes, and thus, deterioration of the image quality occurs.

On the other hand, it is thought that since the reactive compound represented by the general formula (I-c) has a styrene skeleton as the chain polymerizable group, the compatibility with an aryl group which is a main skeleton of the charge transporting material is attained, and the film shrinkage or the aggregation of the charge transporting structure due to the polymerization reaction or the crosslinking reaction, and the aggregation of the structure in the vicinity of the chain polymerizable group is suppressed. As a result, it is thought that in the electrophotographic photoreceptor including the protective layer (outermost surface layer) including a polymer or crosslinked form of the reactive compound represented by the general formula (I-c), deterioration of the image quality due to the repeated use is suppressed.

In addition, it is though that for the reactive compound represented by the general formula (I-c), a charge transporting skeleton and a styrene skeleton are linked via a linking group including a specific group such as —C(=O)—, —N(R)—, and —S—, and thus, the interaction between the specific group and a nitrogen atom in the charge transporting skeleton, and between the specific groups, and the like occur, and as a result, it is also thought that the protective layer (outermost surface layer) including a polymer or crosslinked form of the reactive compound represented by the general formula (I-c) has a further improved strength.

As described above, it is thought that if the reactive compound represented by the general formula (I-c) is applied, it is difficult to generate scratches on the surface even when used repeatedly, and further, the deterioration of the image quality is easily suppressed.

In addition, it is thought that a specific group such as —N(R)—, —S—, and the like causes deterioration of a charge transport property and deterioration of the image quality under the conditions of high humidity due to its polarity or hydrophilicity, but the reactive compound represented by the general formula (I-c) has a styrene skeleton having higher hydrophobicity than (meth)acryl or the like as a chain polymerizable group, and thus, it is difficult for deterioration of charge transporting property and deterioration of the image quality, such as development of the residual image (ghost) caused by the history of the previous cycle to occur.

(I-c)

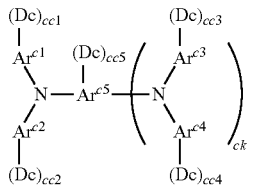

In the general formula (I-c), $Ar^{c1}$ to $Ar^{c4}$ each independently represent a substituted or unsubstituted aryl group. $Ar^{c5}$ represents a substituted or unsubstituted aryl group, or a substituted or unsubstituted arylene group. Dc represents a group represented by the following general formula (IA-c). cc1 to cc5 each independently represent an integer of 0 to 2. ck represents 0 or 1. However, the total number of Dc is from 1 to 8.

(IA-c)

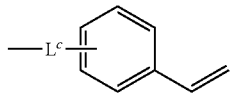

In the general formula (IA-c), $L^c$ represents a divalent linking group including one or more groups selected from the group consisting of the groups formed by a combination of —C(=O)—, —N(R)—, —S—, or —C(=O)—, and —O—, —N(R)—, or —S—. R represents a hydrogen atom, an alkyl group, an aryl group, or an aralkyl group.

Hereinafter, the details of the general formula (I-c) will be described.

In the general formula (I-c), the substituted or unsubstituted aryl groups represented by $Ar^{c1}$ to $Ar^{c4}$ are the same as the substituted or unsubstituted aryl groups represented by $Ar^{a1}$ to $Ar^{a4}$ in the general formula (I-a).

When ck is 0, $Ar^{c5}$ represents a substituted or unsubstituted aryl group, and the substituted or unsubstituted aryl group is the same as the substituted or unsubstituted aryl groups represented by $Ar^{a1}$ to $Ar^{a4}$ in the general formula (I-a).

When ck is 1, $Ar^{c5}$ represents a substituted or unsubstituted arylene group, and the substituted or unsubstituted arylene group is the same as the substituted or unsubstituted arylene groups represented by $Ar^{a5}$ and $Ar^{a6}$ in the general formula (I-a).

From the viewpoint of obtaining a protective layer (outermost surface layer) having a higher strength, the total number of Dc is preferably 2 or more, and more preferably 4 or more.

Generally, if the number of the chain polymerizable groups in one molecule is too large, as the polymerization (crosslinking) reaction proceeds, it is difficult for the molecule to move, the chain polymerization reactivity is decreased, and the ratio of the unreacted chain polymerizable groups is increased, and thus, the total number of Dc is preferably 7 or less, and more preferably 6 or less.

Next, the details of the general formula (IA-c) will be described.

In the general formula (IA-c), $L^C$ represents a divalent linking group including one or more groups (hereinafter also referred to as "specific linking groups") selected from the group consisting of the groups formed by a combination of —C(=O)—, —N(R)—, —S—, or —C(=O)—, and —O—, —N(R)—, or —S—.

Here, from the viewpoint of a balance of the strength of the protective layer (outermost surface layer) and the polarity (hydrophilicity/hydrophobicity), the specific linking group is, for example, —C(=O)—, —N(R)—, —S—, —C(=O)—O—, —C(=O)—N(R)—, —C(=O)—S—, —O—C(=O)—O—, —O—C(=O)—N(R)—, preferably —N(R)—, —S—, —C(=O)—O—, —C(=O)—N(R)—, or —C(=O)—O—, and more preferably —C(=O)—O—.

Furthermore, examples of the divalent linking group represented by $L^c$ include divalent linking groups formed by the combination of the specific linking group with a saturated hydrocarbon (including linear, branched, or cyclic ones) or residues of aromatic hydrocarbons, and an oxygen atom, and in particular, divalent linking groups formed by the combination of the specific linking group with a residue of a linear saturated hydrocarbon and an oxygen atom.

The total number of the carbon atoms included in the divalent linking group represented by $L^c$ is, for example, from 1 to 20, and preferably from 2 to 10, from the viewpoint of the density of a styrene skeleton in the molecule and the chain polymerization reactivity.

In the general formula (IA-c), specific examples of the divalent linking group represented by $L^c$ include:

$*—(CH_2)_{cp}—C(=O)—O—(CH_2)_{cq}—$, $*—(CH_2)_{cp}—O—C(=O)—(CH_2)_{cr}—C(=O)—O—(CH_2)_{cq}—$, $*—(CH_2)_{cp}—C(=O)—N(R)—(CH_2)_{cq}—$, $*—(CH_2)_{cp}—C(=O)—S—(CH_2)_{cq}—$, $(CH_2)_{cp}—N(R)—(CH_2)_{cq}—$, and $*—(CH_2)_{cp}—S—(CH_2)_{cq}—$.

Here, in the linking group represented by $L^c$, cp represents 0, or an integer of 1 to 6 (preferably 1 to 5). cg represents an integer of 1 to 6 (preferably 1 to 5). cr represents an integer of 1 to 6 (preferably 1 to 5).

Furthermore, in the linking group represented by $L^c$, "*" represents a site linked to a group represented by $Ar^{c1}$ to $Ar^{c5}$.

Among these, in the general formula (IA-c), the divalent linking group represented by $L^c$ is preferably $*—(CH_2)_{cp}—C(=O)—O—CH_2—$. That is, the group represented by the general formula (IA-c) is preferably a group represented by the following general formula (IA-c1). However, in the general formula (IA-c1), cp1 represents an integer of 0 to 4.

(IA-c1)

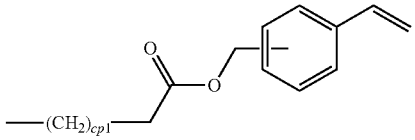

Reactive Compound Represented by General Formula (I-d)

The reactive compound represented by the general formula (I-d) will be described.

If the reactive compound represented by the general formula (I-d) is applied as the specific reactive group-containing charge transporting material, the abrasion of the protective layer (outermost surface layer) is suppressed, and further, the generation of the uneven density of the image is easily suppressed. The reason is not clear, but is thought to be the same as for the reactive compound represented by the general formula (I-b).

Particularly, it is thought that since the reactive compound represented by the general formula (I-d) has a large total number of Dd of 3 to 8, as compared with the general formula (I-b), the formed crosslinked form easily forms a more highly crosslinked structure (crosslinked network) and the abrasion of the protective layer (outermost surface layer) is more easily suppressed.

(I-d)

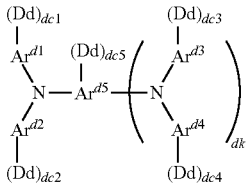

In the general formula (I-d), $Ar^{d1}$ to $Ar^{d4}$ each independently represent a substituted or unsubstituted aryl group. $Ar^{d5}$ represents a substituted or unsubstituted aryl group, or a substituted or unsubstituted arylene group. Dd represents a group represented by the following general formula (IA-d). dc1 to dc5 each independently represent an integer of 0 to 2. dk represents 0 or 1. However, the total number of Dd is from 3 to 8.

(IA-d)

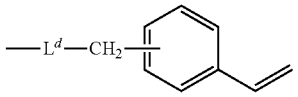

In the general formula (IA-d), $L^d$ includes a group represented by $*—(CH_2)_{dn}—O—$, and represents a divalent linking group linked to a group represented by $Ar^{d1}$ to $Ar^{d5}$ at *. do represents an integer of 1 to 6.

Hereinafter, the details of the general formula (1-d) will be described.

In the general formula (I-d), the substituted or unsubstituted aryl groups represented by $Ar^{d1}$ to $Ar^{d4}$ are the same as the substituted or unsubstituted aryl groups represented by $Ar^{a1}$ to $Ar^{a4}$ in the general formula (I-a).

When dk is 0, $Ar^{d5}$ represents a substituted or unsubstituted aryl group, and the substituted or unsubstituted aryl group is the same as the substituted or unsubstituted aryl groups represented by $Ar^{a1}$ to $Ar^{a4}$ in the general formula (I-a).

When dk is 1, $Ar^{d5}$ represents a substituted or unsubstituted arylene group, and the substituted or unsubstituted arylene group is the same as the substituted or unsubstituted arylene groups represented by $Ar^{a5}$ and $Ar^{a6}$ in the general formula (I-a).

The total number of Dd is preferably 4 or more, from the viewpoint of obtaining a protective layer (outermost surface layer) having a higher strength.

Next, the details of the general formula (IA-d) will be described.

In the general formula (IA-d), examples of the divalent linking group represented by $L^d$ include:

$$*—(CH_2)_{dp}—O—, \text{ and}$$

$$*—(CH_2)_{dp}—O—(CH_2)_{dq}—O—.$$

Here, in the linking group represented by $L^d$, dp represents an integer of 1 to 6 (preferably 1 to 5). dq represents an integer of 1 to 6 (preferably 1 to 5).

Furthermore, in the linking group represented by $L^d$, "*" represents a site linked to a group represented by $Ar^{a1}$ to $Ar^{d5}$.

Reactive Compound Represented by General Formula (II-a)

The reactive compound represented by the general formula (II-a) will be described.

When the reactive compound represented by the general formula (II) (in particular, the general formula (II-a)) is applied as the specific reactive group-containing charge transporting material, the deterioration of the electrical characteristics is easily suppressed even when used repeatedly for a long period of time. The reason is not clear, but is thought to be as follows.

First, the reactive compound represented by the general formula (II) (in particular, the general formula (II-a)) is a compound having 2 or 3 chain polymerizable reactive groups (styrene groups) via one linking group from the charge transporting skeleton.

Consequently, it is thought that, owing to the presence of the linking group, the reactive compound represented by the general formula (II) (in particular, the general formula (II-a)) hardly causes strain in the charge transporting skeleton when polymerized or crosslinked while maintaining high curing degrees and number of crosslinked moieties, and excellent charge transporting performance is also easily achieved with a high curing degree.

Furthermore, the charge transporting compound having a (meth)acryl group, which has been used in the related art, easily causes strain as described above, the reactive site has high hydrophilicity, and the charge transporting site has high hydrophobicity, and as a result, a microscopic phase separation (microphase separation) easily occurs. However, it is thought that the reactive compound represented by the general formula (II) (in particular, the general formula (II-a)) has a styrene group as a reactive group, and further, when cured (crosslinked), it has a structure having a linking group that hardly causes strain in the charge transporting skeleton, the reactive site and the charge transporting site are both hydrophobic, and the phase separation hardly occurs, and as a result, efficient charge transporting performance and increase in strength are obtained. As a result, it is thought that the protective layer (outermost surface layer) including the polymer or crosslinked form of the reactive compound represented by the general formula (II) (in particular, the general formula (II-a)) has excellent mechanic strength as well as superior charge transporting performance (electrical characteristics).

As a result, if the reactive compound represented by the general formula (II) (in particular, the general formula (II-a)) is applied, it is thought that the deterioration of the electrical characteristics even when used repeatedly for a long period of time is easily suppressed.

(II-a)

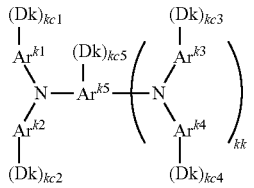

In the general formula (II-a), $Ar^{k1}$ to $Ar^{k4}$ each independently represent a substituted or unsubstituted aryl group. $Ar^{k5}$ represents a substituted or unsubstituted aryl group, or a substituted or unsubstituted arylene group. Dk represents a group represented by the following general formula (IIA-a). kc1 to kc5 each independently represent an integer of 0 to 2. kk represents 0 or 1. However, the total number of Dk is from 1 to 8.

(IIA-a)

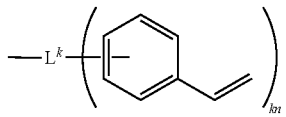

In the general formula (IIA-a), $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—. R represents a hydrogen atom, an alkyl group, an aryl group, or an aralkyl group. kn represents an integer of 2 to 3.

Hereinafter, the details of the general formula (II-a) will be described.

In the general formula (II-a), the substituted or unsubstituted aryl groups represented by $Ar^{k1}$ to $Ar^{k4}$ are the same as the substituted or unsubstituted aryl groups represented by $Ar^{a1}$ to $Ar^{a4}$ in the general formula (I-a).

When kk is 0, $Ar^{k5}$ represents a substituted or unsubstituted aryl group, and the substituted or unsubstituted aryl group is the same as the substituted or unsubstituted aryl groups represented by $Ar^{a1}$ to $Ar^{a4}$ in the general formula (I-a).

When kk is 1, $Ar^{k5}$ represents a substituted or unsubstituted arylene group, and the substituted or unsubstituted arylene group is the same as the substituted or unsubstituted arylene groups represented by $Ar^{a5}$ and $Ar^{a6}$ in the general formula (I-a).

From the viewpoint of obtaining a protective layer (outermost surface layer) having a higher strength, the total number of Dk is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the unreacted chain polymerizable groups is increased, and thus, the total number of Dk is preferably 7 or less, and more preferably 6 or less.

Next, the details of the general formula (IIA-a) will be described.

In the general formula (IIA-a), the (kn+1)-valent linking group represented by $L^k$ is the same as, for example, the (n+1)-valent linking group represented by L' in the general formula (II-a).

Next, the details of the specific reactive group-containing charge transporting material are shown.

Specifically, specific examples of the charge transporting skeleton F (for example, a site corresponding to the skeleton excluding Da in the general formula (I-a) and Dk in the general formula (II-a)) of the general formulae (I) and (II), and specific examples of the functional group linked to the charge transporting skeleton F (for example, the site corresponding to Da in the general formula (I-a) and Dk in the general formula (II-a)), as well as specific examples of the reactive compounds represented by the general formulae (I) and (II) are shown below, but are not limited thereto.

Furthermore, the "*" moiety of the specific examples of the charge transporting skeleton F of the general formulae (I) and (II) means that the "*" moiety of the functional group linked to the charge transporting skeleton F is linked.

That is, for example, the exemplary compound (I-b)-1 is shown as a specific example of the charge transporting skeleton F: (M1)-1 and a specific example of the functional group: (R2)-1, but the specific structures are shown as the following structures.

(I-b)-1

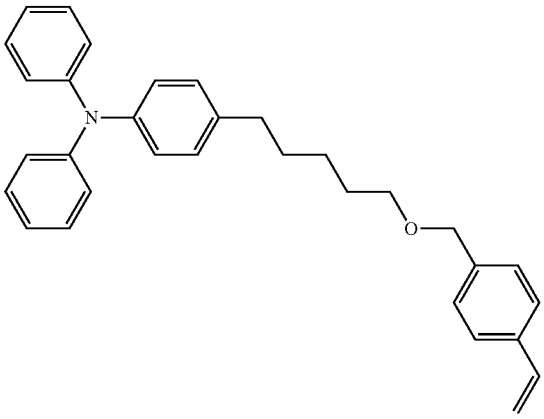

First, specific examples of the charge transporting skeleton F are shown below.

(M1)-1

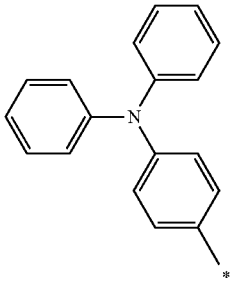

-continued (M1)-2

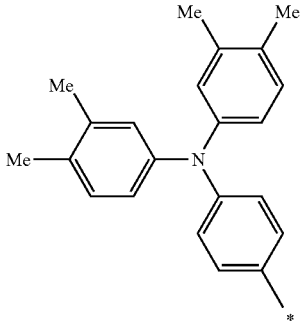

(M1)-3

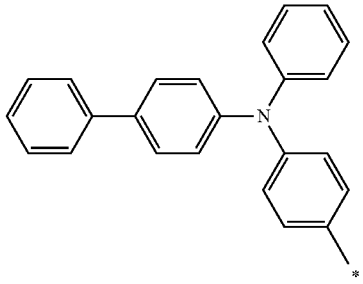

(M1)-4

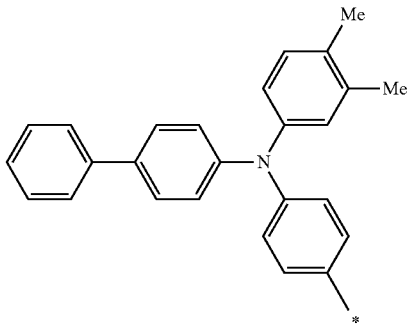

(M1)-5

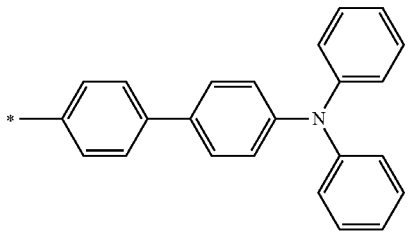

(M1)-6

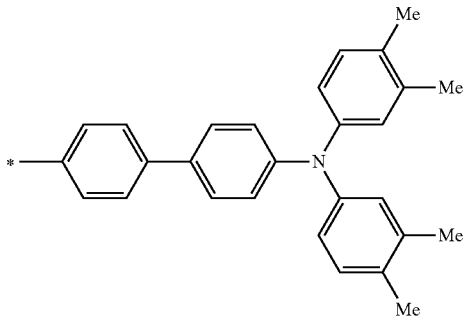

-continued
(M1)-7
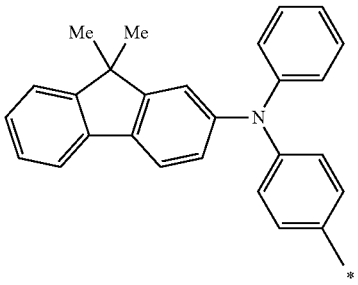
(M1)-8
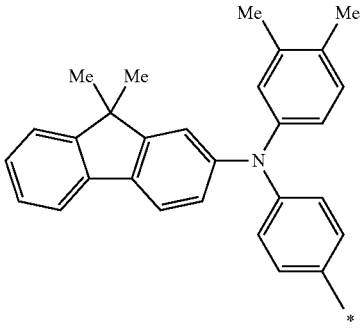
(M1)-9
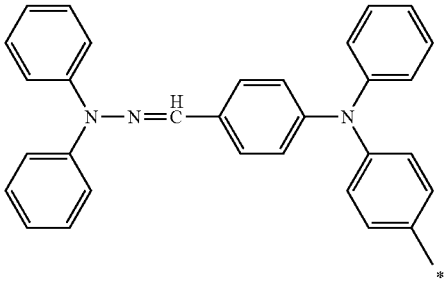
(M1)-10
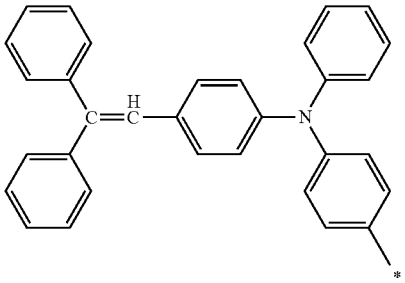
(M1)-11
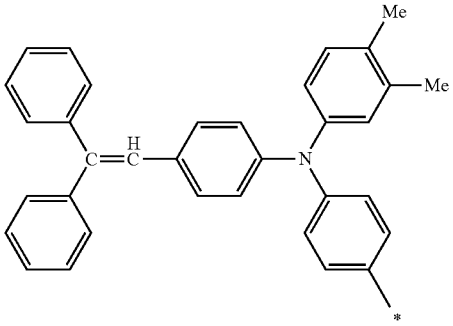
-continued
(M1)-12
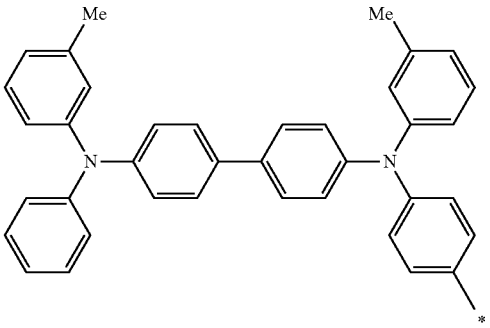
(M1)-13
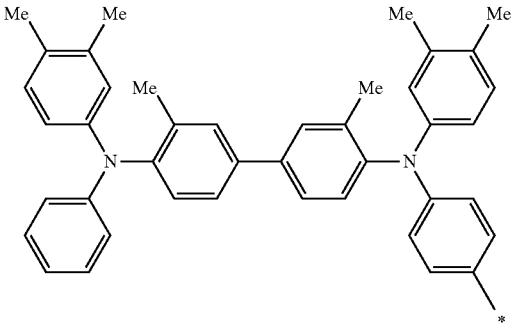
(M1)-14
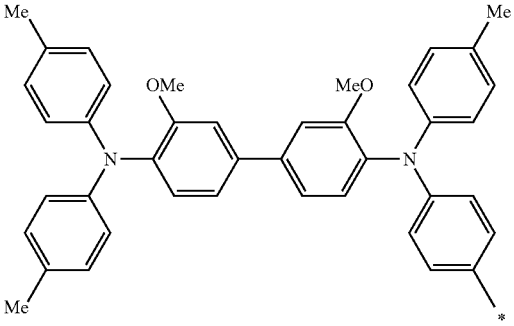
(M1)-15
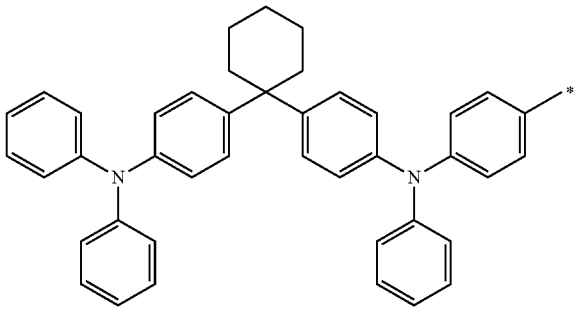

-continued
(M1)-16
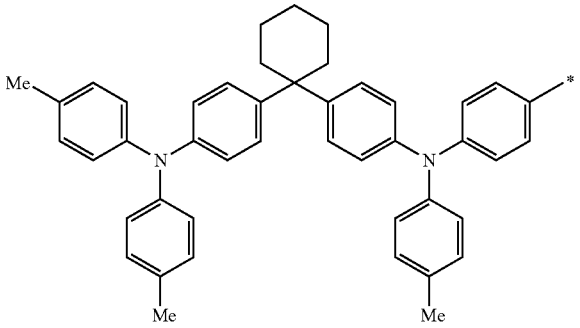
(M1)-17
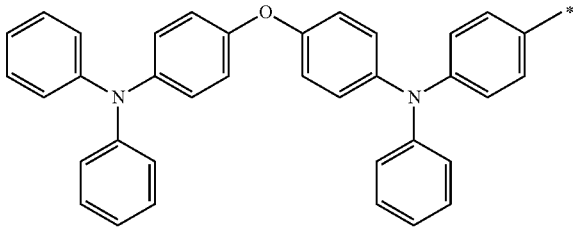
(M1)-18
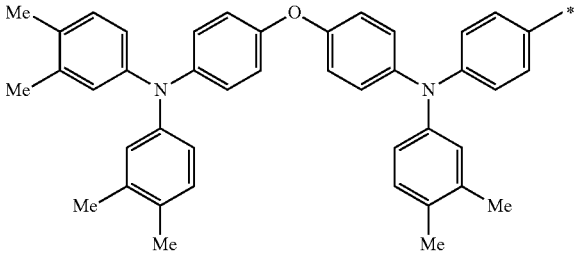
(M1)-19
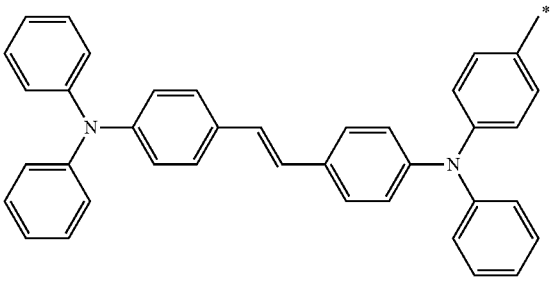
(M1)-20
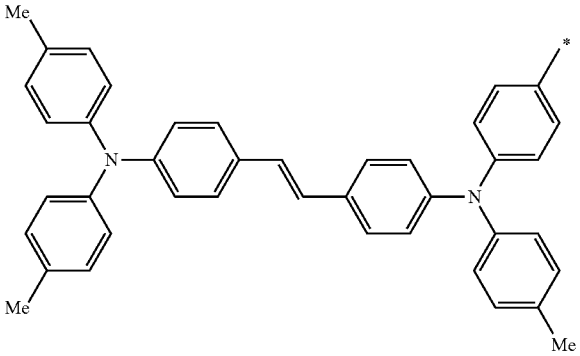
-continued
(M1)-21
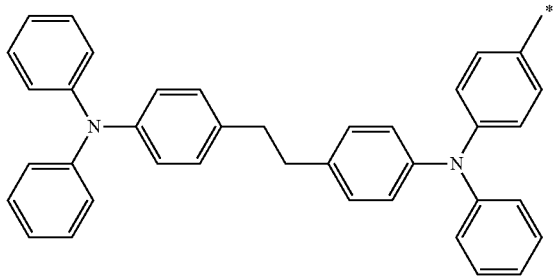
(M1)-22
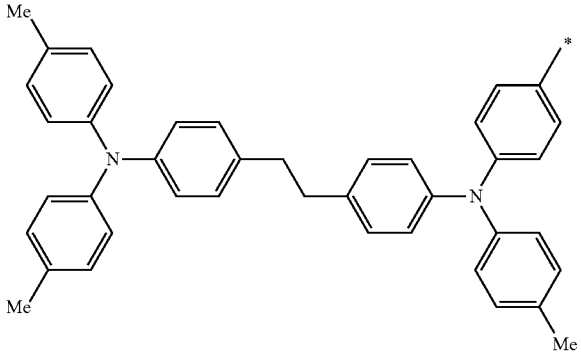
(M2)-1
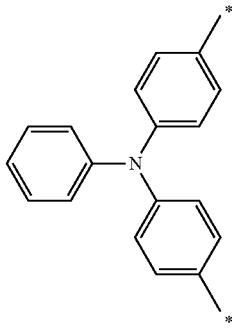
(M2)-2
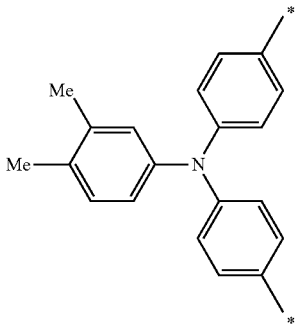

-continued
(M2)-3
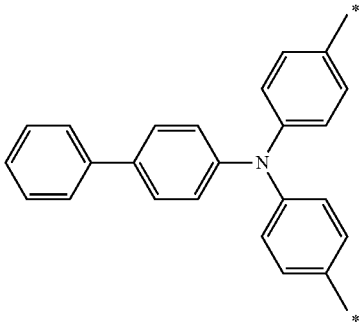
(M2)-4
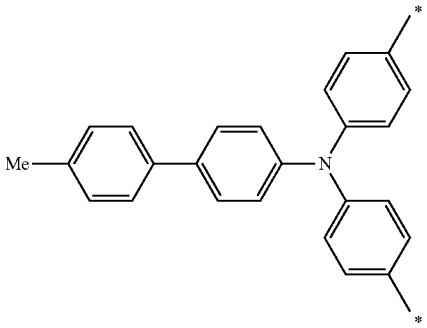
(M2)-5
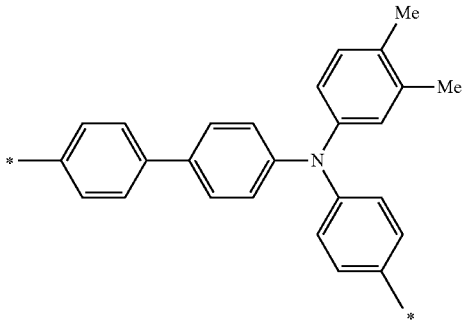
(M2)-6
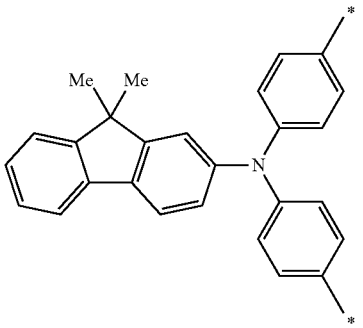
-continued
(M2)-7
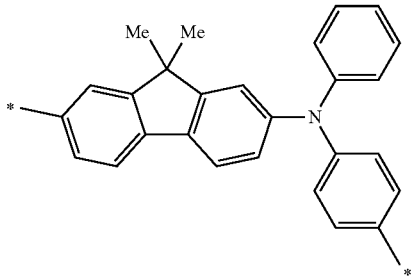
(M2)-8
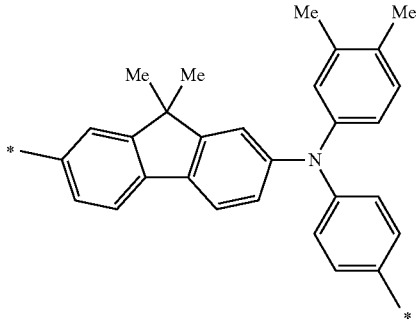
(M2)-9
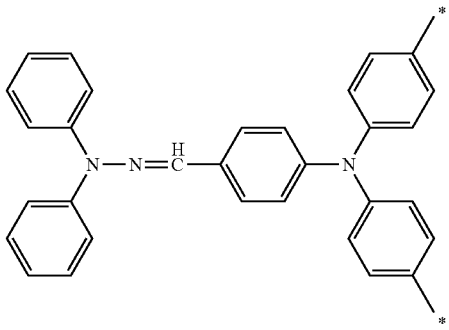
(M2)-10
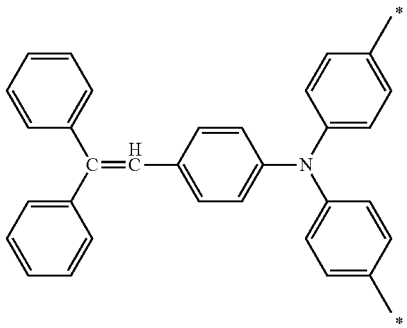

-continued
(M2)-11
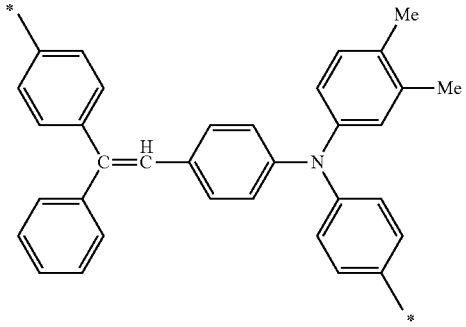
(M2)-12
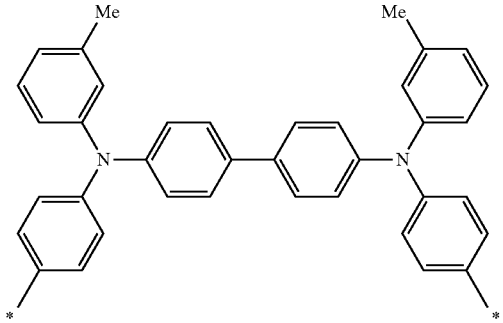
(M2)-13
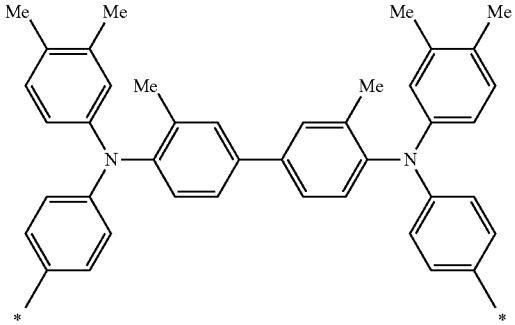
(M2)-14
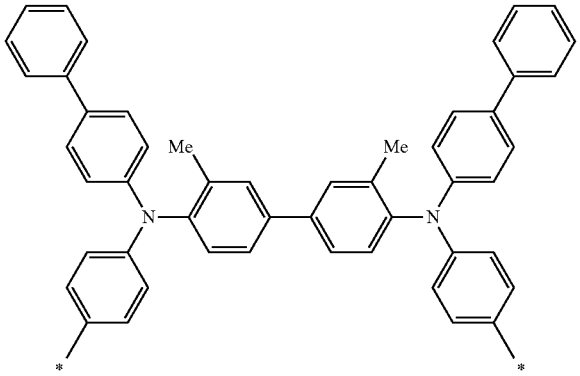
-continued
(M2)-15
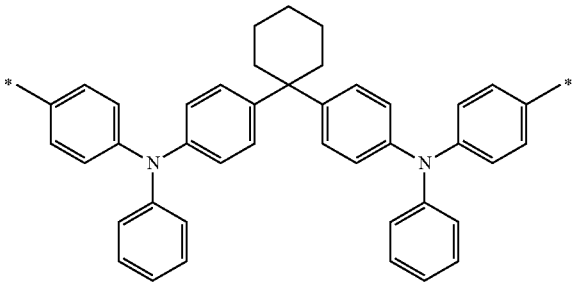
(M2)-16
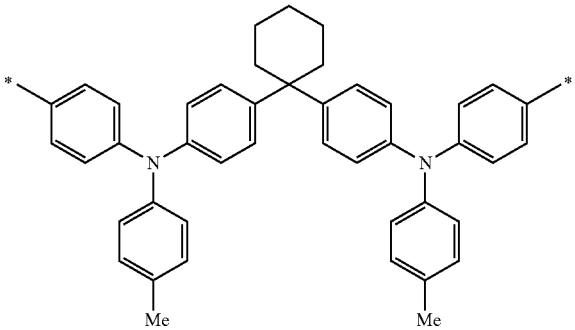
(M2)-17
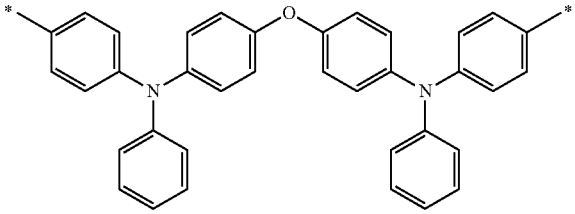
(M2)-18
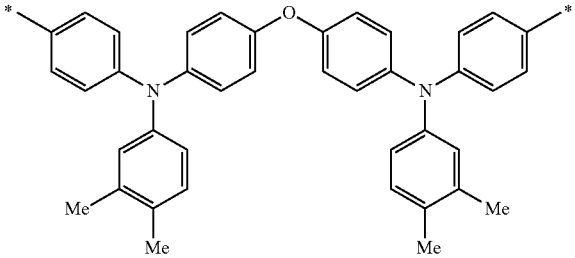
(M2)-19
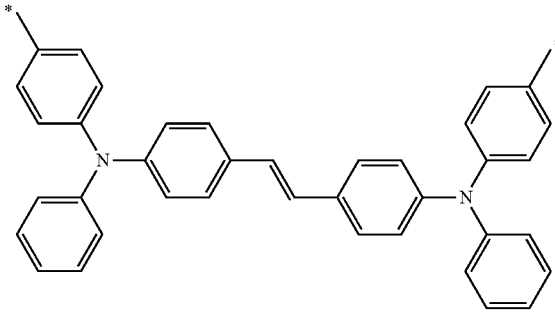

-continued
(M2)-20
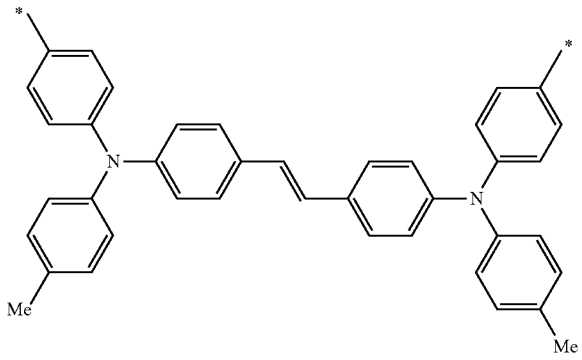
(M2)-21
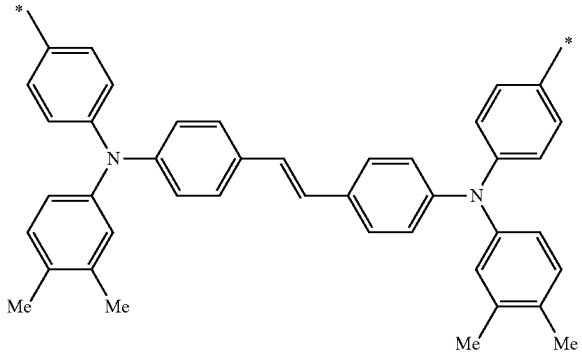
(M2)-22
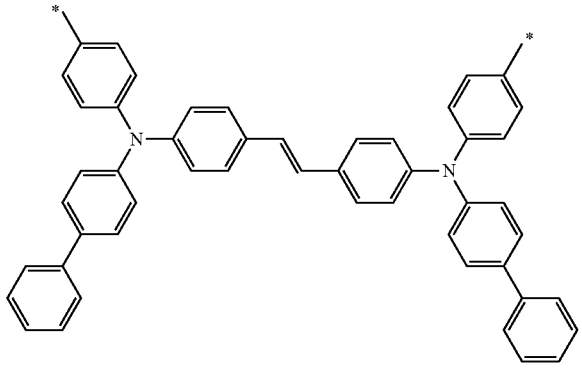
(M2)-23
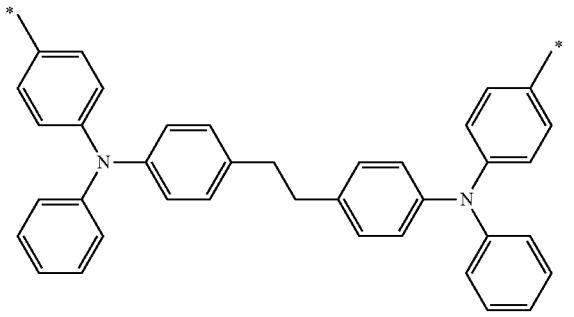
-continued
(M2)-24
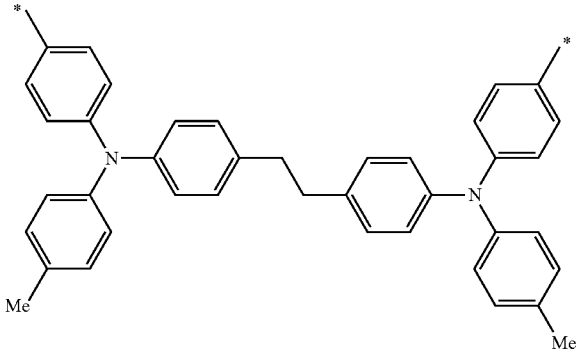
(M2)-25
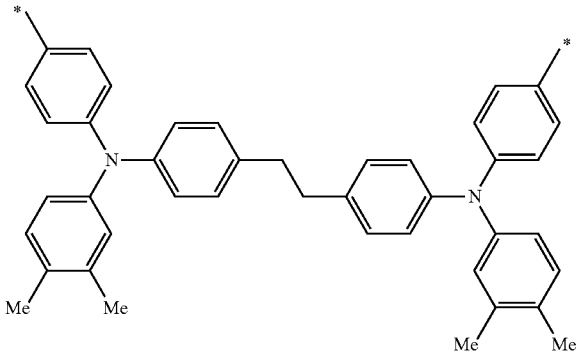
(M2)-26
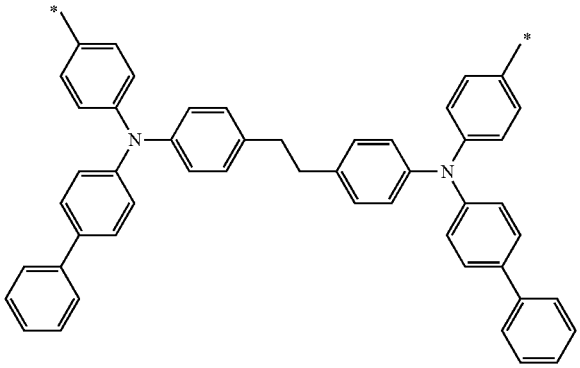
(M3)-1
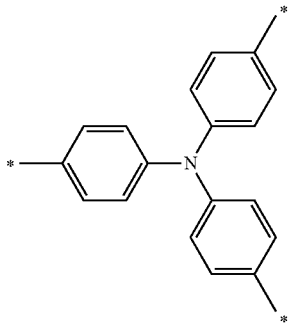

-continued
(M3)-2
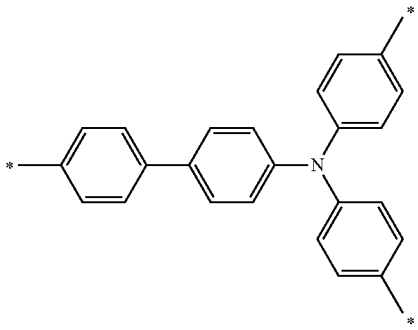
(M3)-3
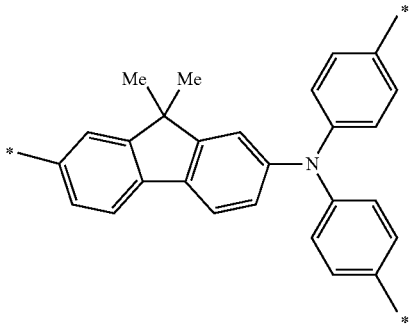
(M3)-4
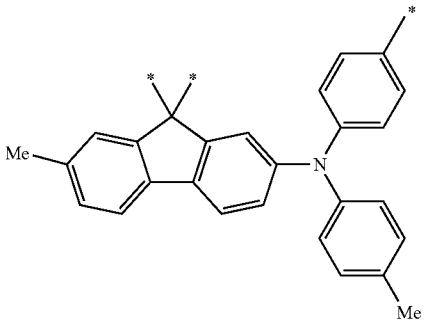
(M3)-5
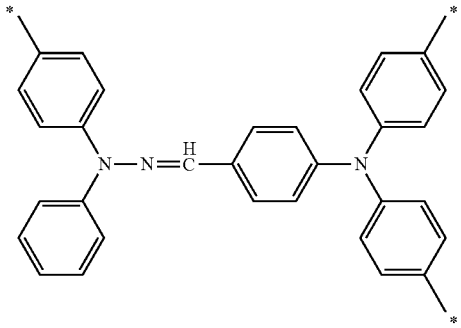
-continued
(M3)-6
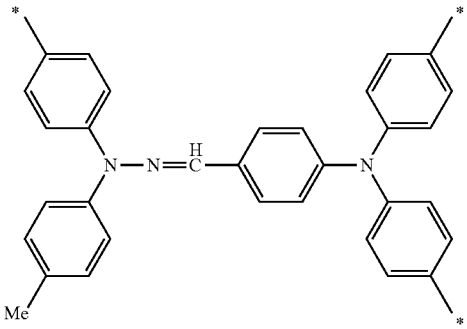
(M3)-7
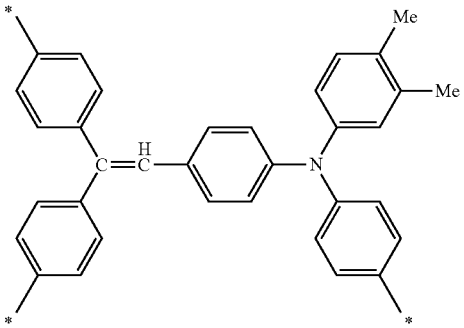
(M3)-8
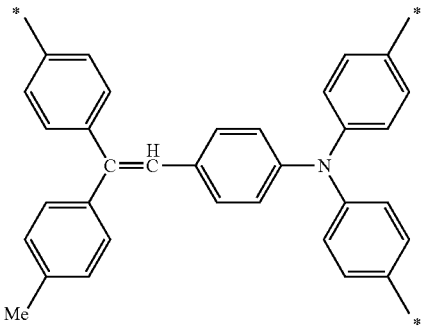
(M3)-9
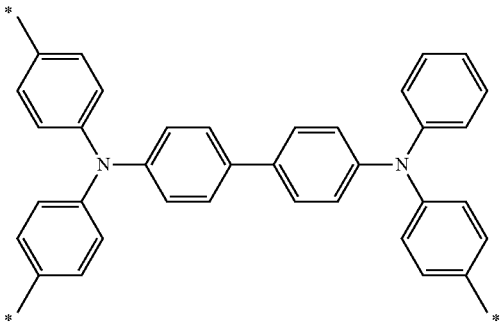

-continued
(M3)-10
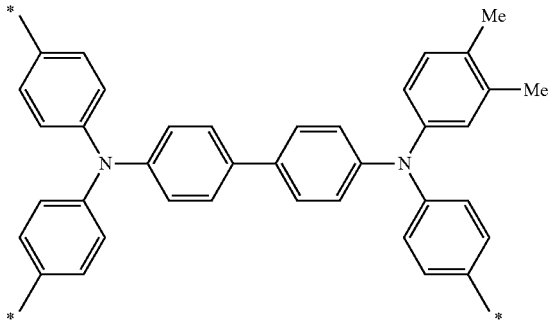
(M3)-11
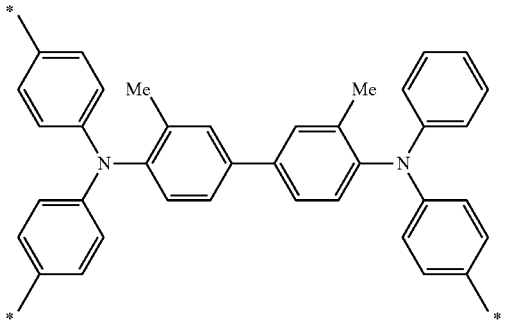
(M3)-12
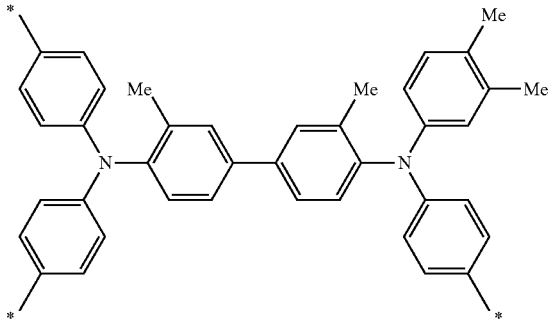
(M3)-13
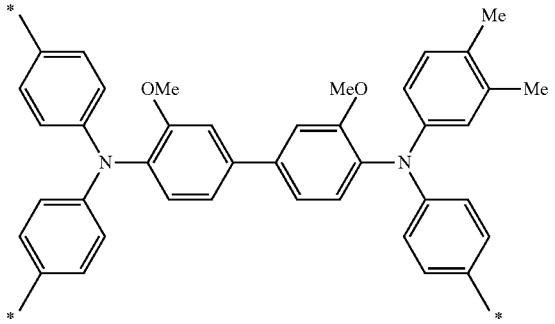
-continued
(M3)-14
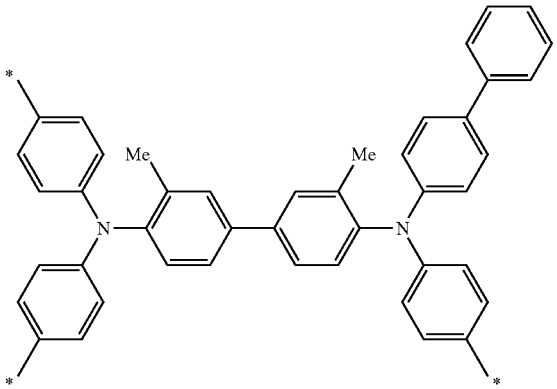
(M3)-15
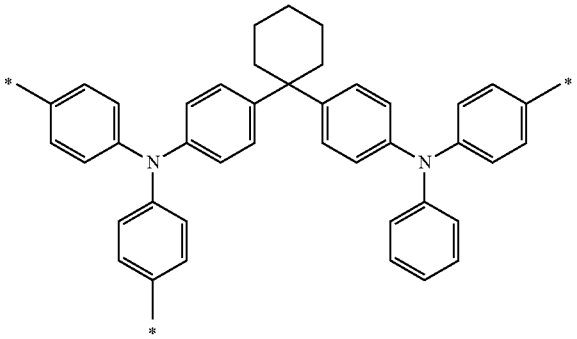
(M3)-16
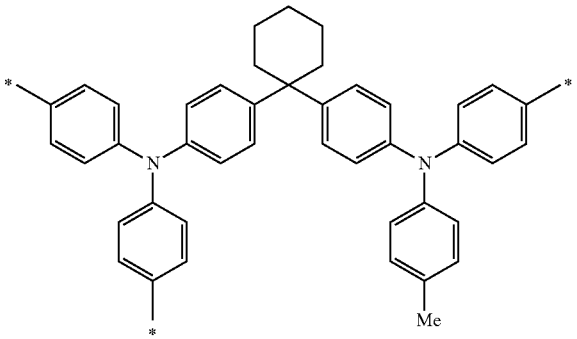
(M3)-17
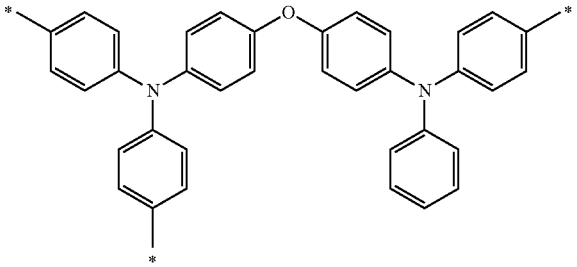

-continued
(M3)-18
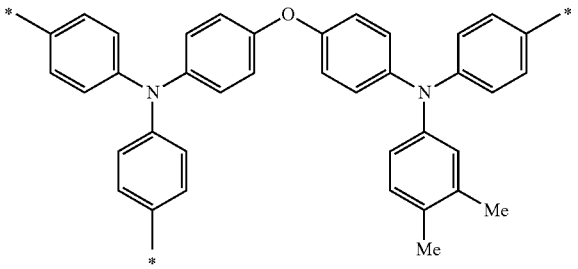
(M3)-19
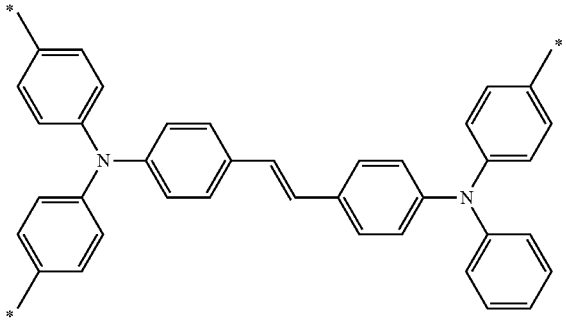
(M3)-20
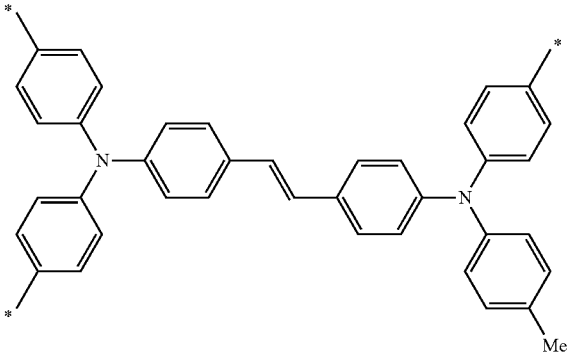
(M3)-21
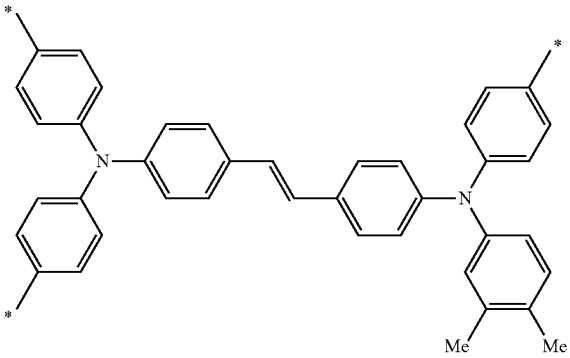
-continued
(M3)-22
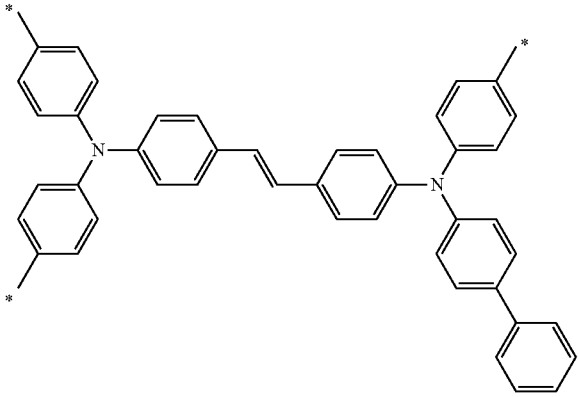
(M3)-23
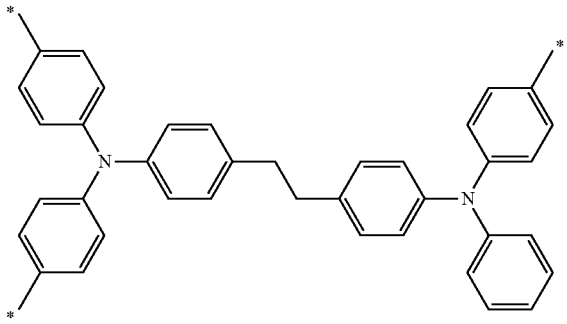
(M3)-24
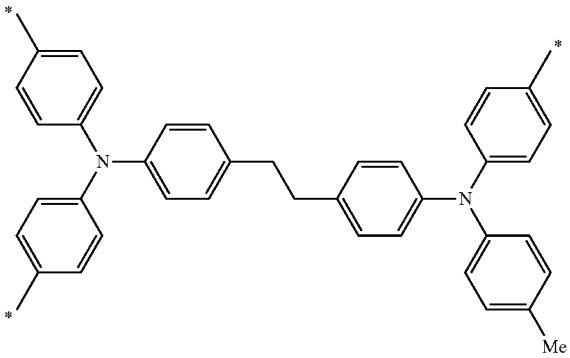
(M3)-25
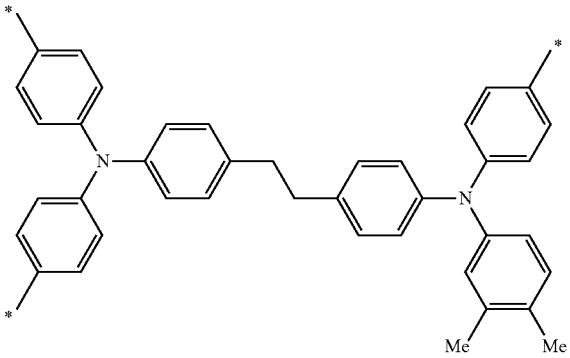

-continued
(M3)-26
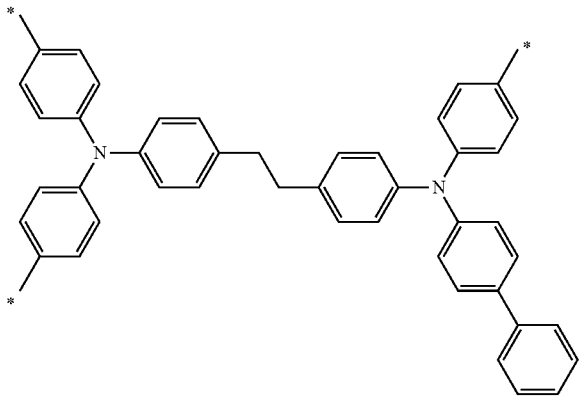
(M4)-1
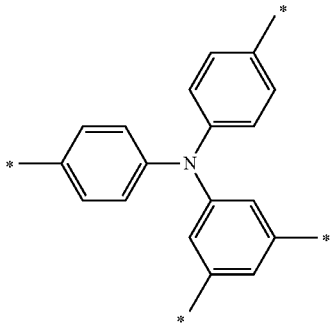
(M4)-2
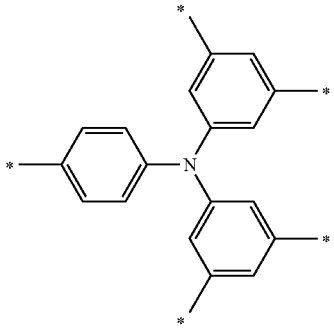
(M4)-3
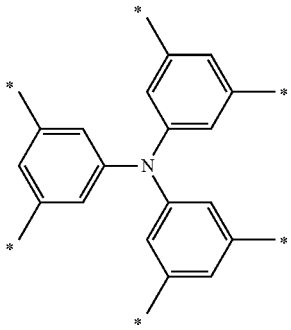
-continued
(M4)-4
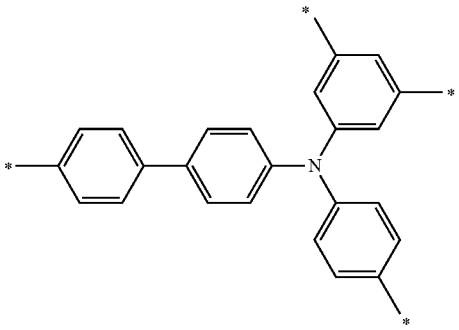
(M4)-5
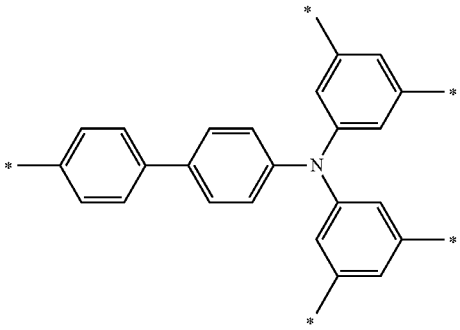
(M4)-6
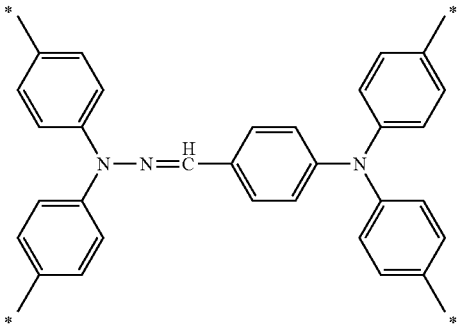
(M4)-7
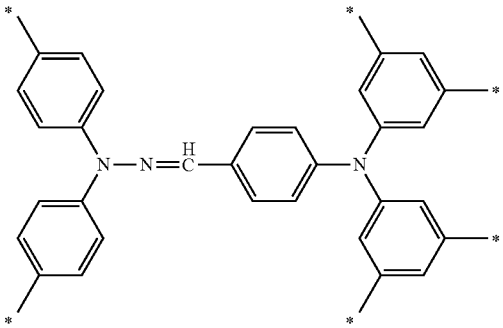

-continued
(M4)-8
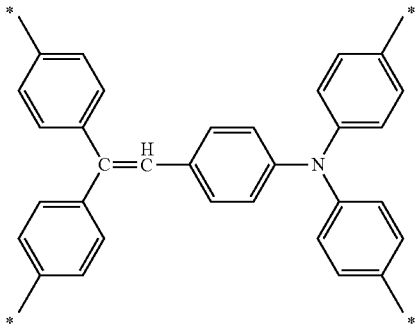
(M4)-9
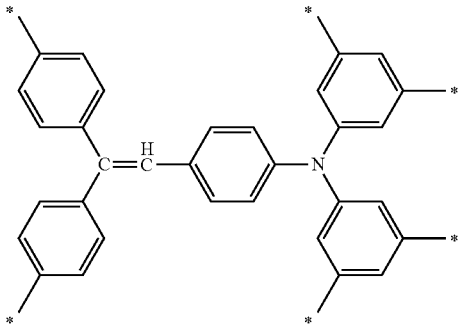
(M4)-10
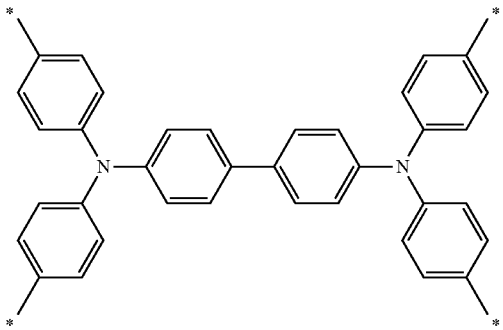
(M4)-11
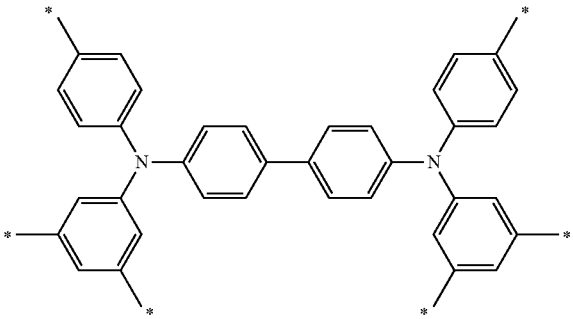
-continued
(M4)-12
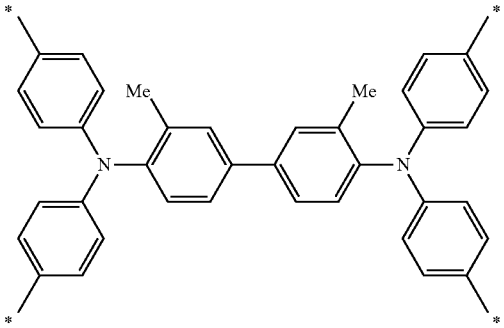
(M4)-13
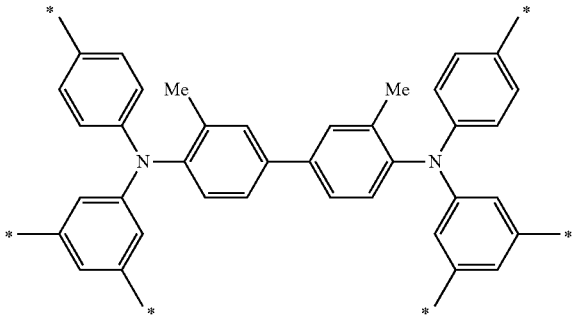
(M4)-14
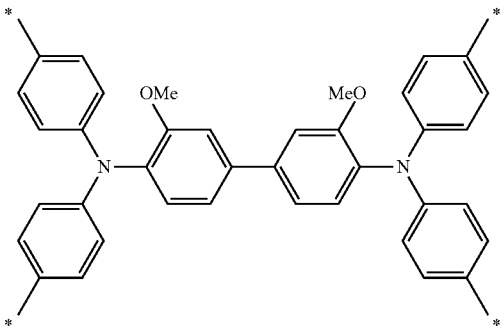
(M4)-15
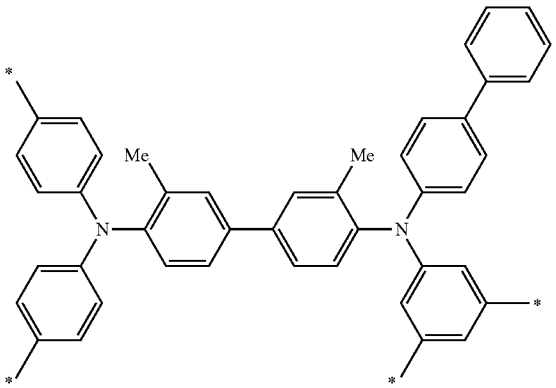

-continued
(M4)-16
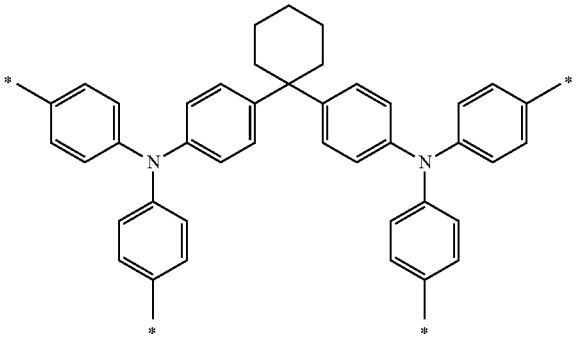
(M4)-17
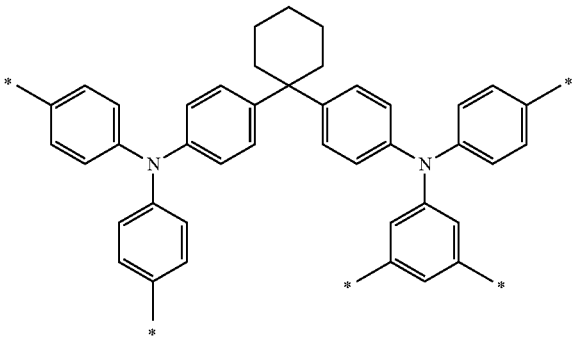
(M4)-18
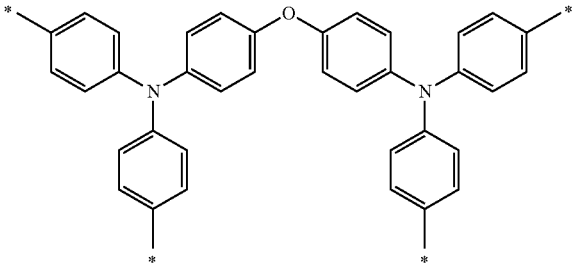
(M4)-19
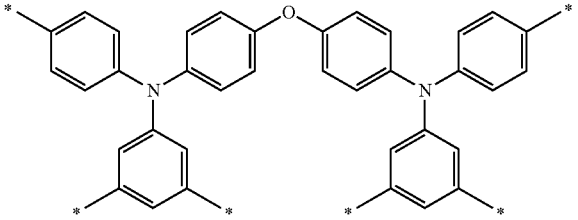
-continued
(M4)-20
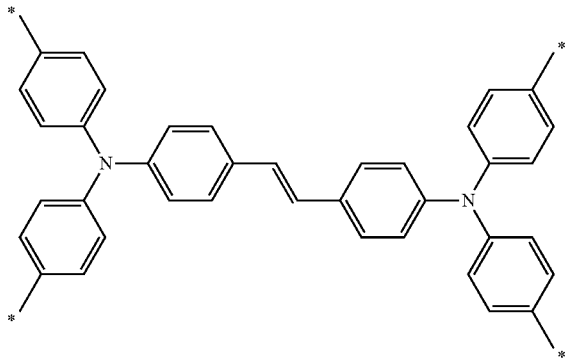
(M4)-21
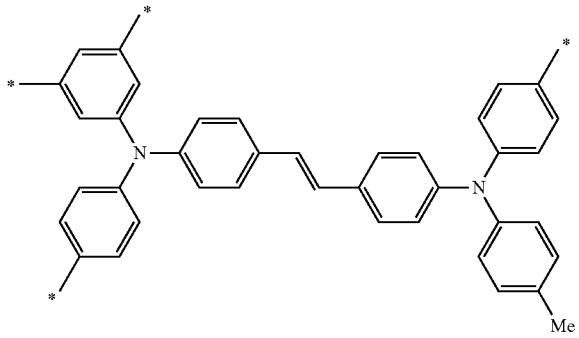
(M4)-22
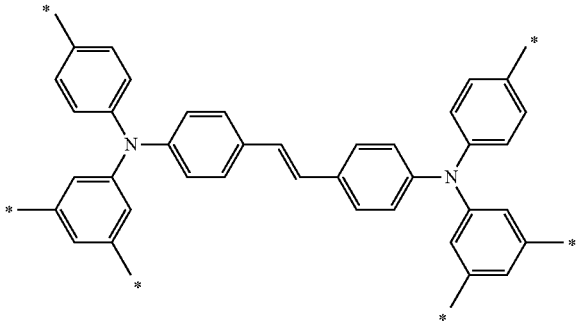
(M4)-23
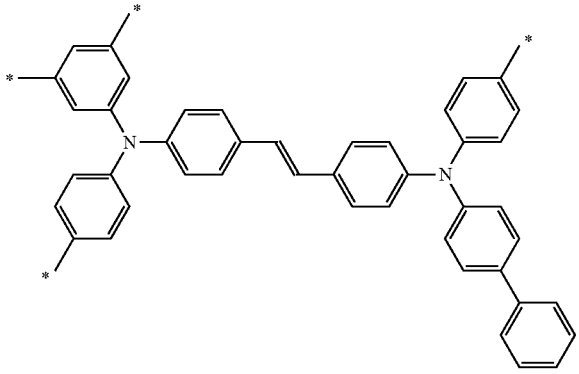

-continued
(M4)-24
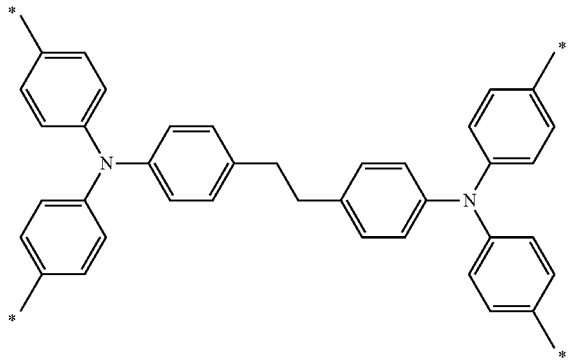
(M4)-25
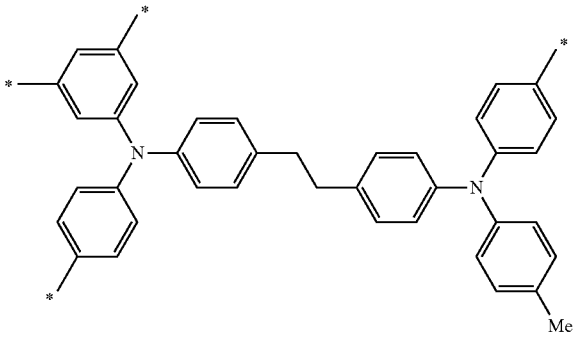
(M4)-26
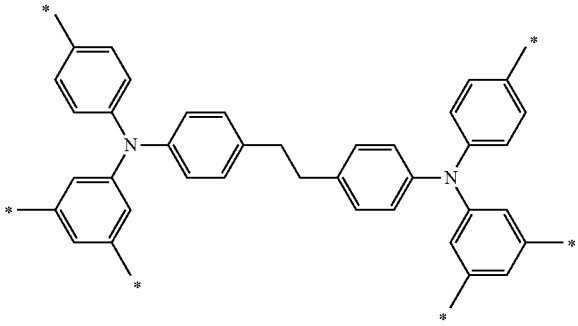
(M4)-27
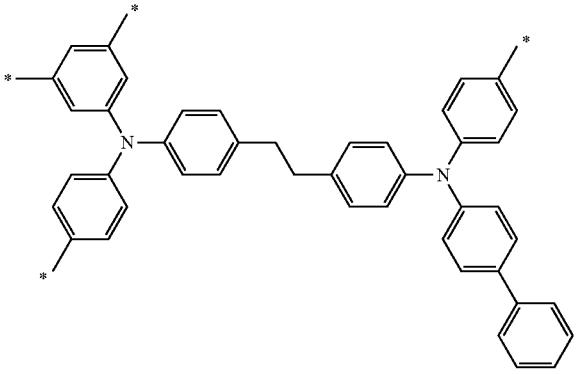
-continued
(M4)-28
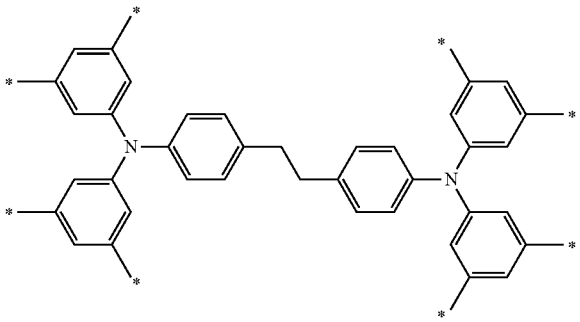
Next, specific examples of the functional group linked to the charge transporting skeleton F are shown.
(R1)-1
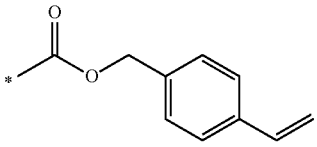
(R1)-2
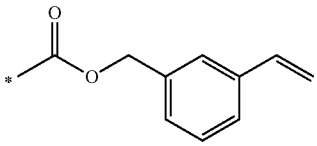
(R1)-3
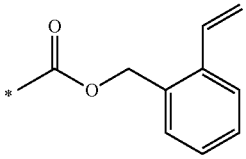
(R1)-4
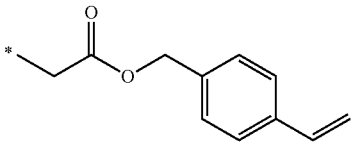
(R1)-5
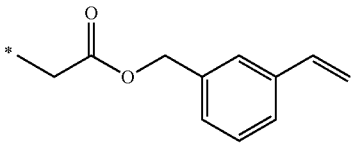
(R1)-6
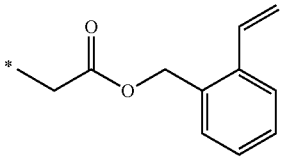
(R1)-7
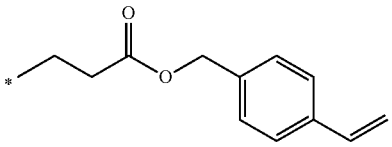

-continued
(R1)-8
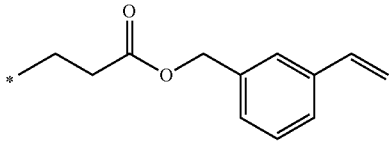
(R1)-9
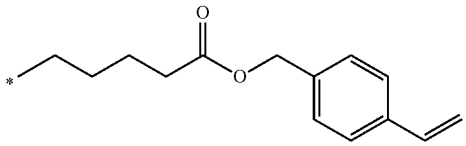
(R1)-10
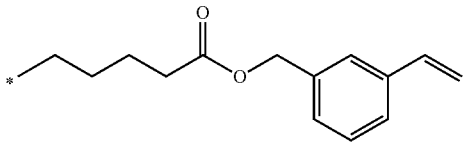
(R1)-11
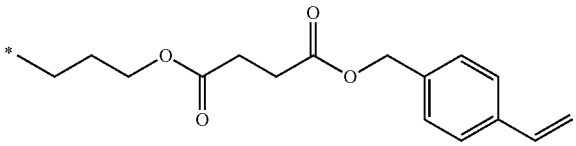
(R1)-12
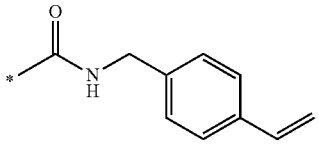
(R1)-13
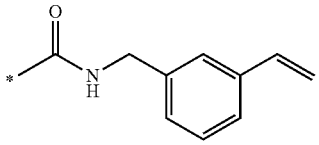
(R1)-14
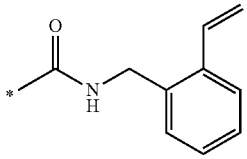
(R1)-15
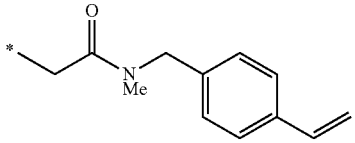
(R1)-16
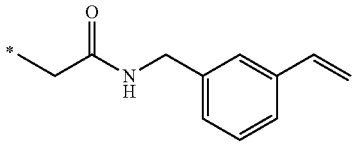
(R1)-17
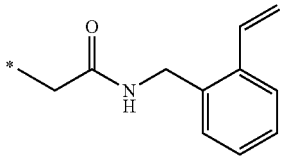
-continued
(R1)-18
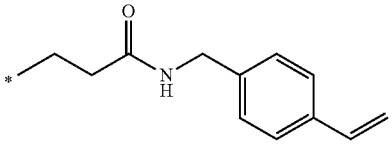
(R1)-19
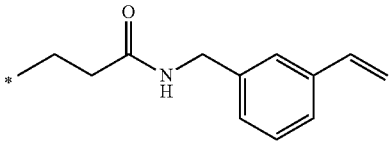
(R1)-20
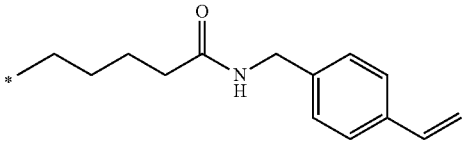
(R1)-21
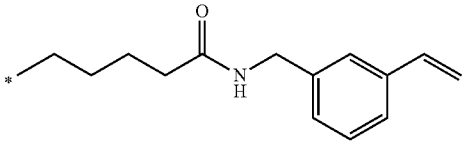
(R1)-22
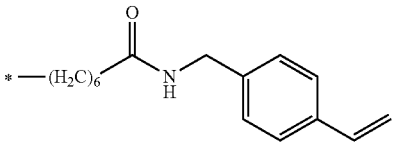
(R1)-23
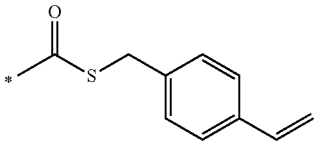
(R1)-24
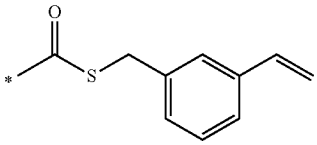
(R1)-25
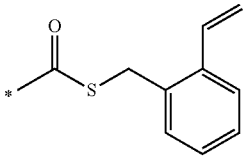
(R1)-26
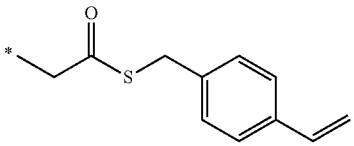
(R1)-27
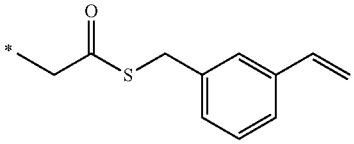

-continued
(R1)-28
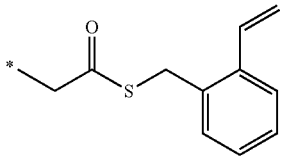
(R1)-29
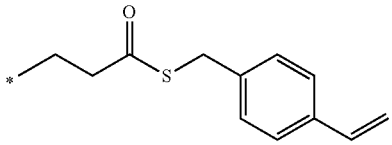
(R1)-30
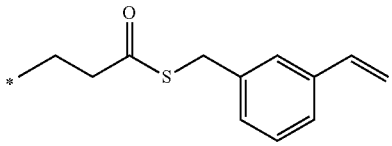
(R1)-31
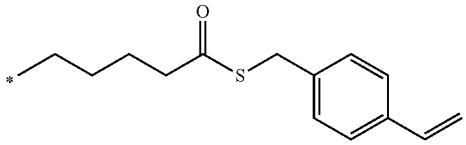
(R1)-32
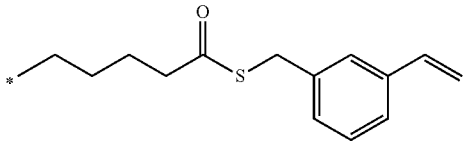
(R1)-33
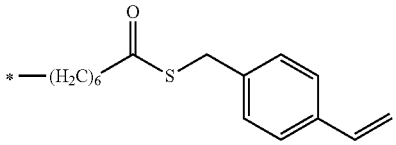
(R1)-34
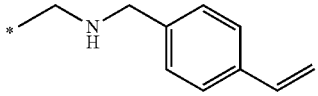
(R1)-35
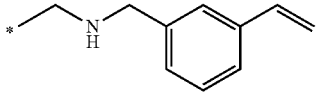
(R1)-36
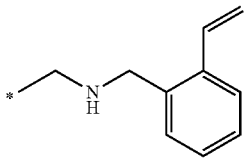
(R1)-37
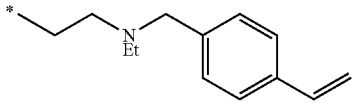
(R1)-38
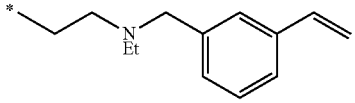
-continued
(R1)-39
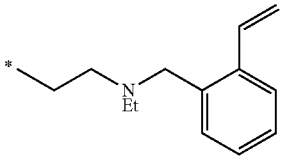
(R1)-40
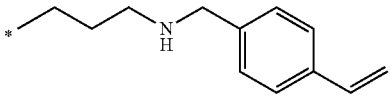
(R1)-41
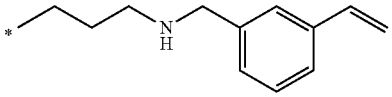
(R1)-42
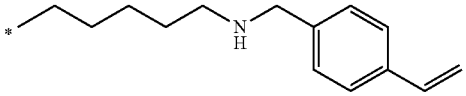
(R1)-43
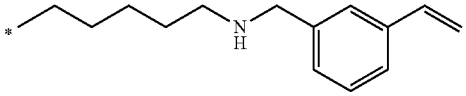
(R1)-44
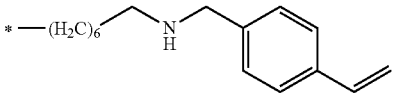
(R1)-45
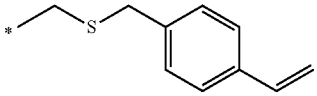
(R1)-46
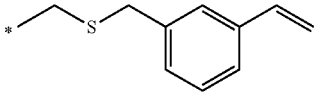
(R1)-47
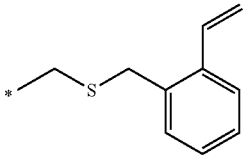
(R1)-48
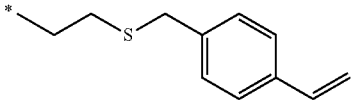
(R1)-49
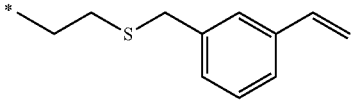
(R1)-50
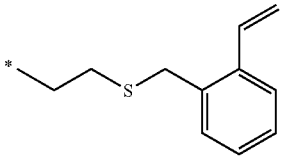

-continued
(R1)-51
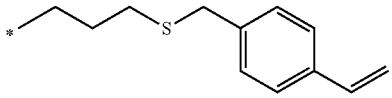
(R1)-52
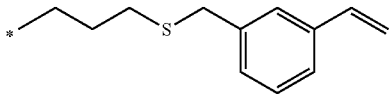
(R1)-53
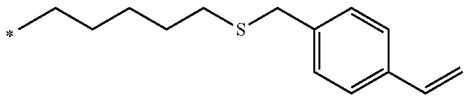
(R1)-54
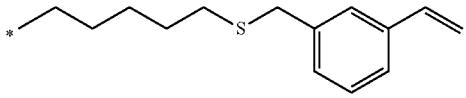
(R1)-55
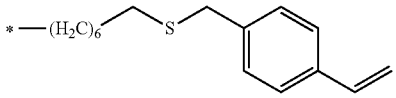
(R2)-1
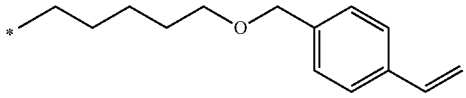
(R2)-2
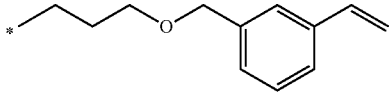
(R2)-3
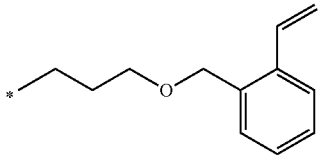
(R2)-4
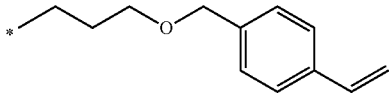
(R2)-5
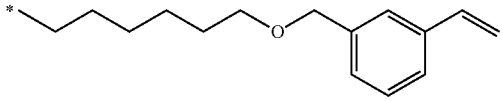
(R2)-6
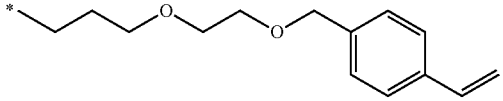
(R2)-7
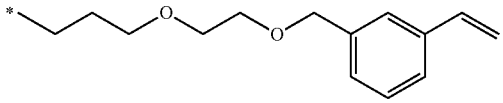
(R2)-8
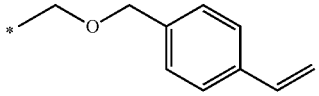
-continued
(R2)-9
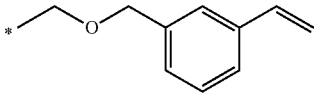
(R2)-10
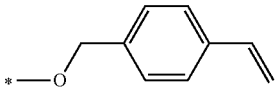
(R2)-11
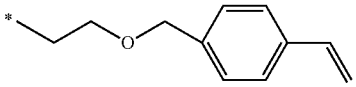
(R3)-1
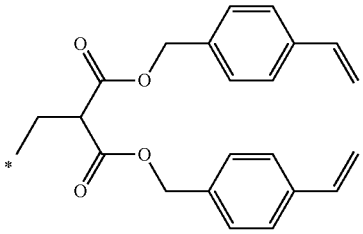
(R3)-2
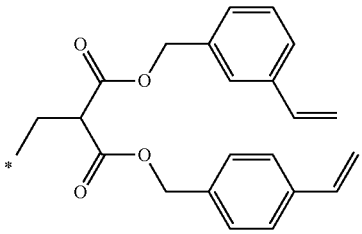
(R3)-3
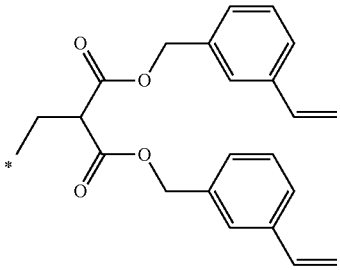
(R3)-4
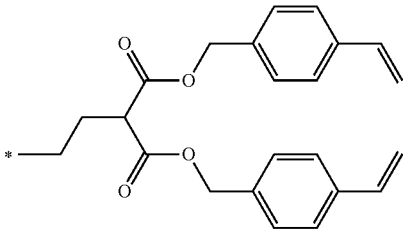
(R3)-5
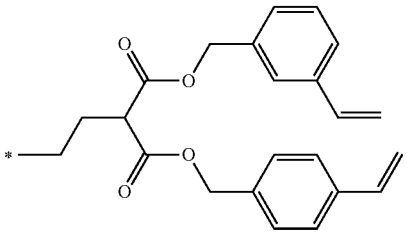

-continued
(R3)-6
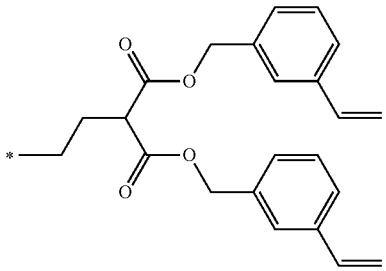
(R3)-7
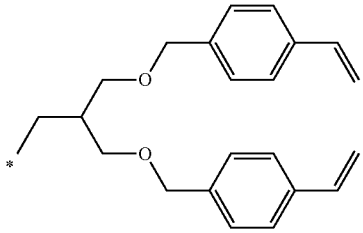
(R3)-8
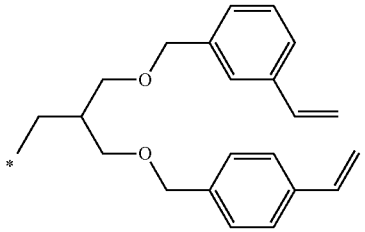
(R3)-9
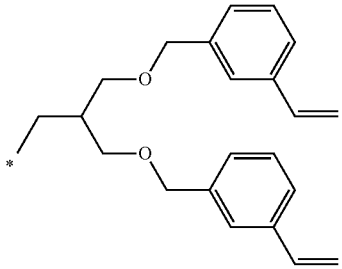
(R3)-10
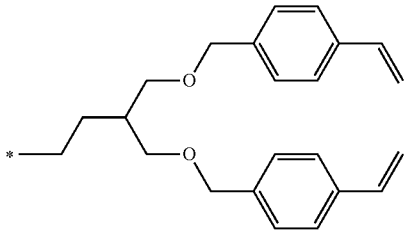
(R3)-11
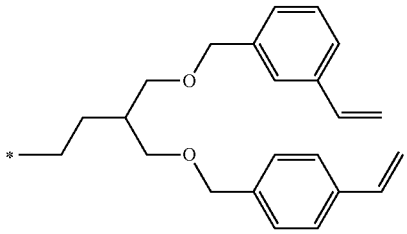
-continued
(R3)-12
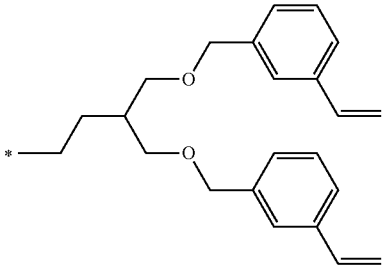
(R3)-13
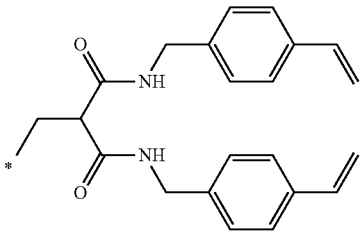
(R3)-14
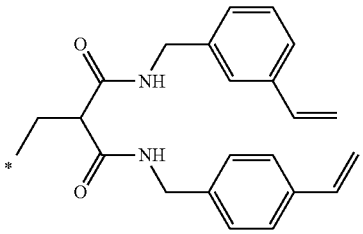
(R3)-15
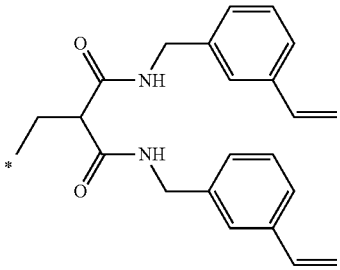
(R3)-16
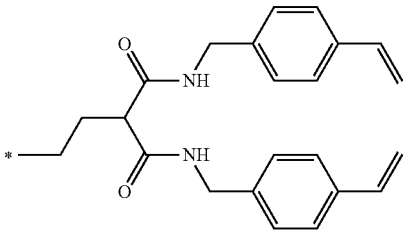
(R3)-17
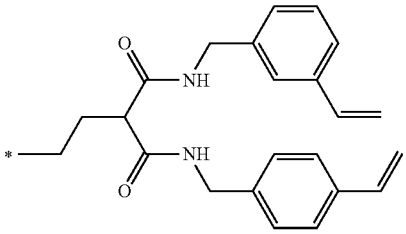

-continued
(R3)-18
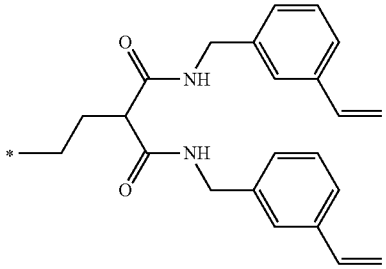
(R3)-19
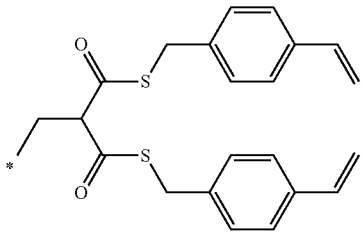
(R3)-20
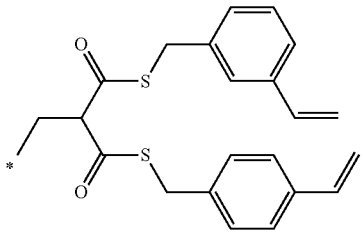
(R3)-21
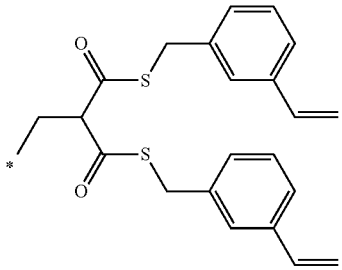
(R3)-22
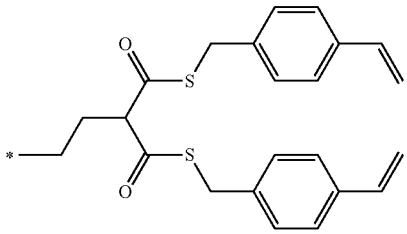
(R3)-23
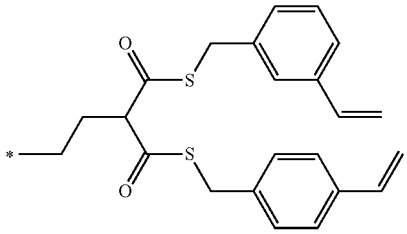
-continued
(R3)-24
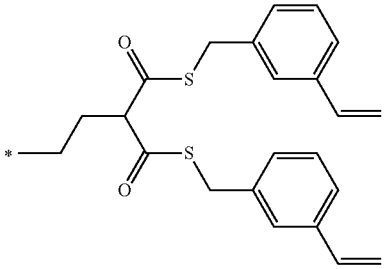
(R3)-25
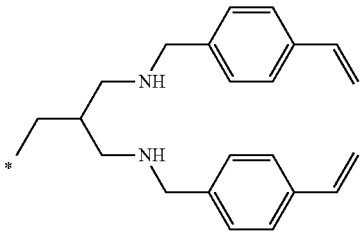
(R3)-26
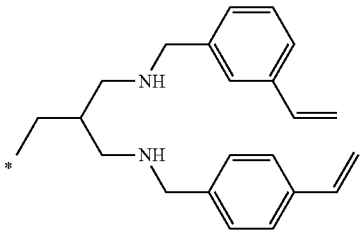
(R3)-27
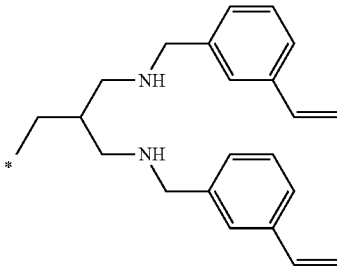
(R3)-28
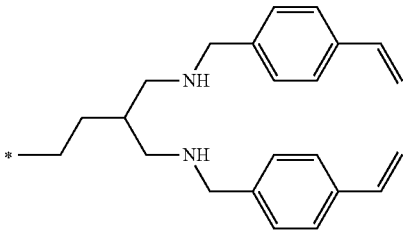
(R3)-29
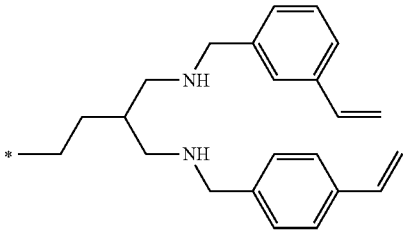

-continued
(R3)-30
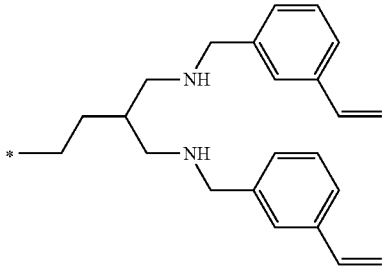
(R3)-31
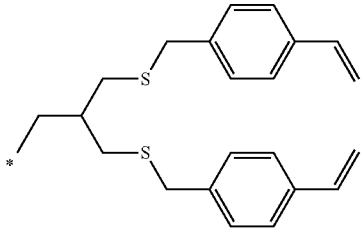
(R3)-32
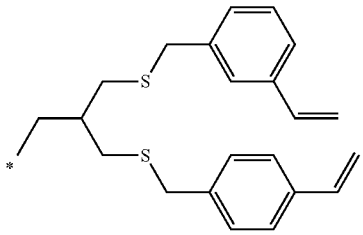
(R3)-33
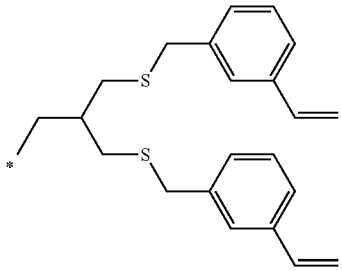
(R3)-34
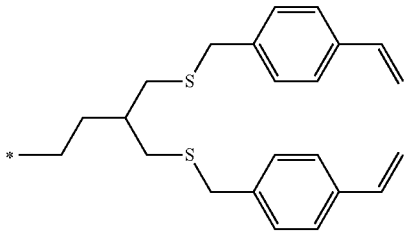
(R3)-35
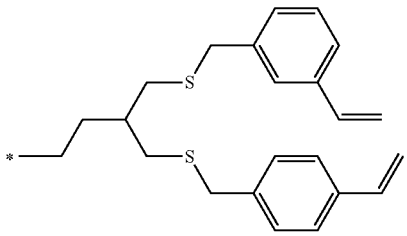
-continued
(R3)-36
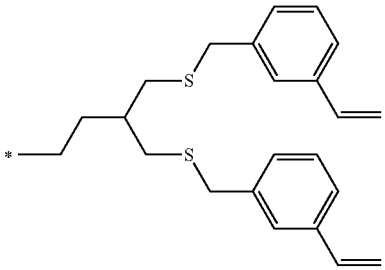
(R3)-37
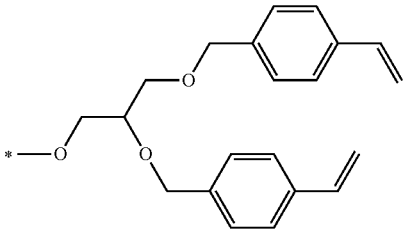
(R3)-38
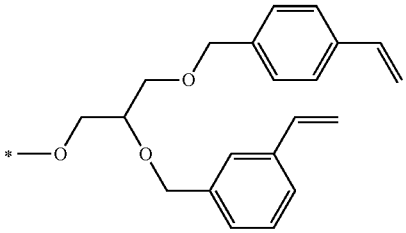
(R3)-39
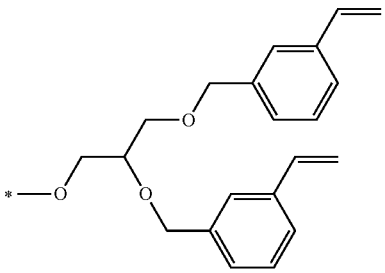
(R3)-40
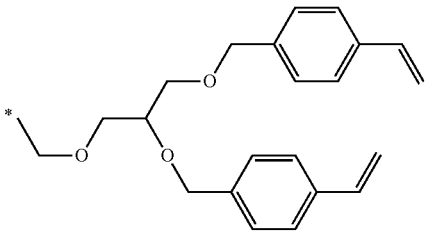
(R3)-41
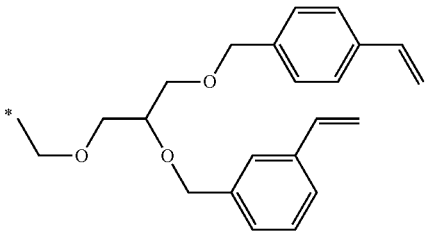

-continued
(R3)-42
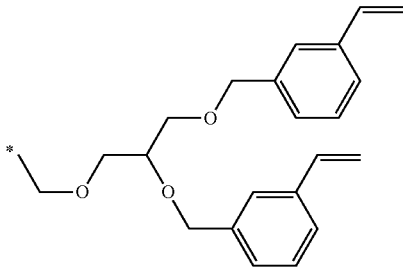
(R3)-43
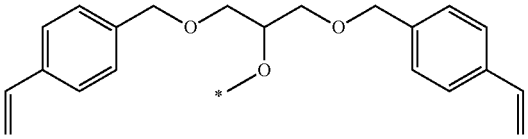
(R3)-44
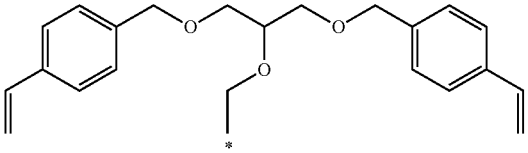
(R3)-45
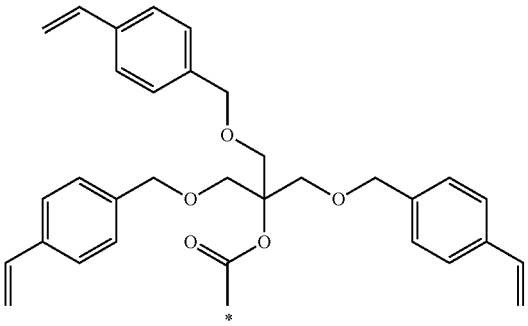
(R3)-46
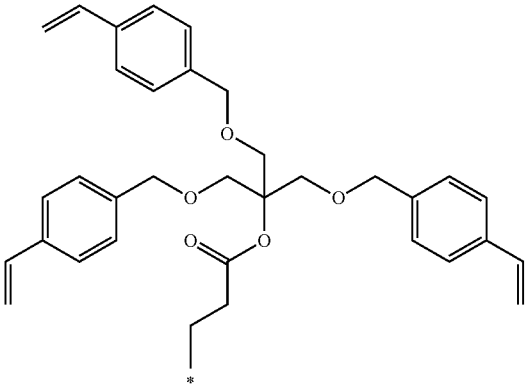
-continued
(R3)-47
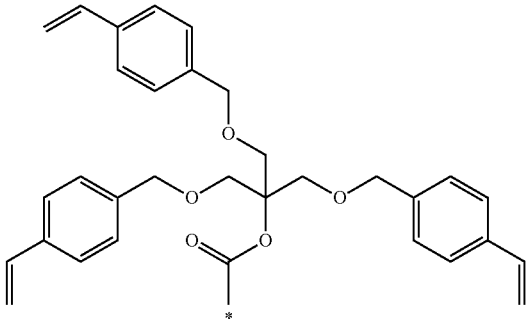
(R3)-48
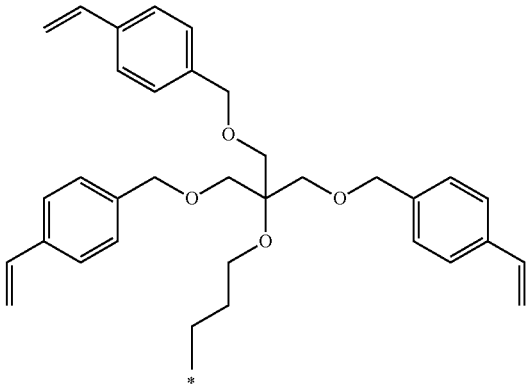
(R4)-1
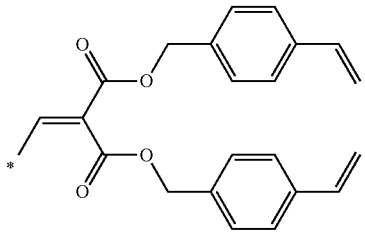
(R4)-2
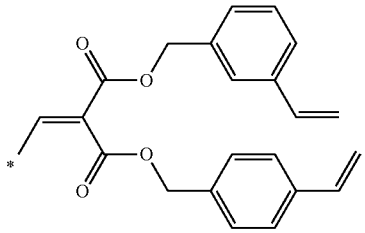
(R4)-3
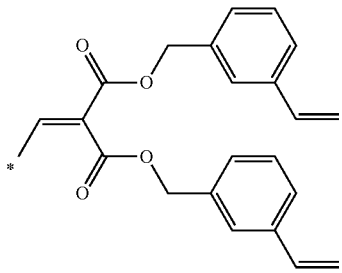

-continued (R4)-4

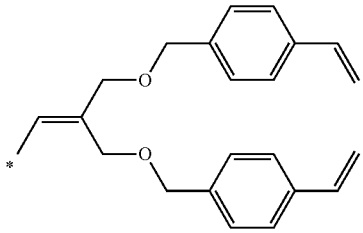

(R4)-5

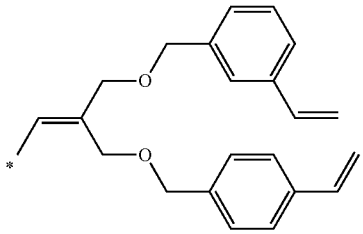

(R4)-6

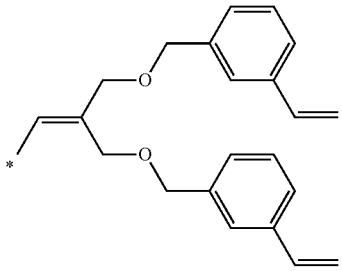

Next, specific examples of the compound represented by the general formula (I), specifically the general formula (I-a) are shown below.

Specific Examples of General Formula (I) [General Formula (I-a)]

| Exemplary compound | Charge transporting skeleton F | Functional group |
|---|---|---|
| (I-a)-1 | (M1)-15 | (R2)-8 |
| (I-a)-2 | (M1)-15 | (R2)-9 |
| (I-a)-3 | (M1)-15 | (R2)-10 |
| (I-a)-4 | (M1)-16 | (R2)-8 |
| (I-a)-5 | (M1)-17 | (R2)-8 |
| (I-a)-6 | (M1)-17 | (R2)-9 |
| (I-a)-7 | (M1)-17 | (R2)-10 |
| (I-a)-8 | (M1)-18 | (R2)-8 |
| (I-a)-9 | (M1)-18 | (R2)-9 |
| (I-a)-10 | (M1)-18 | (R2)-10 |
| (I-a)-11 | (M1)-19 | (R2)-8 |
| (I-a)-12 | (M1)-21 | (R2)-8 |
| (I-a)-13 | (M1)-22 | (R2)-8 |
| (I-a)-14 | (M2)-15 | (R2)-8 |
| (I-a)-15 | (M2)-15 | (R2)-9 |
| (I-a)-16 | (M2)-15 | (R2)-10 |
| (I-a)-17 | (M2)-16 | (R2)-8 |
| (I-a)-18 | (M2)-17 | (R2)-8 |
| (I-a)-19 | (M2)-23 | (R2)-8 |
| (I-a)-20 | (M2)-23 | (R2)-9 |
| (I-a)-21 | (M2)-23 | (R2)-10 |
| (I-a)-22 | (M2)-24 | (R2)-8 |
| (I-a)-23 | (M2)-24 | (R2)-9 |
| (I-a)-24 | (M2)-24 | (R2)-10 |
| (I-a)-25 | (M2)-25 | (R2)-8 |
| (I-a)-26 | (M2)-25 | (R2)-9 |
| (I-a)-27 | (M2)-25 | (R2)-10 |
| (I-a)-28 | (M2)-26 | (R2)-8 |
| (I-a)-29 | (M2)-26 | (R2)-9 |

-continued

| Exemplary compound | Charge transporting skeleton F | Functional group |
|---|---|---|
| (I-a)-30 | (M2)-26 | (R2)-10 |
| (I-a)-31 | (M2)-21 | (R2)-11 |

Next, specific examples of the compound represented by the general formula (I), specifically the general formula (I-b), are shown below.

Specific Examples of General Formula (I) [General Formula (I-b)]

| Exemplary compound | Charge transporting skeleton F | Functional group |
|---|---|---|
| (I-b)-1 | (M1)-1 | (R2)-1 |
| (I-b)-2 | (M1)-1 | (R2)-2 |
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by the general formula (I), specifically the general formula (I-c), are shown below.

Specific Examples of General Formula (I) [General Formula (I-c)]

| Exemplary compound | Charge transporting skeleton F | Functional group |
|---|---|---|
| (I-c)-1 | (M1)-1 | (R1)-1 |
| (I-c)-2 | (M1)-1 | (R1)-2 |
| (I-c)-3 | (M1)-1 | (R1)-4 |
| (I-c)-4 | (M1)-2 | (R1)-5 |
| (I-c)-5 | (M1)-2 | (R1)-7 |
| (I-c)-6 | (M1)-4 | (R1)-3 |
| (I-c)-7 | (M1)-4 | (R1)-7 |
| (I-c)-8 | (M1)-7 | (R1)-6 |
| (I-c)-9 | (M1)-11 | (R1)-4 |
| (I-c)-10 | (M1)-15 | (R1)-5 |
| (I-c)-11 | (M1)-25 | (R1)-1 |
| (I-c)-12 | (M1)-22 | (R1)-1 |
| (I-c)-13 | (M2)-2 | (R1)-1 |
| (I-c)-14 | (M2)-2 | (R1)-3 |
| (I-c)-15 | (M2)-2 | (R1)-7 |
| (I-c)-16 | (M2)-3 | (R1)-4 |

-continued

| Exemplary compound | Charge transporting skeleton F | Functional group |
|---|---|---|
| (I-c)-17 | (M2)-3 | (R1)-7 |
| (I-c)-18 | (M2)-5 | (R1)-6 |
| (I-c)-19 | (M2)-10 | (R1)-4 |
| (I-c)-20 | (M2)-10 | (R1)-5 |
| (I-c)-21 | (M2)-13 | (R1)-1 |
| (I-c)-22 | (M2)-13 | (R1)-3 |
| (I-c)-23 | (M2)-13 | (R1)-7 |
| (I-c)-24 | (M2)-16 | (R1)-5 |
| (I-c)-25 | (M2)-23 | (R1)-7 |
| (I-c)-26 | (M2)-23 | (R1)-4 |
| (I-c)-27 | (M2)-25 | (R1)-7 |
| (I-c)-28 | (M2)-25 | (R1)-4 |
| (I-c)-29 | (M2)-26 | (R1)-5 |
| (I-c)-30 | (M2)-26 | (R1)-7 |

Specific Examples of General Formula (I) [General Formula (I-c)]

| Exemplary compound | Charge transporting skeleton F | Functional group |
|---|---|---|
| (I-c)-31 | (M3)-1 | (R1)-2 |
| (I-c)-32 | (M3)-1 | (R1)-7 |
| (I-c)-33 | (M3)-5 | (R1)-2 |
| (I-c)-34 | (M3)-7 | (R1)-4 |
| (I-c)-35 | (M3)-7 | (R1)-2 |
| (I-c)-36 | (M3)-19 | (R1)-4 |
| (I-c)-37 | (M3)-26 | (R1)-1 |
| (I-c)-38 | (M3)-26 | (R1)-3 |
| (I-c)-39 | (M4)-3 | (R1)-3 |
| (I-c)-40 | (M4)-3 | (R1)-4 |
| (I-c)-41 | (M4)-8 | (R1)-5 |
| (I-c)-42 | (M4)-8 | (R1)-6 |
| (I-c)-43 | (M4)-12 | (R1)-7 |
| (I-c)-44 | (M4)-12 | (R1)-4 |
| (I-c)-45 | (M4)-12 | (R1)-2 |
| (I-c)-46 | (M4)-12 | (R1)-11 |
| (I-c)-47 | (M4)-16 | (R1)-3 |
| (I-c)-48 | (M4)-16 | (R1)-4 |
| (I-c)-49 | (M4)-20 | (R1)-1 |
| (I-c)-50 | (M4)-20 | (R1)-4 |
| (I-c)-51 | (M4)-20 | (R1)-7 |
| (I-c)-52 | (M4)-24 | (R1)-4 |
| (I-c)-53 | (M4)-24 | (R1)-7 |
| (I-c)-54 | (M4)-24 | (R1)-3 |
| (I-c)-55 | (M4)-24 | (R1)-4 |
| (I-c)-56 | (M4)-25 | (R1)-1 |
| (I-c)-57 | (M4)-26 | (R1)-3 |
| (I-c)-58 | (M4)-28 | (R1)-4 |
| (I-c)-59 | (M4)-28 | (R1)-5 |
| (I-c)-60 | (M4)-28 | (R1)-6 |

Specific Examples of General Formula (I) [General Formula (I-c)]

| Exemplary compound | Charge transporting skeleton F | Functional group |
|---|---|---|
| (I-c)-61 | (M1)-1 | (R1)-15 |
| (I-c)-62 | (M1)-1 | (R1)-27 |
| (I-c)-63 | (M1)-1 | (R1)-37 |
| (I-c)-64 | (M1)-2 | (R1)-52 |
| (I-c)-65 | (M1)-2 | (R1)-18 |
| (I-c)-66 | (M1)-4 | (R1)-31 |
| (I-c)-67 | (M1)-4 | (R1)-44 |
| (I-c)-68 | (M1)-7 | (R1)-45 |
| (I-c)-69 | (M1)-11 | (R1)-45 |
| (I-c)-70 | (M1)-15 | (R1)-45 |
| (I-c)-71 | (M1)-25 | (R1)-15 |
| (I-c)-72 | (M1)-22 | (R1)-15 |
| (I-c)-73 | (M2)-2 | (R1)-15 |

-continued

| Exemplary compound | Charge transporting skeleton F | Functional group |
|---|---|---|
| (I-c)-74 | (M2)-2 | (R1)-27 |
| (I-c)-75 | (M2)-2 | (R1)-37 |
| (I-c)-76 | (M2)-3 | (R1)-52 |
| (I-c)-77 | (M2)-3 | (R1)-18 |
| (I-c)-78 | (M2)-5 | (R1)-31 |
| (I-c)-79 | (M2)-10 | (R1)-44 |
| (I-c)-80 | (M2)-10 | (R1)-45 |
| (I-c)-81 | (M2)-13 | (R1)-45 |
| (I-c)-82 | (M2)-13 | (R1)-45 |
| (I-c)-83 | (M2)-13 | (R1)-15 |
| (I-c)-84 | (M2)-16 | (R1)-15 |
| (I-c)-85 | (M2)-23 | (R1)-27 |
| (I-c)-86 | (M2)-23 | (R1)-37 |
| (I-c)-87 | (M2)-25 | (R1)-52 |
| (I-c)-88 | (M2)-25 | (R1)-18 |
| (I-c)-89 | (M2)-26 | (R1)-31 |
| (I-c)-90 | (M2)-26 | (R1)-44 |

Specific Examples of General Formula (I) [General Formula (I-c)]

| Exemplary compound | Charge transporting skeleton F | Functional group |
|---|---|---|
| (I-c)-91 | (M3)-1 | (R1)-15 |
| (I-c)-92 | (M3)-1 | (R1)-27 |
| (I-c)-93 | (M3)-5 | (R1)-37 |
| (I-c)-94 | (M3)-7 | (R1)-52 |
| (I-c)-95 | (M3)-7 | (R1)-18 |
| (I-c)-96 | (M3)-19 | (R1)-31 |
| (I-c)-97 | (M3)-26 | (R1)-44 |
| (I-c)-98 | (M3)-26 | (R1)-45 |
| (I-c)-99 | (M4)-3 | (R1)-45 |
| (I-c)-100 | (M4)-3 | (R1)-45 |
| (I-c)-101 | (M4)-8 | (R1)-15 |
| (I-c)-102 | (M4)-8 | (R1)-15 |
| (I-c)-103 | (M4)-12 | (R1)-15 |
| (I-c)-104 | (M4)-12 | (R1)-27 |
| (I-c)-105 | (M4)-12 | (R1)-37 |
| (I-c)-106 | (M4)-12 | (R1)-52 |
| (I-c)-107 | (M4)-16 | (R1)-18 |
| (I-c)-108 | (M4)-16 | (R1)-31 |
| (I-c)-109 | (M4)-20 | (R1)-44 |
| (I-c)-110 | (M4)-20 | (R1)-45 |
| (I-c)-111 | (M4)-20 | (R1)-45 |
| (I-c)-112 | (M4)-24 | (R1)-45 |
| (I-c)-113 | (M4)-24 | (R1)-15 |
| (I-c)-114 | (M4)-24 | (R1)-15 |
| (I-c)-115 | (M4)-24 | (R1)-27 |
| (I-c)-116 | (M4)-25 | (R1)-37 |
| (I-c)-117 | (M4)-26 | (R1)-52 |
| (I-c)-118 | (M4)-28 | (R1)-18 |
| (I-c)-119 | (M4)-28 | (R1)-31 |
| (I-c)-120 | (M4)-28 | (R1)-44 |

Next, specific examples of the compound represented by the general formula (I), specifically the general formula (I-d), are shown below.

Specific Examples of General Formula (I) [General Formula (I-d)]

| Exemplary compound | Charge transporting skeleton F | functional group |
|---|---|---|
| (I-d)-1 | (M3)-1 | (R2)-2 |
| (I-d)-2 | (M3)-1 | (R2)-7 |
| (I-d)-3 | (M3)-2 | (R2)-2 |
| (I-d)-4 | (M3)-2 | (R2)-4 |
| (I-d)-5 | (M3)-3 | (R2)-2 |
| (I-d)-6 | (M3)-3 | (R2)-4 |

-continued

| Exemplary compound | Charge transporting skeleton F | functional group |
|---|---|---|
| (I-d)-7 | (M3)-12 | (R2)-1 |
| (I-d)-8 | (M3)-21 | (R2)-3 |
| (I-d)-9 | (M3)-25 | (R2)-3 |
| (I-d)-10 | (M3)-25 | (R2)-4 |
| (I-d)-11 | (M3)-25 | (R2)-5 |
| (I-d)-12 | (M3)-25 | (R2)-6 |
| (I-d)-13 | (M4)-1 | (R2)-7 |
| (I-d)-14 | (M4)-3 | (R2)-4 |
| (I-d)-15 | (M4)-3 | (R2)-2 |
| (I-d)-16 | (M4)-8 | (R2)-1 |
| (I-d)-17 | (M4)-8 | (R2)-3 |
| (I-d)-18 | (M4)-8 | (R2)-4 |
| (I-d)-19 | (M4)-10 | (R2)-1 |
| (I-d)-20 | (M4)-10 | (R2)-4 |
| (I-d)-21 | (M4)-10 | (R2)-7 |
| (I-d)-22 | (M4)-12 | (R2)-4 |
| (I-d)-23 | (M4)-12 | (R2)-1 |
| (I-d)-24 | (M4)-12 | (R2)-3 |
| (I-d)-25 | (M4)-22 | (R2)-4 |
| (I-d)-26 | (M4)-24 | (R2)-1 |
| (I-d)-27 | (M4)-24 | (R2)-3 |
| (I-d)-28 | (M4)-24 | (R2)-4 |
| (I-d)-29 | (M4)-24 | (R2)-5 |
| (I-d)-30 | (M4)-28 | (R2)-6 |

Specific Examples of General Formula (I) [General Formula (I-d)]

| Exemplary compound | Charge transporting skeleton F | functional group |
|---|---|---|
| (I-d)-31 | (M3)-1 | (R2)-8 |
| (I-d)-32 | (M3)-1 | (R2)-9 |
| (I-d)-33 | (M3)-2 | (R2)-8 |
| (I-d)-34 | (M3)-2 | (R2)-9 |
| (I-d)-35 | (M3)-3 | (R2)-8 |
| (I-d)-36 | (M3)-3 | (R2)-9 |
| (I-d)-37 | (M3)-12 | (R2)-8 |
| (I-d)-38 | (M3)-12 | (R2)-9 |
| (I-d)-39 | (M4)-12 | (R2)-8 |
| (I-d)-40 | (M4)-12 | (R2)-9 |
| (I-d)-41 | (M4)-12 | (R2)-10 |
| (I-d)-42 | (M4)-24 | (R2)-8 |
| (I-d)-43 | (M4)-24 | (R2)-9 |
| (I-d)-44 | (M4)-24 | (R2)-10 |
| (I-d)-45 | (M4)-28 | (R2)-8 |
| (I-d)-46 | (M4)-28 | (R2)-9 |
| (I-d)-47 | (M4)-28 | (R2)-10 |

Next, specific examples of the compound represented by the general formula (II), specifically the general formula (II-a), are shown below.

Specific Examples of General Formula (II) [General Formula (II-a)]

| Exemplary compound | Charge transporting skeleton F | Functional group |
|---|---|---|
| (II)-1 | (M1)-1 | (R3)-1 |
| (II)-2 | (M1)-1 | (R3)-2 |
| (II)-3 | (M1)-1 | (R3)-7 |
| (II)-4 | (M1)-2 | (R3)-1 |
| (II)-5 | (M1)-2 | (R3)-2 |
| (II)-6 | (M1)-2 | (R3)-3 |
| (II)-7 | (M1)-2 | (R3)-5 |
| (II)-8 | (M1)-2 | (R3)-7 |
| (II)-9 | (M1)-2 | (R3)-8 |
| (II)-10 | (M1)-2 | (R3)-10 |
| (II)-11 | (M1)-2 | (R3)-11 |
| (II)-12 | (M1)-4 | (R3)-1 |

-continued

| Exemplary compound | Charge transporting skeleton F | Functional group |
|---|---|---|
| (II)-13 | (M1)-4 | (R3)-2 |
| (II)-14 | (M1)-4 | (R3)-3 |
| (II)-15 | (M1)-4 | (R3)-5 |
| (II)-16 | (M1)-4 | (R3)-7 |
| (II)-17 | (M1)-4 | (R3)-8 |
| (II)-18 | (M1)-8 | (R3)-1 |
| (II)-19 | (M1)-8 | (R3)-2 |
| (II)-20 | (M1)-8 | (R3)-3 |
| (II)-21 | (M1)-8 | (R3)-5 |
| (II)-22 | (M1)-8 | (R3)-7 |
| (II)-23 | (M1)-8 | (R3)-8 |
| (II)-24 | (M1)-11 | (R3)-1 |
| (II)-25 | (M1)-11 | (R3)-3 |
| (II)-26 | (M1)-11 | (R3)-7 |
| (II)-27 | (M1)-11 | (R3)-9 |
| (II)-28 | (M1)-16 | (R3)-4 |
| (II)-29 | (M1)-22 | (R3)-6 |
| (II)-30 | (M1)-22 | (R3)-9 |

Specific Examples of General Formula (II) [General Formula (II-a)]

| Exemplary compound | Charge transporting skeleton F | Functional group |
|---|---|---|
| (II)-31 | (M2)-2 | (R3)-1 |
| (II)-32 | (M2)-2 | (R3)-3 |
| (II)-33 | (M2)-2 | (R3)-7 |
| (II)-34 | (M2)-2 | (R3)-9 |
| (II)-35 | (M2)-3 | (R3)-1 |
| (II)-36 | (M2)-3 | (R3)-2 |
| (II)-37 | (M2)-3 | (R3)-3 |
| (II)-38 | (M2)-3 | (R3)-7 |
| (II)-39 | (M2)-3 | (R3)-8 |
| (II)-40 | (M2)-5 | (R3)-8 |
| (II)-41 | (M2)-5 | (R3)-10 |
| (II)-42 | (M2)-10 | (R3)-1 |
| (II)-43 | (M2)-10 | (R3)-3 |
| (II)-44 | (M2)-10 | (R3)-7 |
| (II)-45 | (M2)-10 | (R3)-9 |
| (II)-46 | (M2)-13 | (R3)-1 |
| (II)-47 | (M2)-13 | (R3)-2 |
| (II)-48 | (M2)-13 | (R3)-3 |
| (II)-49 | (M2)-13 | (R3)-5 |
| (II)-50 | (M2)-13 | (R3)-7 |
| (II)-51 | (M2)-13 | (R3)-8 |
| (II)-52 | (M2)-16 | (R3)-1 |
| (II)-53 | (M2)-16 | (R3)-7 |
| (II)-54 | (M2)-21 | (R3)-1 |
| (II)-55 | (M2)-21 | (R3)-7 |
| (II)-56 | (M2)-25 | (R3)-1 |
| (II)-57 | (M2)-25 | (R3)-3 |
| (II)-58 | (M2)-25 | (R3)-7 |
| (II)-59 | (M2)-25 | (R3)-8 |
| (II)-60 | (M2)-25 | (R3)-9 |

Specific Examples of General Formula (II) [General Formula (II-a)]

| Exemplary compound | Charge transporting skeleton F | Functional group |
|---|---|---|
| (II)-61 | (M3)-1 | (R3)-1 |
| (II)-62 | (M3)-1 | (R3)-2 |
| (II)-63 | (M3)-1 | (R3)-7 |
| (II)-64 | (M3)-1 | (R3)-8 |
| (II)-65 | (M3)-3 | (R3)-1 |
| (II)-66 | (M3)-3 | (R3)-7 |
| (II)-67 | (M3)-7 | (R3)-1 |
| (II)-68 | (M3)-7 | (R3)-2 |
| (II)-69 | (M3)-7 | (R3)-7 |

-continued

| Exemplary compound | Charge transporting skeleton F | Functional group |
|---|---|---|
| (II)-70 | (M3)-7 | (R3)-8 |
| (II)-71 | (M3)-18 | (R3)-5 |
| (II)-72 | (M3)-18 | (R3)-12 |
| (II)-73 | (M3)-25 | (R3)-7 |
| (II)-74 | (M3)-25 | (R3)-8 |
| (II)-75 | (M3)-25 | (R3)-5 |
| (II)-76 | (M3)-25 | (R3)-12 |
| (II)-77 | (M4)-2 | (R3)-1 |
| (II)-78 | (M4)-2 | (R3)-7 |
| (II)-79 | (M4)-4 | (R3)-7 |
| (II)-80 | (M4)-4 | (R3)-8 |
| (II)-81 | (M4)-4 | (R3)-5 |
| (II)-82 | (M4)-4 | (R3)-12 |
| (II)-83 | (M4)-7 | (R3)-1 |
| (II)-84 | (M4)-7 | (R3)-2 |
| (II)-85 | (M4)-7 | (R3)-7 |
| (II)-86 | (M4)-7 | (R3)-8 |
| (II)-87 | (M4)-9 | (R3)-7 |
| (II)-88 | (M4)-9 | (R3)-8 |
| (II)-89 | (M4)-9 | (R3)-5 |
| (II)-90 | (M4)-9 | (R3)-12 |

Specific Examples of General Formula (II) [General Formula (II-a)]

| Exemplary compound | Charge transporting skeleton F | Functional group |
|---|---|---|
| (II)-91 | (M1)-1 | (R3)-13 |
| (II)-92 | (M1)-1 | (R3)-15 |
| (II)-93 | (M1)-1 | (R3)-47 |
| (II)-94 | (M1)-2 | (R3)-13 |
| (II)-95 | (M1)-2 | (R3)-15 |
| (II)-96 | (M1)-2 | (R3)-19 |
| (II)-97 | (M1)-2 | (R3)-21 |
| (II)-98 | (M1)-2 | (R3)-28 |
| (II)-99 | (M1)-2 | (R3)-31 |
| (II)-100 | (M1)-2 | (R3)-33 |
| (II)-101 | (M1)-2 | (R3)-37 |
| (II)-102 | (M1)-2 | (R3)-38 |
| (II)-103 | (M1)-2 | (R3)-43 |
| (II)-104 | (M1)-4 | (R3)-13 |
| (II)-105 | (M1)-4 | (R3)-15 |
| (II)-106 | (M1)-4 | (R3)-43 |
| (II)-107 | (M1)-4 | (R3)-48 |
| (II)-108 | (M1)-8 | (R3)-13 |
| (II)-109 | (M1)-8 | (R3)-15 |
| (II)-110 | (M1)-8 | (R3)-19 |
| (II)-111 | (M1)-8 | (R3)-28 |
| (II)-112 | (M1)-8 | (R3)-31 |
| (II)-113 | (M1)-8 | (R3)-33 |
| (II)-114 | (M1)-11 | (R3)-33 |
| (II)-115 | (M1)-11 | (R3)-33 |
| (II)-116 | (M1)-11 | (R3)-33 |
| (II)-117 | (M1)-11 | (R3)-33 |
| (II)-118 | (M1)-16 | (R3)-13 |
| (II)-119 | (M1)-22 | (R3)-15 |
| (II)-120 | (M1)-22 | (R3)-47 |

Specific Examples of General Formula (II) [General Formula (II-a)]

| Exemplary compound | Charge transporting skeleton F | Functional group |
|---|---|---|
| (II)-121 | (M2)-2 | (R3)-13 |
| (II)-122 | (M2)-2 | (R3)-15 |
| (II)-123 | (M2)-2 | (R3)-14 |
| (II)-124 | (M2)-2 | (R3)-17 |
| (II)-125 | (M2)-3 | (R3)-15 |
| (II)-126 | (M2)-3 | (R3)-19 |

-continued

| Exemplary compound | Charge transporting skeleton F | Functional group |
|---|---|---|
| (II)-127 | (M2)-3 | (R3)-21 |
| (II)-128 | (M2)-3 | (R3)-28 |
| (II)-129 | (M2)-3 | (R3)-31 |
| (II)-130 | (M2)-5 | (R3)-33 |
| (II)-131 | (M2)-5 | (R3)-37 |
| (II)-132 | (M2)-10 | (R3)-38 |
| (II)-133 | (M2)-10 | (R3)-43 |
| (II)-134 | (M2)-10 | (R3)-13 |
| (II)-135 | (M2)-10 | (R3)-15 |
| (II)-136 | (M2)-13 | (R3)-16 |
| (II)-137 | (M2)-13 | (R3)-48 |
| (II)-138 | (M2)-13 | (R3)-13 |
| (II)-139 | (M2)-13 | (R3)-26 |
| (II)-140 | (M2)-13 | (R3)-19 |
| (II)-141 | (M2)-13 | (R3)-28 |
| (II)-142 | (M2)-16 | (R3)-31 |
| (II)-143 | (M2)-16 | (R3)-33 |
| (II)-144 | (M2)-21 | (R3)-33 |
| (II)-145 | (M2)-21 | (R3)-34 |
| (II)-146 | (M2)-25 | (R3)-35 |
| (II)-147 | (M2)-25 | (R3)-36 |
| (II)-148 | (M2)-25 | (R3)-37 |
| (II)-149 | (M2)-25 | (R3)-15 |
| (II)-150 | (M2)-25 | (R3)-47 |
| (II)-151 | (M3)-1 | (R3)-13 |
| (II)-152 | (M3)-1 | (R3)-15 |
| (II)-153 | (M3)-1 | (R3)-14 |
| (II)-154 | (M3)-1 | (R3)-17 |
| (II)-155 | (M3)-3 | (R3)-15 |
| (II)-156 | (M3)-3 | (R3)-19 |
| (II)-157 | (M3)-7 | (R3)-21 |
| (II)-158 | (M3)-7 | (R3)-28 |
| (II)-159 | (M3)-7 | (R3)-31 |
| (II)-160 | (M3)-7 | (R3)-33 |

Specific Examples of General Formula (II) [General Formula (II-a)]

| Exemplary compound | Charge transporting skeleton F | Functional group |
|---|---|---|
| (II)-161 | (M3)-18 | (R3)-37 |
| (II)-162 | (M3)-18 | (R3)-38 |
| (II)-163 | (M3)-25 | (R3)-43 |
| (II)-164 | (M3)-25 | (R3)-13 |
| (II)-165 | (M3)-25 | (R3)-15 |
| (II)-166 | (M3)-25 | (R3)-16 |
| (II)-167 | (M4)-2 | (R3)-48 |
| (II)-168 | (M4)-2 | (R3)-13 |
| (II)-169 | (M4)-4 | (R3)-26 |
| (II)-170 | (M4)-4 | (R3)-19 |
| (II)-171 | (M4)-4 | (R3)-28 |
| (II)-172 | (M4)-4 | (R3)-31 |
| (II)-173 | (M4)-7 | (R3)-32 |
| (II)-174 | (M4)-7 | (R3)-33 |
| (II)-175 | (M4)-7 | (R3)-34 |
| (II)-176 | (M4)-7 | (R3)-35 |
| (II)-177 | (M4)-9 | (R3)-36 |
| (II)-178 | (M4)-9 | (R3)-37 |
| (II)-179 | (M4)-9 | (R3)-15 |
| (II)-180 | (M4)-9 | (R3)-47 |
| (II)-181 | (M2)-25 | (R4)-1 |
| (II)-182 | (M2)-25 | (R4)-4 |

The specific reactive group-containing charge transporting material (in particular, the reactive compound represented by the general formula (I)) is synthesized in the following manner, for example.

That is, the specific reactive group-containing charge transporting material is synthesized by, for example, etherification of a carboxylic acid as a precursor, or an alcohol with chloromethylstyrene or the like corresponding thereto.

An example of the synthesis route for the exemplary compound (I-d)-22 of the specific reactive group-containing charge transporting material is shown below.
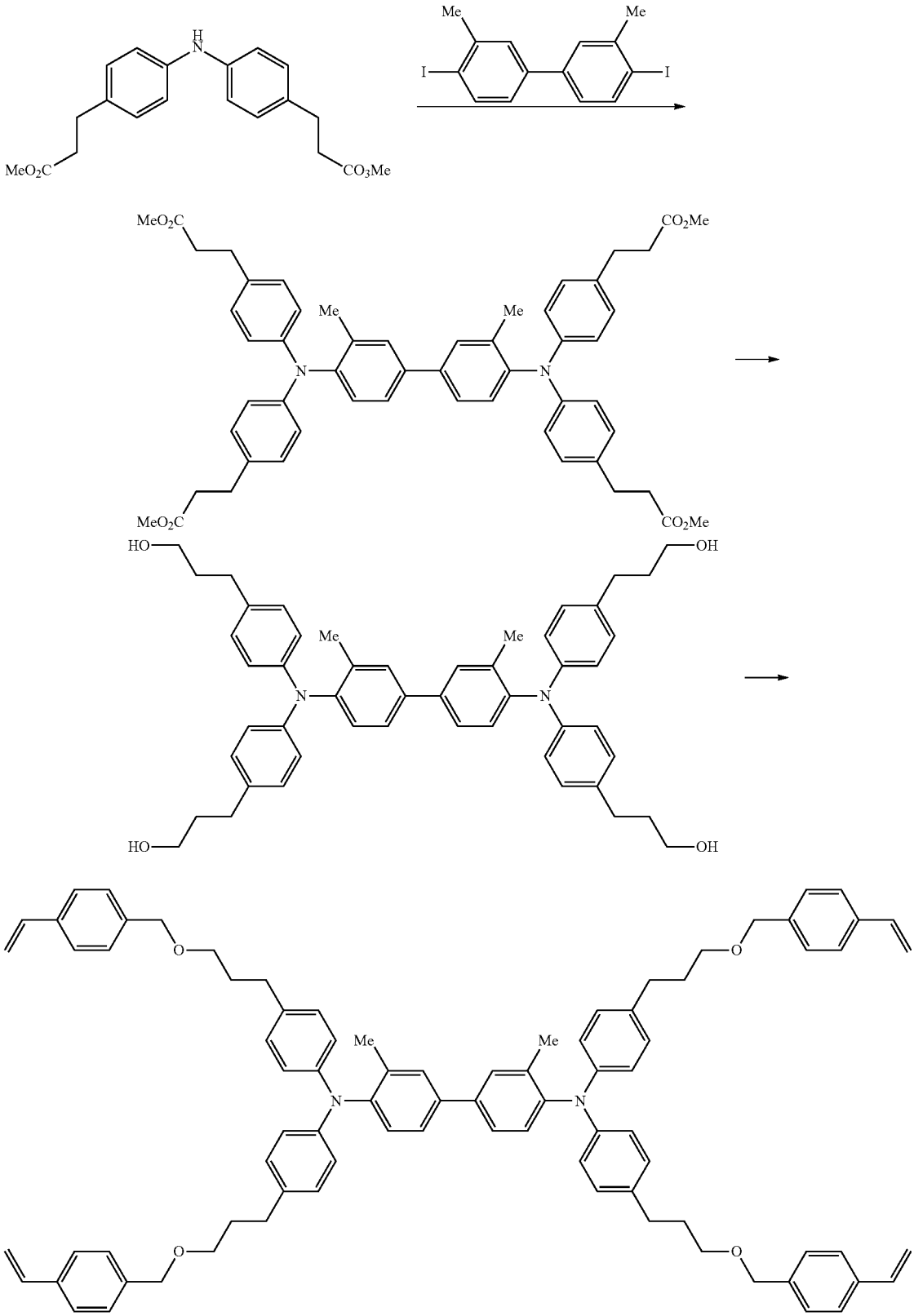

A carboxylic acid of the arylamine compound is obtained by subjecting an ester group of the arylamine compound to hydrolysis using, for example, a basic catalyst (NaOH, $K_2CO_3$, and the like) and an acidic catalyst (for example, phosphoric acid, sulfuric acid, and the like) as described in Experimental Chemistry Lecture, $4^{th}$ Ed., Vol. 20, p. 51, or the like.

Here, examples of the solvent include various types of the solvents, and an alcohol solvent such as methanol, ethanol, and ethylene glycol, or a mixture thereof with water may preferably be used.

Incidentally, in the case where the solubility of the arylamine compound is low, methylene chloride, chloroform, toluene, dimethylsulfoxide, ether, tetrahydrofuran, or the like may be added.

The amount of the solvent is not particularly limited, but it may be, for example, from 1 part by weight to 100 parts by weight, and preferably from 2 parts by weight to 50 parts by weight, based on 1 part by weight of the ester group-containing arylamine compound.

The reaction temperature is set to be, for example, in a range of room temperature (for example, 25° C.) to the boiling point of the solvent, and in terms of the reaction rate, preferably 50° C. or higher.

The amount of the catalyst is not particularly limited, and may be, for example, from 0.001 part by weight to 1 part by weight, and preferably from 0.01 part by weight to 0.5 part by weight, based on 1 part by weight of the ester group-containing arylamine compound.

After the hydrolysis reaction, in the case where the hydrolysis is carried out with a basic catalyst, the produced salt is neutralized with an acid (for example, hydrochloric acid) to be free. Further, after sufficiently washing with water, the product is dried and used, or may be, if necessary, purified by recrystallization with a suitable solvent such as methanol, ethanol, toluene, ethyl acetate, and acetone, and then dried and used.

Furthermore, the alcohol form of the arylamine compound is synthesized by reducing an ester group of the arylamine compound to a corresponding alcohol using aluminum lithium hydride, sodium borohydride, or the like as described in, for example, Experimental Chemistry Lecture, $4^{th}$ Ed., Vol. 20, P. 10, or the like.

For example, in the case of introducing a reactive group with an ester bond, ordinary esterification in which a carboxylic acid of the arylamine compound and hydroxymethylstyrene are dehydrated and condensed using an acid catalyst, or a method in which a carboxylic acid of the arylamine compound and halogenated methylstyrene are condensed using a base such as pyridine, piperidine, triethylamine, dimethylaminopyridine, trimethylamine, DBU, sodium hydride, sodium hydroxide, and potassium hydroxide may be used, but the method using halogenated methylstyrene is suitable since it inhibits by-products.

The halogenated methylstyrene may be added in an amount of 1 equivalent or more, preferably 1.2 equivalents or more, and more preferably 1.5 equivalents or more, based on the acid of the carboxylic acid of the arylamine compound, and the base may be added in an amount of from 0.8 equivalent to 2.0 equivalents, and preferably from 1.0 equivalent to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the arylamine compound/carboxylic acid.

The reaction temperature is not particularly limited. After completion of the reaction, the reaction liquid is poured into water, extracted with a solvent such as toluene, hexane, and ethyl acetate, washed with water, and if necessary, purified using an adsorbent such as activated carbon, silica gel, porous alumina, and activated white clay.

Furthermore, in the case of introduction with an ether bond, a method in which an alcohol of an arylamine compound and a halogenated methylstyrene are condensed using a base such as pyridine, piperidine, triethylamine, dimethylaminopyridine, trimethylamine, DBU, sodium hydride, sodium hydroxide, and potassium hydroxide may be preferably used.

The halogenated methylstyrene may be used in an amount of 1 equivalent or more, preferably 1.2 equivalents or more, and more preferably 1.5 equivalents or more, based on the alcohol of the alcohol of the arylamine compound, and the base may be used in an amount of from 0.8 equivalent to 2.0 equivalents, and preferably from 1.0 equivalents to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the alcohol of the arylamine compound.

The reaction temperature is not particularly limited. After completion of the reaction, the reaction liquid is poured into water, extracted with a solvent such as toluene, hexane, and ethyl acetate, washed with water, and if necessary, purification may be carried out using an adsorbent such as activated carbon, silica gel, porous alumina, and activated white clay.

The specific reactive group-containing charge transporting material (in particular, the reactive compound represented by the general formula (II)) is synthesized using, for example, the general method for synthesizing a charge transporting material as shown below (formylation, esterification, etherification, or hydrogenation).

Formylation: a reaction which is suitable for introducing a formyl group into an aromatic compound, a heterocyclic compound, and an alkene, each having an electron donating group. DMF and phosphorous oxytrichloride are generally used and is commonly carried out at a reaction temperature from room temperature (for example, 25° C.) to 100° C.

Esterification: A condensation reaction of an organic acid with a hydroxyl group-containing compound such as an alcohol and a phenol. A method in which a dehydrating agent coexists or water is excluded from the system to move the equilibrium toward the ester side is preferably used.

Etherification: A Williamson synthesis method in which an alkoxide and an organic halogen compound are condensed is general.

Hydrogenation: A method in which hydrogen is reacted with an unsaturated bond using various catalysts.

The content of the specific reactive group-containing charge transporting material is, for example, from 40% by weight to 95% by weight, and preferably from 50% by weight to 95% by weight, based on the total solid content of the composition for forming a layer.

Fluorine-Containing Resin Particles

The fluorine-containing resin particles may be a homopolymer of fluoroolefins or a copolymer of two or more kinds of fluoroolefins and the examples thereof include particles of a copolymer of one or two or more fluoroolefins with non-fluorinated monomers.

Examples of the fluoroolefin include perhalolefins such as tetrafluoroethylene (TFE), perfluorovinyl ether, hexafluoropropylene (HFP), and chlorotrifluoroethylene (CTFE), and non-perfluoroolefins such as vinylidene fluoride (VdF), trifluoroethylene, and vinyl fluoride, with VdF, TFE, CTFE, HFP, and the like being preferable.

On the other hand, examples of the non-fluorinated monomer include hydrocarbon olefins such as ethylene, propylene, and butene, alkyl vinyl ethers such as cyclohexyl vinyl ether (CHVE), ethyl vinyl ether (EVE), butyl vinyl ether, and methyl vinyl ether, alkenyl vinyl ethers such as polyoxyethylene allyl ether (POEAE), and ethyl allyl ether, reactive α,β-unsaturated group-containing organosilicon compounds such as vinyltrimethoxysilane (VSi), vinyltriethoxysilane, and vinyltris(methoxyethoxy)silane, acrylic esters such as methyl acrylate and ethyl acrylate, methacrylic esters such as methyl methacrylate and ethyl methacrylate, vinyl esters such as vinyl acetate, vinyl benzoate, and "BEOBA" (trade name, manufactured by Shell Chemical Co., Ltd.), with alkyl vinyl ether, allyl vinyl ether, vinyl ester, and reactive α,β-unsaturated group-containing organosilicon compounds being preferable.

Among these, those having a high degree of fluorination are preferable, and polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), an ethylene-chlorotrifluoroethylene copolymer (ECTFE), and the like are more preferable. Among these, PTFE, FEP, and PEA are particularly preferable.

As the fluorine-containing resin particles, for example, particles (fluorine resin aqueous dispersion) prepared by a method such as emulsion polymerization of fluorinated monomers may be used as they are or may be used after washing the particles sufficiently with water, and drying them.

The average particle diameter of the fluorine-containing resin particles is preferably from 0.0 μm to 100 μm, and particularly preferably from 0.03 μm to 5 μm.

Furthermore, the average particle diameter of the fluorine-containing resin particles refers to a value measured using a laser diffraction-type particle size distribution measurement device LA-700 (manufactured by Horiba, Ltd.).

As the fluorine-containing resin particles, ones that are commercially available may be used, and examples of the PTFE particles include FLUON L173JE (manufactured by Asahi Glass Co., Ltd.), DANIION THV-221 AZ and DANIION 9205 (both manufactured by Sumitomo 3M Limited), and LUBRON L2 and LUBRON L5 (both manufactured by Daikin Industries, Ltd.).

The fluorine-containing resin particles may be those irradiated with laser light having the oscillation wavelength of an ultraviolet ray band. The laser light radiated to the fluorine-containing resin particles is not particularly limited, and examples thereof include excimer laser. As the excimer laser light, ultraviolet laser light having a wavelength of 400 nm or less, and particularly from 193 nm to 308 nm is suitable. In particular, KrF excimer laser light (wavelength: 248 nm), ArF excimer laser light (wavelength: 193 nm), and the like are preferable. Irradiation of excimer laser light is usually carried out at room temperature (25° C.) in air, but may be carried out under an oxygen atmosphere.

Moreover, the irradiation condition for excimer laser light depends on the type of a fluorine resin and the required degree of surface modification, but general irradiation conditions are as follows.

Fluence: 50 mJ/cm$^2$/pulse or more

Incident energy: 0.1 J/cm$^2$ or more

Number of shots: 100 or less

Particularly suitable irradiation conditions that are commonly used for KrF excimer laser light and ArF excimer laser light are as follows.

KrF

Fluence: from 100 mJ/cm$^2$/pulse to 500 mJ/cm$^2$/pulse

Incident energy: from 0.2 J/cm$^2$ to 2.0 J/cm$^2$

Number of shots: from 1 to 20

ArF

Fluence: from 50 mJ/cm$^2$/pulse to 150 mJ/cm$^2$/pulse

Incident energy: from 0.1 J/cm$^2$ to 1.0 J/cm$^2$

Number of shots: from 1 to 20

The content of the fluorine-containing resin particles is preferably from 1% by weight to 20% by weight, and more preferably from 1% by weight to 12% by weight, based on the total solid content of the protective layer (outermost surface layer).

Fluorine-Containing Dispersant

The fluorine-containing dispersant is used to disperse the fluorine-containing resin particles in a protective layer (outermost surface layer), and thus, preferably has a surfactant action, that is, it is preferably a substance having a hydrophilic group and a hydrophobic group in the molecule.

Examples of the fluorine-containing dispersant include a resin formed by the polymerization of the following reactive monomers (hereinafter referred to as a "specific resin"). Specific examples thereof include a random or block copolymer of an acrylate having a perfluoroalkyl group with monomer having no fluorine, a random or block copolymer of a methacrylate homopolymer and the acrylate having a perfluoroalkyl group with the monomer having no fluorine, and a random or block copolymer of a methacrylate with the monomer having no fluorine. Further, examples of the acrylate having a perfluoroalkyl group include 2,2,2-trifluoroethyl methacrylate and 2,2,3,3,3-pentafluoropropyl methacrylate.

Furthermore, examples of the monomer having no fluorine include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, and o-phenylphenol glycidyl ether acrylate. Further, other examples thereof include the block or branch polymers disclosed in the specifications of U.S. Pat. No. 5,637,142, Japanese Patent No. 4251662, and the like. Further, in addition, fluorinated surfactants may also be included. Specific examples of the fluorinated surfactant include SURFLON S-611 and SURFLON S-385 (both manufactured by AGO Seimi Chemical Co., Ltd.), FTERGENT 730FL and FTERGENT 750FL (both manufactured by NEOS Co., Ltd.), PF-636 and PF-6520 (both manufactured by Kitamura Chemicals Co., Ltd.), MEGAFACE EXP, TF-1507, MEGA- FACE EXP, and TF-1535 (all manufactured by DIC), and FC-4430 and FC-4432 (both manufactured by 3M Corp.).

Furthermore, the weight average molecular weight of the specific resin is preferably from 100 to 50000.

The content of the fluorine-containing dispersant is preferably from 0.1% by weight to 1% by weight, and more preferably from 0.2% by weight to 0.5% by weight, based on the total solid content of the protective layer (outermost surface layer).

As a method for attaching the fluorine-containing dispersant to the surface of the fluorine-containing resin particles, the fluorine-containing dispersant may be directly attached on the surface of the fluorine-containing resin particles, or first, the monomers are adsorbed on the surface of the fluorine-containing resin particles, and then polymerized to form the specific resin on the surface of the fluorine-containing resin particles.

The fluorine-containing dispersant may be used in combination with other surfactants. However, the amount thereof is preferably extremely little, and the amount of the other surfactants is preferably from 0 part by weight to 0.1 part by weight, more preferably from 0 part by weight to 0.05 part by weight, and particularly preferably from 0 part by weight to 0.03 part by weight, based on 1 part by weight of the fluorine-containing resin particles.

As the other surfactant, nonionic surfactants are preferable, and examples thereof include polyoxyethylene alkyl ethers, polyoxyethylene alkylphenyl ethers, polyoxyethylene alkyl esters, sorbitan alkyl esters, polyoxyethylene sorbitan alkyl esters, glycerin esters, fluorinated surfactants and derivatives thereof.

Specific examples of the polyoxyethylenes include EMULGEN 707 (manufactured by Kao Corporation), NAROACTY CL-70 and NAROACTY CL-85 (both manufactured by Sanyo Chemical Industries, Ltd.), and LECCOL TD-120 (manufactured by Lion Corporation).

Compound Having Unsaturated Bond

The film constituting the protective layer (outermost surface layer) may use a compound having an unsaturated bond in combination.

The compound having an unsaturated bond may be any one of a monomer, an oligomer, and a polymer, and may further have a charge transporting skeleton.

Examples of the compound having an unsaturated bond, which has no charge transporting skeleton, include the following compounds.

Specifically, as the monofunctional monomers, for example, isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, o-phenylphenol glycidyl ether acrylate, and styrene are exemplified.

As the difunctional monomers, for example, diethylene glycol di(meth)acrylate, polyethylene glycol di(meth)acrylate, polypropylene glycol di(meth)acrylate, neopentyl glycol di(meth)acrylate, 1,6-hexanediol di(meth)acrylate, divinylbenzene, and diallyl phthalate are exemplified.

As the trifunctional monomers, for example, trimethylol propane tri(meth)acrylate, pentaerythritol tri(meth)acrylate, aliphatic tri(meth)acrylate, and trivinylcyclohexane are exemplified.

As the tetrafunctional monomers, pentaerythritol tetra (meth)acrylate, ditrimethylol propane tetra(meth)acrylate, aliphatic tetra(meth)acrylate are exemplified.

As the pentafunctional or higher functional monomers, for example, (meth)acrylates having a polyester skeleton, a urethane skeleton, and a phosphagen skeleton, in addition to dipentaerythritol penta(meth)acrylate, dipentaerythritol hexa (meth)acrylate are exemplified.

Furthermore, examples of the reactive polymer include those disclosed in, for example, JP-A-5-216249, JP-A-5-323630, JP-A-11-52603, JP-A-2000-264961, and JP-A-2005-2291.

In the case where a compound which has an unsaturated bond, and has no charge transporting component is used, it is used singly or in a mixture of two or more kinds thereof.

The content of the compound having an unsaturated bond, which has no charge transporting component, may be 60% by weight or less, preferably 55% by weight or less, and more preferably 50% by weight or less, based on the total solid content of the composition used to form the protective layer (outermost surface layer).

Meanwhile, examples of the compound having an unsaturated bond, which has a charge transporting skeleton, include the following compounds.

Compound Having Chain Polymerizable Functional Group (Chain Polymerizable Functional Group Other Than Styryl Group) and Charge Transporting Skeleton in the Same Molecule The chain polymerizable functional group in the compound having a chain polymerizable functional group and a charge transporting skeleton in the same molecule is not particularly limited as long as it is a functional group that is capable of radical polymerization, and it is, for example, a functional group having a group containing at least carbon double bonds. Specific examples thereof include a group containing at least one selected from a vinyl group, a vinyl ether group, a vinyl thioether group, a styryl group, an acryloyl group, a methacryloyl group, and derivatives thereof. Among these, in terms of high reactivity, the chain polymerizable functional group is preferably a group containing at least one selected from a vinyl group, a styryl group, an acryloyl group, a methacryloyl group, and derivatives thereof.

Furthermore, the charge transporting skeleton in the compound having a chain polymerizable functional group and a charge transporting skeleton in the same molecule is not particularly limited as long as it has a structure known in electrophotographic photoreceptor, and it is, for example, a skeleton derived from a nitrogen-containing hole transporting compound such as a triarylamine compound, a benzidine compound, and a hydrazone compound. Examples thereof include structures having conjugation with nitrogen atoms. Among these, a triarylamine skeleton is preferable.

Non-Reactive Charge Transporting Material

For the film constituting the protective layer (outermost surface layer), a non-reactive charge transporting material may be used in combination. The non-reactive charge transporting material has no reactive group not in charge of charge transportation, and accordingly, in the case where the non-reactive charge transporting material is used in the protective layer (outermost surface layer), the concentration of the charge transporting component increases, which is thus effective for further improvement of electrical characteristics. In addition, the non-reactive charge transporting material may be added to reduce the crosslinking density, so as to adjust the strength.

As the non-reactive charge transporting material, a known charge transporting material may be used, and specifically, a triarylamine compound, a benzidine compound, an arylalkane compound, an aryl-substituted ethylene compound, a stilbene compound, an anthracene compound, a hydrazone compound, or the like is used.

Among these, from the viewpoint of charge mobility, compatibility, or the like, those having a triphenylamine skeleton are preferable.

The amount of the non-reactive charge transporting material used is preferably from 0% by weight to 30% by weight, more preferably from 1% by weight to 25% by weight, and even more preferably from 5% by weight to 25% by weight, based on the total solid content in a coating liquid for forming a layer.

Other Additives

The film constituting the protective layer (outermost surface layer) may be used in a mixture with other coupling agents, particularly, fluorine-containing coupling agents for the purpose of further adjusting film formability, flexibility, lubricating property, and adhesiveness. As these compounds, various silane coupling agents and commercially available silicone hard coat agents are used. In addition, a radical polymerizable group-containing silicon compound or a fluorine-containing compound may be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl)-3-aminopropyltriethoxysilane, tetramethoxysilane, methyltrimethoxysilane, and dimethyldimethoxysilane.

Examples of the commercially available hard coat agent include KP-85, X-40-9740, and X-8239 (all manufactured by Shin-Etsu Chemical Co., Ltd.), and AY42-440, AY42-441, and AY49-208 (all manufactured by Dow Corning Toray Co., Ltd.).

In addition, in order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added.

The silane coupling agent may be used in an arbitrary amount, but the amount of the fluorine-containing compound is preferably 0.25 time or less by weight, based on the compound containing no fluorine from the viewpoint of the film formability of the crosslinked film. In addition, a reactive fluorine compound disclosed in JP-A-2001-166510 or the like may be mixed.

Examples of the radical polymerizable group-containing silicon compound and fluorine-containing compound include the compounds described in JP-A-2007-11005.

A deterioration inhibitor is preferably added to the film constituting the protective layer (outermost surface layer). Preferable examples of the deterioration inhibitor include hindered phenol deterioration inhibitors and hindered amine deterioration inhibitors, and known antioxidants such as organic sulfur antioxidants, phosphite antioxidants, dithiocarbamate antioxidants, thiourea antioxidants, benzimidazole antioxidants, and the like may be used.

The amount of the deterioration inhibitor to be added is preferably 20% by weight or less, and more preferably 10% by weight or less.

Examples of the hindered phenol antioxidant include IRGANOX 1076, IRGANOX 1010, IRGANOX 1098, IRGANOX 245, IRGANOX 1330, and IRGANOX 3114 (all manufactured by Ciba Japan), and 3,5-di-t-butyl-4-hydroxybiphenyl.

Examples of the hindered amine antioxidants include SANOL LS2626, SANOL LS765, SANOL LS770, and SANOL LS744 (all manufactured by Sankyo Lifetech Co., Ltd.), TINUVIN 144 and TINUVIN 622LD (both manufactured by Ciba Japan), and MARK LA57, MARK LA67, MARK LA62, MARK LA68, and MARK LA63 (all manufactured by Adeka Corporation); examples of the thioether antioxidants include SUMILIZER TPS and SUMILIZER TP-D (all manufactured by Sumitomo Chemical Co., Ltd.); and examples of the phosphite antioxidants include MARK 2112, MARK PEP-8, MARK PEP-24G, MARK PEP-36, MARK 329K, and MARK HP-10 (all manufactured by Adeka Corporation).

Conductive particles, organic particles, or inorganic particles may be added to the film constituting the protective layer (outermost surface layer).

Examples of the particles include silicon-containing particles. The silicon-containing particles refer to particles which include silicon as a constitutional element, and specific examples thereof include colloidal silica and silicone particles. The colloidal silica used as the silicon-containing particles is selected from those obtained by dispersing silica having an average particle diameter of from 1 nm to 100 nm, preferably from 10 nm to 30 nm, in an acidic or alkaline aqueous dispersion or in an organic solvent such as an alcohol, a ketone, and an ester. As the particles, commercially available ones may be used.

The solid content of the colloidal silica in the protective layer is not particularly limited, but it is used in an amount in the range of 0.1% by weight to 50% by weight, and preferably from 0.1% by weight to 30% by weight, based on the total solid content of the protective layer.

The silicone particles used as the silicon-containing particles are selected from silicone resin particles, silicone rubber particles, and treated silica particles whose surfaces have been treated with silicone, and commercially available silicone particles may be used.

These silicone particles are spherical, and the average particle diameter is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, based on the total amount of the total solid content of the protective layer.

In addition, examples of other particles include semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Further, various known dispersant materials may be used to disperse the particles.

Oils such as a silicone oil may be added to the film constituting the protective layer (outermost surface layer).

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxylic-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

In order to improve the wettability of the coated film, a silicone-containing oligomer, a fluorine-containing acryl polymer, a silicone-containing polymer, or the like may be added to the film constituting the protective layer (outermost surface layer).

A metal, a metal oxide, carbon black, or the like may be added to the film constituting the protective layer (outermost surface layer). Examples of the metal include aluminum, zinc, copper, chromium, nickel, silver and stainless steel, and resin particles having any of these metals deposited on the surface thereof. Examples of the metal oxide include zinc oxide, titanium oxide, tin oxide, antimony oxide, indium oxide, bismuth oxide, indium oxide on which tin has been doped, tin oxide having antimony or tantalum doped thereon, and zirconium oxide having antimony doped thereon.

These may be used singly or in combination of two or more kinds thereof. When two or more kinds are used in combination, they may be simply mixed, or formed into a solid solution or a fused product. The average particle diameter of the conductive particles is 0.3 μm or less, and particularly preferably 0.1 μm or less.

Composition

The composition used to form a protective layer is preferably prepared as a coating liquid for forming a protective layer, including the respective components dissolved or dispersed in the solvent.

Here, as the solvent of the coating liquid for forming a protective layer, from the viewpoint of the solubility of the charge transporting material, the dispersibility of the fluorine-containing resin particles, and the inhibition of uneven distribution of the fluorine-containing resin particles on the surface layer side of the outermost surface layer, a ketone solvent or ester solvent having a difference (absolute value) in the SP value (solubility parameter as calculated by a Feders method) from the binder resin of the charge transporting layer (specific polycarbonate copolymer) of from 2.0 to 4.0 (preferably from 2.5 to 3.5) may be preferably used.

Specific examples of the solvent of the coating liquid for forming a protective layer include singular or mixed solvents of, for example, ketones such as methylethyl ketone, methylisobutyl ketone, diisopropyl ketone, diisobutyl ketone, ethyl-n-butyl ketone, di-n-propyl ketone, methyl-n-amyl ketone, methyl-n-butyl ketone, diethyl ketone, and methyl-n-propyl ketone; esters such as isopropyl acetate, isobutyl acetate, ethyl acetate, n-propyl acetate, n-butyl acetate, ethyl isovalerate, isoamyl acetate, isopropyl butyrate, isoamyl propionate, butyl butyrate, amyl acetate, butyl propionate, ethyl propionate, methyl acetate, methyl propionate, and allyl acetate. Further, 0% by weight to 50% by weight of an ether solvent (for example, diethyl ether, dioxane, diisopropyl ether, cyclopentyl methyl ether, and tetrahydrofuran), and an alkylene glycol solvent (for example, 1-methoxy-2-propanol, 1-ethoxy-2-propanol, ethylene glycol monoisopropyl ether, and propylene glycol monomethyl ether acetate) may be mixed and used.

Examples of the method of dispersing the fluorine-containing resin particles in the coating liquid for forming a protective layer include dispersing methods using a media dispersing machine such as a ball mill, a vibrating ball mill, an attriter, a sand mill, and a horizontal sand mill; and a medialess dispersing machine such as a stirrer, an ultrasonic dispersing machine, a roll mill, and a high pressure homogenizer. Further, examples of the dispersing method using a high pressure homogenizer include dispersing methods using a collision system that disperses a dispersion liquid in a high pressure state through liquid-liquid collision or liquid-wall collision, or a penetration system that disperses a dispersion liquid by making the dispersion liquid pass through a fine flow channel in a high pressure state.

Furthermore, the method for preparing the coating liquid for forming a protective layer is not particularly limited, and the coating liquid for forming a protective layer may be prepared by mixing a charge transporting material, fluorine-containing resin particles, a fluorine-containing dispersant, and if necessary, other components such as a solvent, and using the above-described dispersing machine, or may be prepared by separately preparing two liquids of a mixed liquid A including fluorine-containing resin particles, a fluorine-containing dispersant, and a solvent, and a mixed liquid B including at least a charge transporting material and a solvent, and then mixing the mixed liquids A and B. By mixing the fluorine-containing resin particles and a fluorine-containing dispersant in a solvent, the fluorine-containing dispersant is easily attached to the surface of the fluorine-containing resin particles.

Furthermore, when the above-described components are reacted with each other to obtain a coating liquid for forming a protective layer, the respective components may be simply mixed and dissolved, but alternatively, the components may be preferably warmed under the conditions of a temperature of from room temperature (20° C.) to 100° C., and more preferably from 30° C. to 80° C., and a time of preferably from 10 minutes to 100 hours, and more preferably from 1 hour to 50 hours. Further, in doing so, it is also preferable to radiate ultrasonic waves.

Formation of Protective Layer

The protective layer-forming coating liquid is applied to a surface to be coated (charge transporting layer) through a general method such as a blade coating method, a wire bar coating method, a spray coating method, a dipping coating method, a bead coating method, an air knife coating method, a curtain coating method, or an inkjet coating method.

Thereafter, radical polymerization is carried out by applying light, electron beams, or heat to the obtained coating film to cure the coating film.

Heat, light, radiation, and the like are used in the curing method. When the coating film is cured by heat and light, a polymerization initiator is not necessarily needed, but a photocuring catalyst or a thermal polymerization initiator may be used. As the photocuring catalyst and the thermal polymerization initiator, known photocuring catalysts and thermal polymerization initiators are used. Electron beams are preferable as the radiation.

Electron Beam Curing

When using electron beams, the acceleration voltage is preferably 300 KV or less, and optimally 150 KV or less. In addition, the radiation dose is in the range of preferably from 1 Mrad to 100 Mrad, and more preferably from 3 Mrad to 50 Mrad. When the acceleration voltage is set to 300 KV or less, the damage of the electron beam irradiation on the photoreceptor characteristics is suppressed. When the radiation dose is set to 1 Mrad or greater, the crosslinking is sufficiently carried out, whereas when the radiation dose is set to 100 Mrad or less, the deterioration of the photoreceptor is suppressed.

The irradiation is performed under an inert gas atmosphere of nitrogen, argon, or the like at an oxygen concentration of 1000 ppm or less, and preferably 500 ppm or less, and heating may be performed at from 50° C. to 150° C. during or after irradiation.

Photocuring

As a light source, a high-pressure mercury lamp, a low-pressure mercury lamp, a metal halide lamp, or the like is used, and a filter such as a band pass filter may be used to select a preferable wavelength. The irradiation time and the light intensity are freely selected, but, for example, the illumination (365 nm) is preferably from 300 mW/cm$^2$ to 1000 mW/cm$^2$, and for example, in the case of irradiation with UV light at 600 mW/cm$^2$, irradiation may be performed for from 5 seconds to 360 seconds.

The irradiation is performed under an inert gas atmosphere of nitrogen, argon, or the like at an oxygen concentration of preferably 1000 ppm or less, and more preferably 500 ppm or less, and heating may be performed at from 50° C. to 150° C. during or after irradiation.

Examples of the photocuring catalyst of intramolecular cleavage type include benzyl ketal photocuring catalysts, alkylphenone photocuring catalysts, aminoalkylphenone photocuring catalysts, phosphine oxide photocuring catalysts, titanocene photocuring catalysts, and oxime photocuring catalysts.

Specifically, examples of the benzyl ketal photocuring catalysts include 2,2-dimethoxy-1,2-diphenylethan-1-one.

Examples of the alkylphenone photocuring catalysts include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyloxy)acetophenone.

Examples of the aminoalkylphenone photocuring catalysts include p-dimethylaminoacetophenone, p-dimethylamino-propiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalysts include 2,4,6-trimethylbenzoyl-diphenyl-phosphine oxide and bis(2,4,6-trimethylbenzoyl)-phenyl phosphine oxide.

Examples of the titanocene photocuring catalysts include bis(η5-2,4-cyclopentadien-1-yl)-bis(2,6-difluoro-3-(1H-pyrrol-1-yl)-phenyl)titanium.

Examples of the oxime photocuring catalysts include 1,2-octanedione,1-[4-(phenylthio)-,2-(O-benzoyloxime)] and ethanone, 1-[9-ethyl-6-(2-methylbenzoyl)-9H-carbazol-3-yl]-,1-(O-acetyloxime).

Examples of the hydrogen withdrawing-type photocuring catalyst include benzophenone photocuring catalysts, thioxanthone photocuring catalysts, benzyl photocuring catalysts, and Michler's ketone photocuring catalysts.

Specifically, examples of the benzophenone photocuring catalysts include 2-benzoyl benzoic acid, 2-chlorobenzophenone, 4,4'-dichlorobenzophenone, 4-benzoyl-4'-methyl-diphenylsulfide, and p,p'-bisdiethylaminobenzophenone.

Examples of the thioxanthone photocuring catalysts include 2,4-diethylthioxanthen-9-one, 2-chlorothioxanthone, and 2-isopropylthioxanthone.

Examples of the benzyl photocuring catalysts include benzyl, (±)-camphorquinone, and p-anisyl.

These photocuring catalysts are used singly, or in combination of two or more kinds thereof.

Thermal Curing

Examples of the thermal polymerization initiator include thermal radical generating agents or derivatives thereof, and specific examples thereof include azo initiators such as V-30, V-40, V-59, V-601, V-65, V-70, VF-096, VE-073, Vam-110, and Vam-111 (manufactured by Wako Pure Chemical Industries, Ltd.), and OTazo-15, OTazo-30, AIBN, AMEN, ADVN, and ACVA (manufactured by Otsuka Chemical Co., Ltd.); and PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PERCYL TCP, PEROYL OPP, PEROYL SEP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (manufactured by NOF Corporation), KAYAKETAL AM-055, TRIGONOX 36-C75, LAUROX, PERCADOX L-W75, PERCADOX CH-50L, TRIGONOX TMBH, KAYACUMENE H, KAYABUTYL H-70, PERCADOX BC-FF, KAYAHEXA AD, PERCADOX 14, KAYABUTYL C, KAYABUTYL D, KAYAHEXA YD-E85, PERCADOX 12-XL25, PERCADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-070, KAYAESTER P-70, KAYAESTER TMPO-70, TRIGONOX 121, KAYAESTER O, KAYAESTER HTP-65W, KAYAESTER AN, TRIGONOX 42, TRIGONOX F-050, KAYABUTYL B, KAYACARBON EH-C70, KAYACARBON EH-W60, KAYACARBON I-20, KAYACARBON BIC-75, TRIGONOX 117, and KAYALENE 6-70 (manufactured by Kayaku Akzo Co., Ltd.), and LUPEROX 610, LUPEROX 188, LUPEROX 844, LUPEROX 259, LUPEROX 10, LUPEROX 701, LUPEROX 11, LUPEROX 26, LUPEROX 80, LUPEROX 7, LUPEROX 270, LUPEROX P, LUPEROX 546, LUPEROX 554, LUPEROX 575, LUPEROX TANPO, LUPEROX 555, LUPEROX 570, LUPEROX TAP, LUPEROX TRIG, LUPEROX TBEC, LUPEROX JW, LUPEROX TRIC, LUPEROX TAEC, LUPEROX DC, LUPEROX 101, LUPEROX F, LUPEROX DI, LUPEROX 130, LUPEROX 220, LUPEROX 230, LUPEROX 233, and LUPEROX 531 (manufactured by Arkema Yoshitomi, Ltd.).

Among them, when an azo polymerization initiator having a molecular weight of 250 or greater is used, the reaction proceeds without unevenness at a low temperature, and thus a high-strength film in which unevenness is suppressed is formed. The molecular weight of the azo polymerization initiator is preferably 250 or greater, and more preferably 300 or greater.

The heating is performed under an inert gas atmosphere of nitrogen, argon, or the like at an oxygen concentration of preferably 1000 ppm or less, and more preferably 500 ppm or less and a temperature of preferably from 50° C. to 170° C., and more preferably from 70° C. to 150° C. for preferably from 10 minutes to 120 minutes, and more preferably from 15 minutes to 100 minutes.

The total content of the photocuring catalyst or the thermal polymerization initiator is preferably from 0.1% by weight to 10% by weight, more preferably from 0.1% by weight to 8% by weight, and particularly preferably from 0.1% by weight to 5% by weight with respect to the total solid content in the solution for layer formation.

In this exemplary embodiment, a thermal curing method in which radicals are relatively slowly generated is employed due to the reason that when the reaction excessively rapidly proceeds, structural relaxation of the coating film is difficult to occur due to the crosslinking, and thus unevenness and wrinkles easily occur in the film.

Particularly, when the specific reactive group-containing charge transporting material and thermal curing are combined with each other, structural relaxation of the coating film is promoted, whereby a protective layer (outermost layer) having excellent surface properties is easily obtained.

The thickness of the protective layer is set in the range of, for example, preferably from 3 μm to 40 μm, and more preferably from 5 μm to 35 μm.

Image Forming Apparatus (and Process Cartridge)

Hereinafter, an image forming apparatus (and process cartridge) according to this exemplary embodiment will be described in detail.

Figure 2:
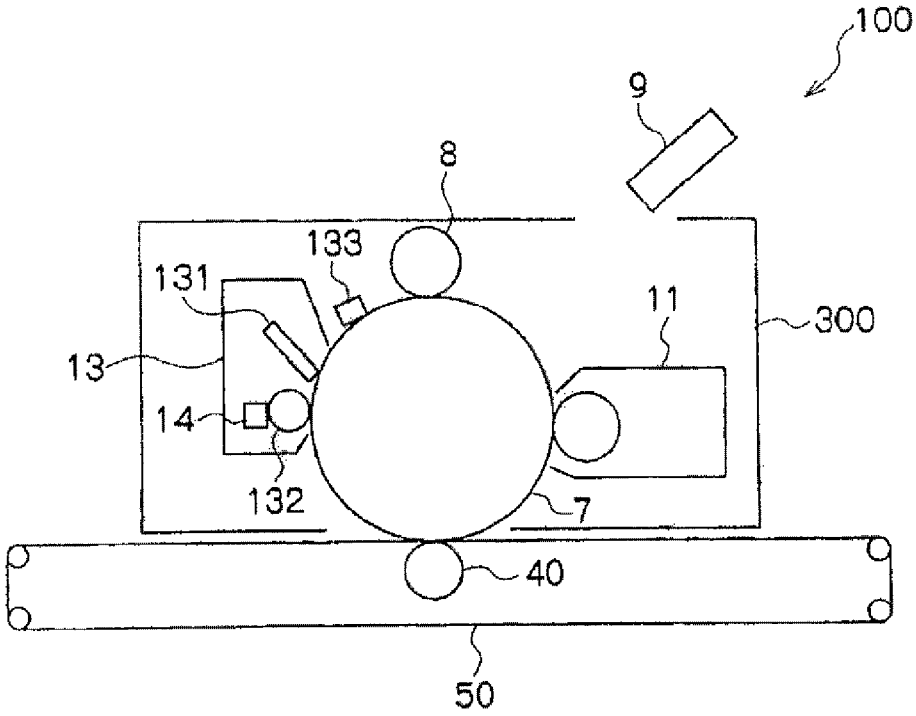
FIG. 2 is a schematic structural diagram showing an example of the image forming apparatus according to the present exemplary embodiment.

FIG. 2 is a diagram schematically showing the configuration of the image forming apparatus according to the first exemplary embodiment. As shown in FIG. 2, the image forming apparatus 100 is provided with a process cartridge 300 provided with an electrophotographic photoreceptor 7, an exposure device 9, a transfer device 40, and an intermediate transfer member 50. In the image forming apparatus 100, the exposure device 9 is disposed so that it is possible to expose the electrophotographic photoreceptor 7 through an opening portion of the process cartridge 300, the transfer device 40 is disposed at a position that is opposed to the electrophotographic photoreceptor 7 with the intermediate transfer member 50 interposed therebetween, and the intermediate transfer member 50 is disposed so as to be partially brought into contact with the electrophotographic photoreceptor 7. Also the image forming apparatus has a secondary transfer device which is not shown in the figure and transfers the toner images from the intermediate transfer member 50 to recording medium.

The process cartridge 300 in FIG. 2 integrally supports the electrophotographic photoreceptor 7, a charging device 8, a developing device 11 and a cleaning device 13 in a housing. The cleaning device 13 has a cleaning blade (cleaning member). The cleaning blade 131 is disposed so as to be brought into contact with the surface of the electrophotographic photoreceptor 7.

Although using a fibrous member 132 (roll shape) which supplies an antifriction 14 to the surface of the electrophotographic photoreceptor 7 and a fibrous member 133 (flat brush shape) which assists cleaning are exemplified, these may or may not be used.

Hereinafter, elements of the image forming apparatus according to this exemplary embodiment will be described in detail.

Charging Device

As the charging device 8, a contact charging device that uses, for example, a conductive or semiconductive charging roller, charging brush, charging film, charging rubber blade or charging tube is used. A known charging device such as a non-contact roller charging device, Scorotron corona charger or Corotron corona charger that makes use of corona discharge may be used as well.

Though not shown in the drawing, a photoreceptor heating member for elevating a temperature of the electrophotographic photoreceptor 7 to reduce a relative temperature may be disposed around the electrophotographic photoreceptor 7 to enhance stability of an image.

Exposure Device

As the exposing device 9, an optical device for desirably image-wise exposing light of semiconductor laser beam, LED light or liquid crystal shutter light on a surface of the photoreceptor 7 is exemplified. A wavelength of a light source, which is in a spectral sensitivity range of a photoreceptor, is used. As a wavelength of a semiconductor laser, near-infrared having an oscillation wavelength in the proximity of 780 nm is mainly used. However, without restricting to the wavelength, a laser having an oscillation wavelength of 600 something nm or a laser having an oscillation wavelength in the vicinity of from 400 nm to 450 nm as a blue laser may be used. Furthermore, when a color image is formed, a surface-emitting laser light source capable of outputting multibeams as well is effective.

Developing Device

As the developing device 11, a general developing device where, for example, a magnetic or nonmagnetic single component developer or two-component developer is used in contact or without contact to develop may be used. The developing device is selected in accordance with the object as long as the foregoing functions are possessed. For example, a known developing device where the single component or two-component developer is attached to a photoreceptor 7 by use of a brush or a roller is cited. Among these, a developing roller retaining a developer on a surface thereof is preferably used.

Hereinafter, a toner that is used in the developing device 11 is described. The developer may be a single component developer composed of a toner, or two-component developer including a toner and a carrier.

Cleaning Device

A device with a cleaning blade system which is provided with the cleaning blade 131 is used as the cleaning device 13.

Other than the cleaning blade system, a fur brush cleaning system or a system in which cleaning is carried out simultaneously with development may be employed.

Transfer Device

As the transfer device 40, a known charging device such as a contact transfer charging device that uses, for example, a belt, a roller, a film or a rubber blade; or a Scorotron corona charger or Corotron corona charger using corona discharge may be used as well.

As the intermediate transfer member 50, a belt (intermediate transfer belt) made of semiconductive polyimide, polyamideimide, polycarbonate, polyarylate, polyester, rubber or the like may be used. As a form of the intermediate transfer medium 50, a drum may be used in addition to a belt.

The above-described image forming apparatus 100 may be provided with, for example, known devices, other than the above-described devices.

Figure 3:
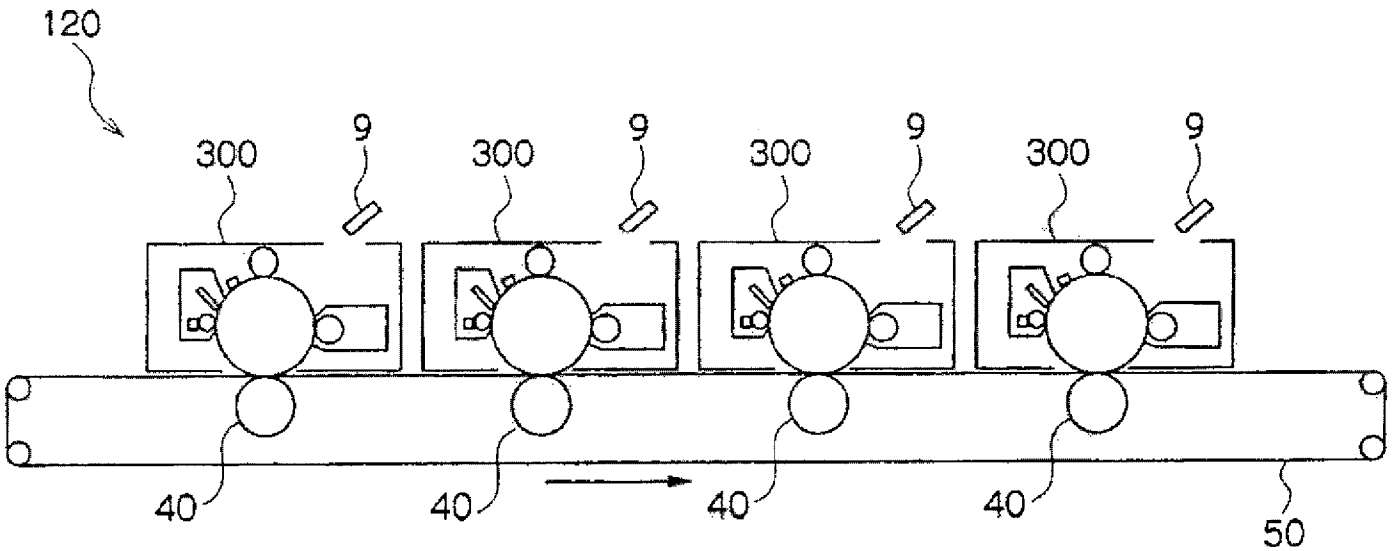
FIG. 3 is a schematic structural diagram showing another example of the image forming apparatus according to the present exemplary embodiment.

FIG. 3 is a schematic diagram showing another example of the configuration of the image forming apparatus according to this exemplary embodiment.

An image forming apparatus 120 shown in FIG. 3 is a tandem multicolor image forming apparatus having four process cartridges 300 installed therein. In the image forming apparatus 120, the four process cartridges 300 are arranged in parallel on an intermediate transfer member 50, and a configuration is employed in which one electrophotographic photoreceptor is used per color. The image forming apparatus 120 has the same configuration as the image forming apparatus 100, except that the image forming apparatus 120 has a tandem system.

The process cartridge according to this exemplary embodiment may be any process cartridge as long as it is provided with an electrophotographic photoreceptor and is detachable from the image forming apparatus.

As for the above-described image forming apparatus (process cartridge) according to this exemplary embodiment, the image forming apparatus to which a dry developer is applied has been described. However, an image forming apparatus (process cartridge) to which a liquid developer is applied may be used. Particularly, in the image forming apparatus (process cartridge) to which a liquid developer is applied, an outermost layer of an electrophotographic photoreceptor swells due to liquid components of the liquid developer, and thus cracks or cleaning scratches due to the cleaning are easily generated. However, when the electrophotographic photoreceptor according to this exemplary embodiment is applied, these are improved, and as a result, stable images are obtained over a long period of time.

Figure 4:
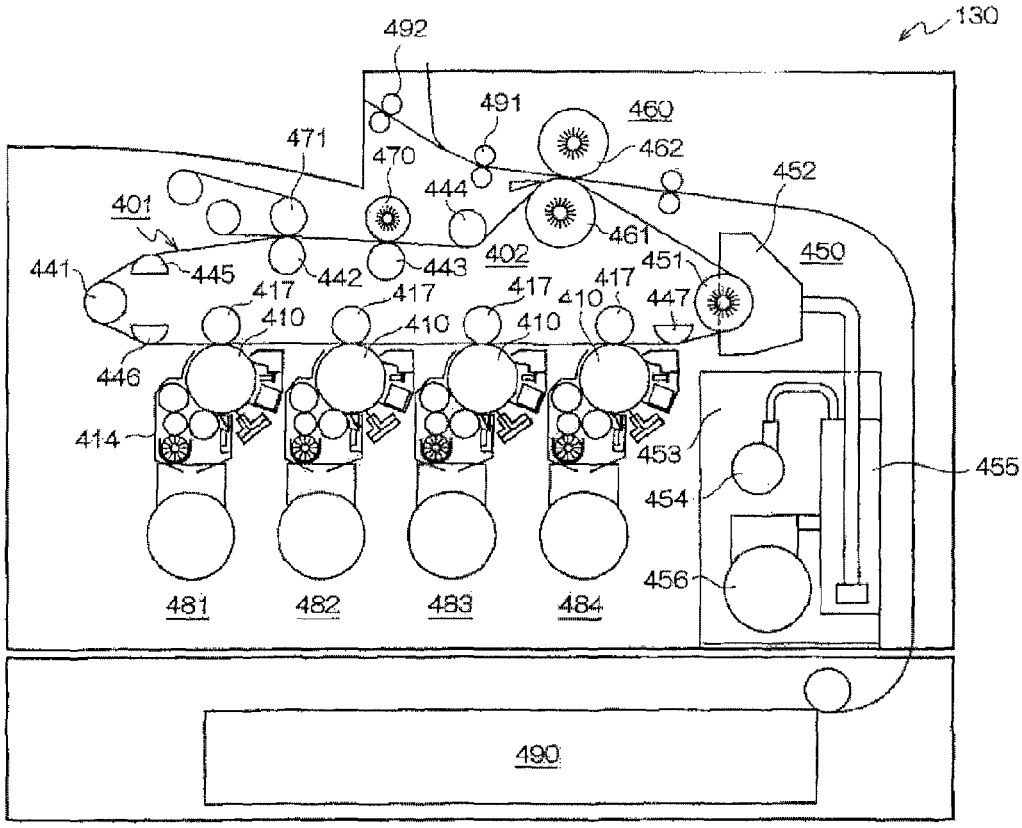
FIG. 4 is a schematic structural diagram showing still another example of the image forming apparatus according to the present exemplary embodiment.
Figure 5:
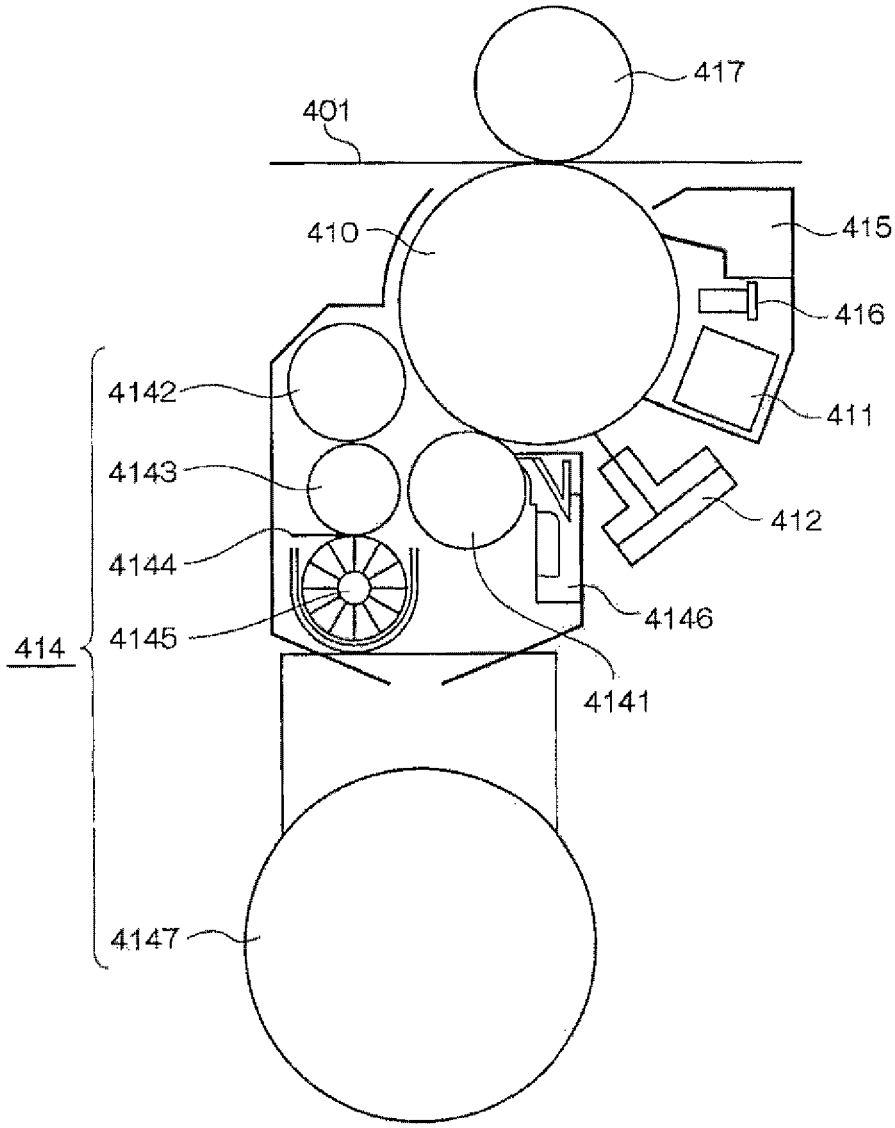
FIG. 5 is a schematic structural diagram showing the developing apparatus in the image forming apparatus shown in FIG. 4.

FIG. 4 is a schematic diagram showing a further example of the configuration of the image forming apparatus according to this exemplary embodiment. FIG. 5 is a schematic diagram showing a configuration of an image forming unit in the image forming apparatus shown in FIG. 4.

An image forming apparatus 130 shown in FIG. 4 is mainly configured by a belt-shaped intermediate transfer member 401, color image forming units 481, 482, 483, and 484, a heating part 450 (an example of a layer forming section), and a transfer fixing part 460.

As shown in FIG. 5, the image forming unit 481 is configured by an electrophotographic photoreceptor 410, a charging device 411 which charges the electrophotographic photoreceptor 410, a LED array head 412 (an example of an electrostatic latent image forming section) which performs an image exposure in order to form an electrostatic latent image on a surface of the charged electrophotographic photoreceptor 410 in accordance with image information, a developing device 414 which develops the electrostatic latent image which is formed on the electrophotographic photoreceptor 410 using a liquid developer, a cleaner 415 which cleans the surface of the photoreceptor, an erasing device 416, and a transfer roll 417 (an example of a primary transfer section) which is disposed to be opposed to the electrophotographic photoreceptor 410 with the belt-shaped intermediate transfer member 401 interposed therebetween, and to which a transfer bias is applied to transfer, onto the belt-shaped intermediate transfer member 401, the image which is formed on the electrophotographic photoreceptor 410 and developed with the liquid developer.

As shown in FIG. 5, the developing device 414 has a developing roll 4141, a liquid drain-off roll 4142, a developer cleaning roll 4143, a developer cleaning blade 4144, a developer cleaning brush 4145, a circulation pump (not shown), a liquid developer supply path 4146, and a developer cartridge 4147 provided therein.

As the liquid developer which is used herein, a liquid developer in which particles including a heating fusing fixing-type resin such as polyester or polystyrene as a main component are dispersed, or a liquid developer which is formed into a layer (hereinafter, referred to as forming into a film) by increasing the ratio of the solid content in the liquid developer by removing a surplus dispersion medium (carrier liquid) is used. The detailed description of the material which is formed into a film is shown in U.S. Pat. No. 5,650,253 (from Column 10, Line 8 to Column 13, Line 14) and U.S. Pat. No. 5,698,616.

The developer which is formed into a film is a liquid developer in which a substance having a fine particle diameter (such as a toner having a fine particle diameter) having a glass transition temperature lower than room temperature (for example, 25° C.) is dispersed in a carrier liquid. Usually, particles of the substance do not come into contact and aggregate with each other. However, when the carrier liquid is removed, only the substance is present, and thus when the substance is adhered in the form of a film, the particles are bonded to each other at room temperature (for example, 25° C.) and a film is formed. This substance is obtained by blending ethyl alcohol with methyl methacrylate, and the glass transition temperature is set in accordance with the blending ratio.

Other image forming units 482, 483, and 484 also have the same configuration. Liquid developers having different colors (yellow, magenta, cyan, and black) are charged in the developing devices of the respective image forming units. In addition, the electrophotographic photoreceptor, the developing device, or the like is made into a cartridge in the respective image forming units 481, 482, 483, and 484.

In the above configuration, examples of the material of the belt-shaped intermediate transfer member 401 include a PET film (polyethylene telephthalate film) coated with silicon rubber or a fluorine resin, and a polyimide film.

The electrophotographic photoreceptor 410 is brought into contact with the belt-shaped intermediate transfer member 401 on an upper surface thereof, and moves with the belt-shaped intermediate transfer member 401 at the same rate.

For example, a corona charger is used as the charging device 411. As the electrophotographic photoreceptors 410 in the image forming units 481, 482, 483, and 484, electrophotographic photoreceptors 410 having the same peripheral length are used, and an interval between the transfer rolls 417 is the same as the peripheral length of the electrophotographic photoreceptor 410, or the integral multiple of the peripheral length.

The heating part 450 is configured by a heating roll 451 which is provided to be brought into contact and rotated with an inner surface of the belt-shaped intermediate transfer member 401, a reservoir tank 452 which is provided to be opposed to the heating roll 451 and surround an outer surface of the belt-shaped intermediate transfer member 401, and a carrier liquid recovering part 453 which recovers a carrier liquid vapor and a carrier liquid from the reservoir tank 452. A suction blade 454 which sucks the carrier liquid vapor in the reservoir tank 452, a condensing part 455 which converts the carrier liquid vapor into a liquid, and a recovery cartridge 456 which recovers the carrier liquid from the condensing part 455 are mounted on the carrier liquid recovering part 453.

The transfer fixing part 460 (an example of a secondary transfer section) is configured by a transfer support roll 461 which rotates and supports the belt-shaped intermediate transfer member 401 and a transfer fixing roll 462 which rotates while pressing a recording medium passing through the transfer fixing part 460 against the belt-shaped intermediate transfer member 401, and both of them have a heating element therein.

In addition, a cleaning roll 470 and a cleaning web 471 which perform cleaning on the belt-shaped intermediate transfer member 401 prior to the formation of the color image on the belt-shaped intermediate transfer member 401, and support rolls 441 to 444 and support shoes 445 to 447 which support the rotary drive of the belt-shaped intermediate transfer member 401 are provided.

Regarding the belt-shaped intermediate transfer member 401, the transfer rolls 417 of the respective color image forming units, the heating roll 451, the transfer support roll 461, the support rolls 441 to 444, the support shoes 445 to 447, the cleaning roll 470, and the cleaning web 471 constitute an intermediate unit 402, and the intermediate unit 402 in the vicinity of the support roll 441 is integrally moved up and down around the vicinity of the heating roll 451.

Hereinafter, an operation of the image forming apparatus shown in FIG. 4 which uses a liquid developer will be described.

First, in the image forming unit 481, an image exposure according to yellow image information is performed by the LED array head 412 on the electrophotographic photoreceptor 410 having a surface charged by the charging device 411 to form an electrostatic latent image. The electrostatic latent image is developed with a yellow liquid developer by the developing device 414.

Here, the developing is performed in the following steps. The yellow liquid developer passes through the liquid developer supply path 4146 from the developer cartridge 4147 by a circulation pump and is supplied around a position at which the developing roll 4141 and the electrophotographic photoreceptor 410 approach each other. Due to a developing electric field which is formed between the electrostatic latent image on the electrophotographic photoreceptor 410 and the developing roll 4141, the colored solid content having a charge in the supplied liquid developer transfers to the electrostatic latent image part as an image part on the electrophotographic photoreceptor 410.

Next, the carrier liquid is removed from the electrophotographic photoreceptor 410 by the liquid drain-off roll 4142 so as to obtain a carrier liquid ratio which is necessary in the next transfer process. In this manner, a yellow image by the yellow liquid developer is formed on the surface of the electrophotographic photoreceptor 410 passing through the developing device 414.

In the developing device 414, the developer cleaning roll 4143 removes the liquid developer on the developing roll 4141 after the developing operation and the liquid developer adhered to a squeeze roll due to a squeeze operation, and the developer cleaning blade 4144 and the developer cleaning brush 4145 clean the developer cleaning roll 4143 to always perform a stable developing operation. The configuration and the operation of the developing device are described in detail in JP-A-11-249444.

In order to supply a liquid developer having a constant solid content ratio to the developing roll 4141, at least one of the developing device 414 and the developer cartridge 4147 automatically controls the concentration of the solid content in the liquid developer.

The yellow developed image formed on the electrophotographic photoreceptor 410 is brought into contact with the belt-shaped intermediate transfer member 401 on its upper surface due to the rotation of the electrophotographic photoreceptor 410, and electrostatically transferred onto the belt-shaped intermediate transfer member 401 in a contact manner by the transfer roll 417 which is disposed to be opposed to and brought into pressure contact with the electrophotographic photoreceptor 410 via the belt-shaped intermediate transfer member 401 and to which a transfer bias is applied.

In the electrophotographic photoreceptor 410 in which the contact electrostatic transfer is ended, the liquid developer remaining after the transfer is removed by the cleaner 415, and the electrophotographic photoreceptor 410 is erased by the erasing device 416 so as to be used in the next image formation.

Other image forming units 482, 483, and 484 also perform the same operation. As the electrophotographic photoreceptors in the respective image forming units, electrophotographic photoreceptors 410 having the same peripheral length are used, and developed color images formed on the respective photoreceptors are electrostatically transferred in order onto the belt-shaped intermediate transfer member 401 by the transfer rolls which are provided at an interval which is the same as the peripheral length of photoreceptor, or the integral multiple of the peripheral length. Accordingly, the developed images of yellow, magenta, cyan, and black formed on the respective photoreceptors 410 in consideration of the overlapping positions on the belt-shaped intermediate transfer member 401 overlap each other in order with high accuracy on the belt-shaped intermediate transfer member 401 without a position deviation and are electrostatically transferred in a contact manner even when there is eccentricity of the electrophotographic photoreceptor 410, and the images developed with the respective color liquid developers are formed on the belt-shaped intermediate transfer member 401 passing through the image forming unit 484.

The developed images formed on the belt-shaped intermediate transfer member 401 are heated from a rear surface of the belt-shaped intermediate transfer member 401 by the heating roll 451 in the heating part 450, and the carrier liquid which is a dispersion medium almost evaporates, whereby an image formed into a film is obtained. The reason for this is that when the liquid developer is a liquid developer in which particles including a heating fusing fixing-type resin as a main component are dispersed, the dispersed particles are melted due to the removal of the surplus dispersion medium and the heating by the heating roll 451 and form a film. Otherwise, the reason is that the liquid developer is a liquid developer which is formed into a film by removing a surplus dispersion medium (carrier liquid) and increasing the ratio of the solid content in the liquid developer.

In the heating part 450, a carrier liquid vapor in the reservoir tank 452 which is generated by evaporation by heating by the heating roll 451 is guided to and liquefied in the condensing part 455 by the suction blade 454 in the carrier liquid recovering part 453, and the reliquefied carrier liquid is guided to the recovery cartridge 456 and recovered.

In the transfer fixing part 460, the belt-shaped intermediate transfer member 401 with the film-shaped (layer-shaped) image formed thereon which passes through the heating part 450 is transferred onto a transfer medium (for example, plain paper) which is transported at the right time from a paper storage part 490 in a lower part of the device, through heating and pressing by the transfer support roll 461 and the transfer fixing roll 462 to form the image on the transfer medium. The transfer medium is output and discharged to the outside of the device by discharge rolls 491 and 492. Here, in the transfer, the adhesion of the image formed into a film on the belt-shaped intermediate transfer member 401 to the belt-shaped intermediate transfer member 401 is weaker than the adhesion of the image formed into a film to the transfer medium, and the transfer is performed on the transfer medium by a difference in the adhesion. No electrostatic force is applied at the time of transfer. The bonding power of the image formed into a film is greater than the adhesion to the transfer medium.

In the belt-shaped intermediate transfer member 401 passing through the transfer fixing part 460, the solid content remaining after the transfer or a substance which is contained in the solid content and inhibits the function of the belt-shaped intermediate transfer member 401 is recovered and removed by the cleaning roll 470 having a heating element therein and the cleaning web 471. Thereafter, the belt-shaped intermediate transfer member 401 is used in the next image formation.

After the image is formed as described above, the intermediate unit 402 in the vicinity of the support roll 441 integrally moves upward around the vicinity of the heating roll 451, and the belt-shaped intermediate transfer member 401 is separated from the electrophotographic photoreceptors 410 of the respective image forming units. In addition, the transfer fixing roll 462 is also separated from the belt-shaped intermediate transfer member 401.

When there is again an image forming request, the intermediate unit 402 is operated so as to bring the belt-shaped intermediate transfer member 401 into contact with the electrophotographic photoreceptors 410 of the image forming units. Likewise, the transfer fixing roll 462 is also operated so as to be brought into contact with the belt-shaped intermediate transfer member 401. The operation of the transfer fixing roll 462 may be carried out in accordance with a time at which an image is transferred onto a recording medium.

Figure 6:
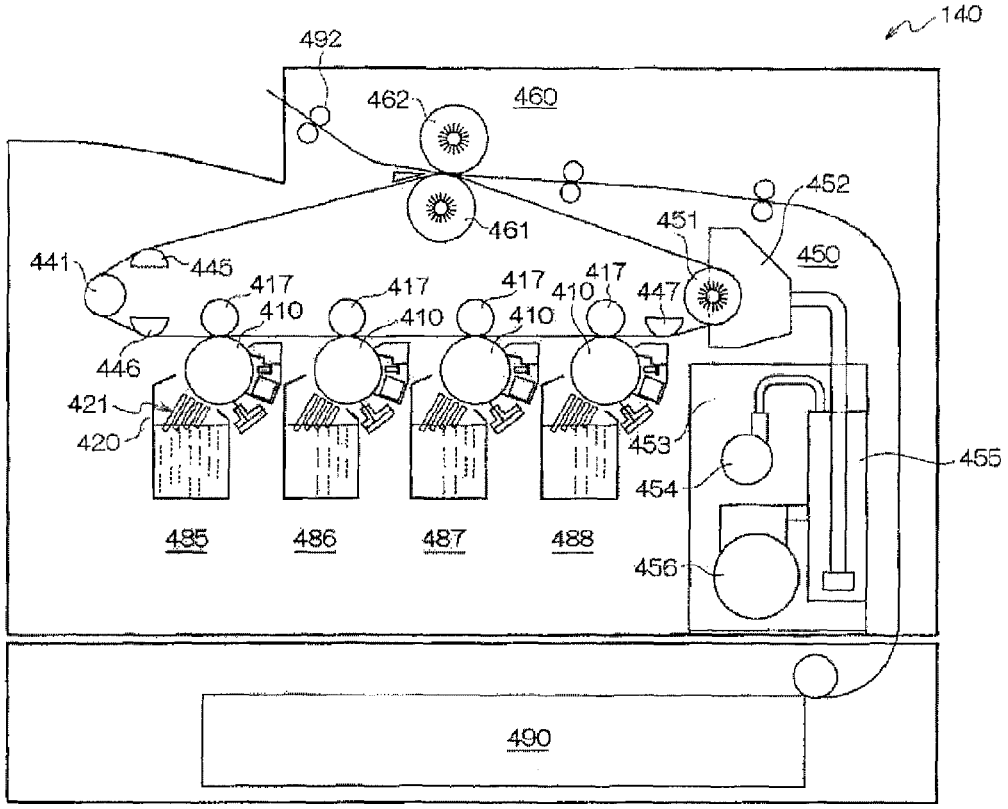
FIG. 6 is a schematic structural diagram showing still another example of the image forming apparatus according to the present exemplary embodiment.

The image forming apparatus using a liquid developer is not limited to the above-described image forming apparatus 130 shown in FIG. 4, and may be, for example, an image forming apparatus shown in FIG. 6.

FIG. 6 is a schematic diagram showing a further example of the configuration of the image forming apparatus according to this exemplary embodiment.

An image forming apparatus 140 shown in FIG. 6 is mainly configured by a belt-shaped intermediate transfer member 401, color image forming units 485, 486, 487, and 488, a heating part 450, and a transfer fixing part 460 as in the image forming apparatus 130 shown in FIG. 4.

The image forming apparatus 140 shown in FIG. 6 is different from the image forming apparatus 130 shown in FIG. 4 in that the belt-shaped intermediate transfer member 401 runs in a substantially triangular form and a developing device 420 in each of the color image forming units 485, 486, 487, and 488 has a different configuration. The heating part 450 and the transfer fixing part 460 are the same as those in the image forming apparatus 130 shown in FIG. 4. A cleaning roll 470 and a cleaning web 471 are omitted in the drawing.

The belt-shaped intermediate transfer member 401 performs a bending operation with the rotation of the belt-shaped intermediate transfer member 401. However, since the bending operation affects the stable running and the lifespan of the belt-shaped intermediate transfer member 401, a substantially triangular running form with a minimized bending operation is employed.

In the developing device 420, there are no developing rolls and liquid drain-off rolls, but plural recording heads 421 which selectively jet and adhere a liquid developer to an electrostatic latent image formed on an electrophotographic photoreceptor 410 are arranged in plural rows.

In addition, a large number of recording electrodes 422 are uniformly provided in a longitudinal direction of the electrophotographic photoreceptor 410 in the respective rows of the recording heads 421, and a jetting electric field is formed between an electrostatic latent image potential formed on the electrophotographic photoreceptor 410 and a jetting bias potential applied to the recording electrode 422, whereby the colored solid content having a charge in the liquid developer supplied to the recording electrode 422 transfers to the electrostatic latent image part as an image part on the electrophotographic photoreceptor 410, and is developed.

Figure 7:
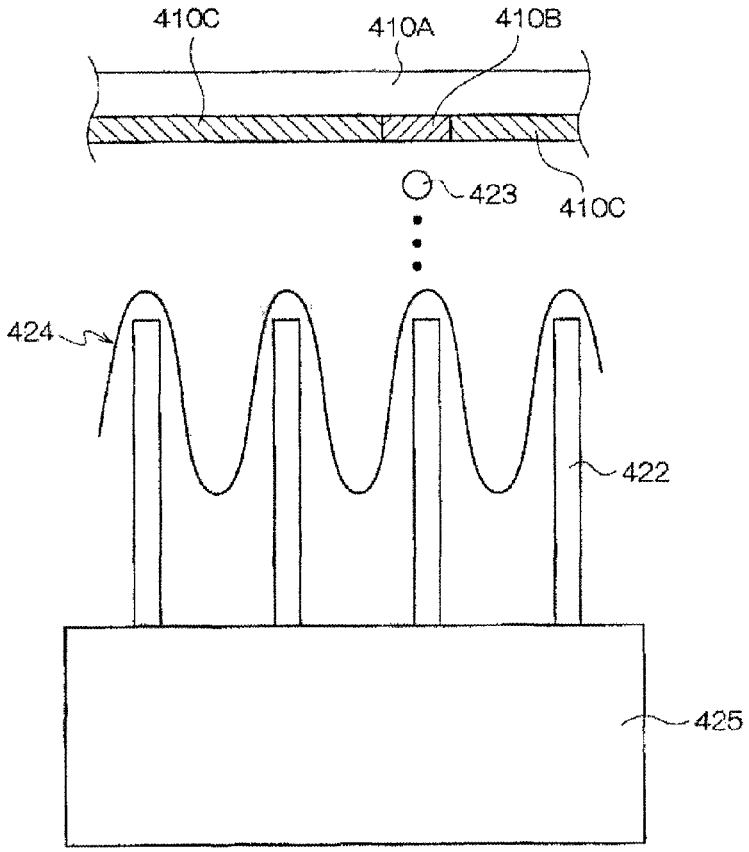
FIG. 7 is a schematic diagram showing the liquid transition state to the meniscus and the image portion of the liquid developer formed around the recording electrode of the developing apparatus in the image forming apparatus shown in FIG. 6.

A meniscus (liquid holding form which is formed on the member or between the members brought into contact with the liquid by viscosity of the liquid, surface tension, and surface energy of the surface of the member brought into contact with the liquid) 424 of the liquid developer is formed around the recording electrode 422. FIG. 7 is a diagram showing the above state. An electrostatic latent image which becomes an image part is formed on an electrophotographic photoreceptor 410A which is a jetting destination of a liquid droplet 423 of the liquid developer. At this time, for example, an electrostatic latent image potential of from 50 V to 100 V is applied to an image part 410B, and for example, a potential of from 500 V to 600 V is applied to a non-image part 4100. Here, when a jetting bias potential of about 1000 V is applied to the recording electrode 422 via a bias voltage supplier 425, a liquid developer having a solid content ratio higher than the ratio of the solid content in the supplied liquid developer, i.e. a high-concentration liquid developer is supplied to a tip end of the recording electrode 422 by electric field concentration, and the liquid droplet 423 generated by the high-concentration liquid developer is jetted and adhered to the electrostatic latent image part (image part) on the electrophotographic photoreceptor 410A by a potential difference (for example, from 700 V to 800 V is a threshold of the potential difference for jetting) between the electrostatic latent image potential of the image part 4100 on the electrophotographic photoreceptor 410A and the jetting bias potential of the recording electrode 422. In addition, in the developing device 420, the developing device itself acts as a developer cartridge.

As for the operation of the image forming apparatus 140 shown in FIG. 6, since only the running form of the belt-shaped intermediate transfer member 401 and the operation of the developing device 420 are different from those in the image forming apparatus 130 shown in FIG. 4 and other operations are the same, the descriptions thereof will be omitted.

Figure 8:
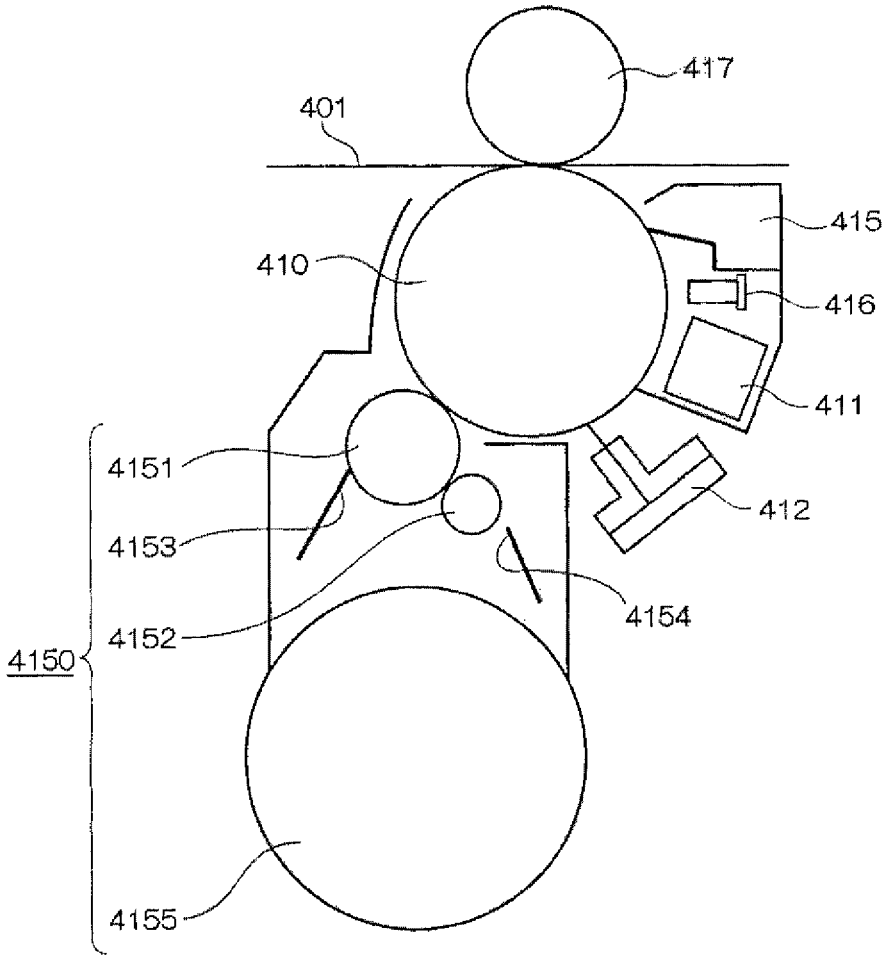
FIG. 8 is a schematic structural diagram showing another example of the developing apparatus in the image forming apparatus shown in FIGS. 4 and 6.

Here, in the image forming apparatus using a liquid developer, the developing device is not limited to the above-described configuration, and for example, may be a developing device shown in FIG. 8.

FIG. 8 is a schematic diagram showing a configuration of another developing device in the image forming apparatus shown in FIG. 4 or 6.

In the image forming apparatus 130 shown in FIG. 4 or the image forming apparatus 140 shown in FIG. 6, when developing an electrostatic latent image formed on an electrophotographic photoreceptor 410 by a developing roll 4151, a developing device 4150 shown in FIG. 8 forms, on the developing roll 4151, a liquid developer layer having a solid content ratio higher than the ratio of the solid content in a liquid developer which is supplied from a developer cartridge 4155, and the developing is carried out by the high-concentration liquid developer layer.

As for the formation of the liquid developer layer having an increased solid content ratio on the developing roll 4151, by forming an electric field by providing a potential difference between a supply roll 4152 and the developing roll 4151, a liquid developer layer having a solid content ratio higher than that of the liquid developer from the developer cartridge 4155 is formed on the developing roll 4151. Cleaning blades 4153 and 4154 are provided to clean roll surfaces of the developing roll 4151 and the supply roll 4152.

The above-described image forming apparatus (process cartridge) according to this exemplary embodiment is not limited to the above-described configuration, and a known configuration may be applied.

EXAMPLES

Hereinbelow, the invention will be described in more detail with reference to Examples, but the invention is not limited thereto.

Example 1

Preparation of Undercoat Layer 100 parts by weight of zinc oxide (average particle diameter: 70 nm, manufactured by Tayca Corporation, specific surface area: 15 $m^2/g$) is stirred and mixed with 500 parts by weight of toluene, and 1.3 parts by weight of a silane coupling agent (KBM503, manufactured by Shin-Etsu Chemical Co., Ltd.) is added thereto, followed by stirring for 2 hours. Subsequently, toluene is removed by distillation under reduced pressure and the resultant is baked at a temperature of 120° C. for 3 hours to obtain zinc oxide having the surface treated with the silane coupling agent.

110 parts by weight of the surface-treated zinc oxide is stirred and mixed with 500 parts by weight of tetrahydrofuran, into which a solution having 0.6 part by weight of alizarin dissolved in 50 parts by weight of tetrahydrofuran is added, followed by stirring at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, Sumidur 3175, manufactured by Sumitomo-Bayer Urethane Co., Ltd.) and 15 parts by weight of a butyral resin (S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with glass beads having a diameter of 1 mmϕ for 2 hours to obtain a dispersion.

0.005 part by weight of dioctyltin dilaurate as a catalyst, and 40 parts by weight of silicone resin particles (Tospal 145, manufactured by GE Toshiba Silicone Co., Ltd.) are added to the dispersion to obtain a coating liquid for forming an undercoat layer.

An undercoat layer having a thickness of 18.7 μm is formed by coating the coating liquid for forming an undercoat layer thus obtained on a cylindrical aluminum support having a diameter of 30 mm, a length of 340 mm and a thickness of 1 mm prepared as a conductive support by dip coating, and performing drying and curing at a temperature of 170° C. for 40 minutes.

Preparation of Charge Generating Layer

A mixture including 15 parts by weight of hydroxygallium phthalocyanine having the diffraction peaks at Bragg angles (2θ±0.2° of at least 7.3°, 16.0°, 24.9°, and 28.0° in an X-ray diffraction spectrum of Cukα characteristic X rays as a charge generating substance, 10 parts by weight a vinyl chloride-vinyl acetate copolymer resin (VMCH, manufactured by Nippon Unicar Co., Ltd.) as a binder resin, and 200 parts by weight of n-butyl acetate is dispersed using a sand mill with the glass beads having a diameter of 1 ϕmm for 4 hours. 175 parts by weight of n-butyl acetate and 180 parts by weight of methyl ethyl ketone are added to the obtained dispersion, followed by stirring to obtain a coating liquid for forming a charge generating layer.

The obtained coating liquid for forming a charge generating layer is dip-coated on the undercoat layer formed in advance on the cylindrical aluminum support, and dried at an ordinary temperature (25° C.) to form a charge generating layer having a film thickness of 0.2 μm.

Preparation of Charge Transporting Layer

First, a polycarbonate copolymer (1) is obtained in the following manner.

In a flask equipped with a phosgene inlet tube, a thermometer, and a stirrer, 106.9 g (0.398 mole) of 1,1-bis(4-hydroxyphenyl)cyclohexane (hereinafter referred to as Z), 24.7 g (0.133 mole) of 4,4'-dihydroxybiphenyl (hereinafter referred to as BP), 0.41 g of hydrosulfide, 825 ml (sodium hydroxide 2.018 moles) of a 9.1% sodium hydroxide aqueous solution, and 500 ml of methylene chloride are combined and dissolved under a nitrogen atmosphere, maintained at from 18° C. to 21° C. under stirring, and 76.2 g (0.770 mole) of phosgene is introduced thereinto over 75 minutes to perform a phosgenation reaction. After the end of the phosgenation reaction, 1.11 g (0.0075 mole) of p-tert-butylphenol and 54 ml (sodium hydroxide 0.266 mole) of a 25% sodium hydroxide aqueous solution are added thereto, followed by stirring, while 0.18 mL (0.0013 mole) of triethylamine is added thereto to perform a reaction at a temperature of from 30° C. to 35° C. for 2.5 hours. The separated methylene chloride phase is washed with an acid and water until the inorganic salts and the amines disappear, and then methylene chloride is removed to obtain a polycarbonate copolymer (1). The polycarbonate copolymer (1) has a ratio of structural units of Z. to BP of 75:25 in terms of a molar ratio.

Next, 40 parts by weight of N,N'-diphenyl-N,N'-bis(3-methylphenyl)-[1,1']biphenyl-4,4'-diamine (TPD), 10 parts by weight of N,N-bis(3,4-dimethylphenyl)biphenyl-4-amine, and 55 parts by weight of the polycarbonate copolymer (1) (viscosity average molecular weight of 50,000) as a binder resin are dissolved in 560 parts by weight of tetrahydrofuran and 240 parts by weight of toluene to obtain a coating liquid for a charge transporting layer. This coating liquid is coated on the charge generating layer and dried at 135° C. for 45 minutes to form a charge transporting layer having a film thickness of 25 μm.

Preparation of Protective Layer

First, 5 parts by weight of LUBRON L2 (manufactured by Daikin Industries, Ltd.) and 0.2 part by weight of a fluorinated graft polymer (ARON GF300: manufactured by Toagosei Co., Ltd.) are repeatedly subjected to a 10-minutes dispersion treatment three times with 300 parts by weight of isobutyl acetate as a solvent using an ultrasonic homogenizer (manufactured by Nihonseiki Kaisha Ltd.) in a thermostat vessel at 20° C. to obtain a suspension. To the suspension are added 100 parts by weight of an exemplary compound (I-a)-31 as a reactive group-containing charge transporting material and 2 parts by weight of VE-73 (manufactured by Wako Pure Chemical Industries, Ltd.) of a polymerization initiator, followed by stirring and mixing them at room temperature for 12 hours to obtain a coating liquid for forming a protective layer.

Next, the obtained coating liquid for forming a protective layer is coated on the charge transporting layer previously formed on the cylindrical aluminum support at a push-up rate of 150 ram/min by a ring coating method. Thereafter, a curing reaction is carried out at a temperature of 160±5° C. for 60 minutes in the state where an oxygen concentration is 200 ppm or less in a nitrogen dryer having an oxygen concentration meter to form a protective layer. The film thickness of the protective layer is 7 μm.

As described above, an electrophotographic photoreceptor is prepared.

Examples 2 to 24, Comparative Examples 1 to 2, and Comparative Examples 4 to 5

The undercoat layer and the charge generating layer are formed on the cylindrical aluminum support by the method described in Example 1 by sequential coating. Thereafter, the protective layer is formed by the method described in Example 1 except that the binder resin of the charge transporting layer, the reactive group-containing charge transporting material (denoted as "RCTM" in the Tables) of the coating liquid for forming a protective layer and the solvent (denoted as "SOL" in the Tables) are changed according to Tables 1 and 2 below, thereby preparing an electrophotographic photoreceptor.

Furthermore, the respective polycarbonate copolymers (denoted as "PC copolymers" in the Tables) used in the respective examples are synthesized according to the synthesis of the polycarbonate copolymer (1) in correspondence with the repeating structural units (denoted as "units" in the Tables).

Comparative Example 3

The undercoat layer and the charge generating layer are formed on the cylindrical aluminum support by sequential coating by the method described in Example 1.

Preparation of Charge Transporting Layer 40 parts by weight of N,N'-diphenyl-N,N'-bis(3-methylphenyl)-[1,1']biphenyl-4,4'-diamine (TPD), 10 parts by weight of N,N-bis(3,4-dimethylphenyl)biphenyl-4-amine, and 55 parts by weight of polycarbonate ("C-1400 WP (bisphenol (A) polycarbonate), manufactured by Teijin Chemicals Ltd.", viscosity average molecular weight of 50,000) are added to 800 parts by weight of dichloromethane and dissolved therein to obtain a coating liquid for a charge transporting layer. This coating liquid is applied to the charge generating layer, followed by drying at 135° C. for 45 minutes, thereby forming a charge transporting layer having a thickness of 25 μm.

Thereafter, the protective layer is formed by the method described in Example 1 except that the binder resin of the charge transporting layer, the reactive group-containing charge transporting material (denoted as "RCTM" in the Tables) of the coating liquid for forming a protective layer and the solvent (denoted as "SOL" in the Tables) are changed according to Table 2 below, thereby preparing an electrophotographic photoreceptor.

Evaluation

The electrophotographic photoreceptor obtained in each of examples is installed in Docucentre-IVC2260 manufactured by Fuji Xerox Co., Ltd., and image formation is continuously performed on 300000 sheets of A4 paper under an environment of 29° C. and 85% RH, with the printing image having a solid image portion having an image density of 100% and a half-tone image portion having an image density of 20% and a fine-line image portion.

For the images at the initial time at the $100^{th}$ sheet and after the passage of time at the $300000^{th}$ sheet, evaluation of the scratch-resistance and confirmation of the presence or absence of blade curling are carried out. Further, for the electrophotographic photoreceptor at the initial time (after printing 100 sheets) and after printing 300,000 sheets in the print test, the residual potential (Rp) after the removal of charge is measured by providing a surface potential probe (at a position of 1 mm from the surface of the electrophotographic photoreceptor) in an area to be measured, using a surface potential meter (Trek 334, manufactured by Trek Co., Ltd.), and the difference (ΔRp) between the initial residual potential and the residual potential after printing 300,000 sheets is calculated. The results are shown in Table 2.

In addition, in the image forming test, P paper (A4 size, horizontal transport) manufactured by Fuji Xerox Co., Ltd. is used.

Evaluation of Scratch Resistance

The surface of the electrophotographic photoreceptor after printing 10000 sheets is observed with the naked eye to carry out evaluation according to the following criteria.

A+: Scratch is not observed.

A: Scratch is extremely partially generated.

B: Scratch is partially generated.

C: Scratch is fully generated.

Blade Curling

A cleaning blade is brought into contact under the following conditions with the electrophotographic photoreceptor after printing 300,000 sheets, and the contact state (whether the blade is curled) after the photoreceptor is rotated 30 times is observed with the naked eye to carry out evaluation of the blade curling according to the following criteria.

Materials for blade: Urethane rubber

Elastic force of blade: 53%

Pressurization pressure: 3.2 g/mm

Residual Potential

The residual potential is evaluated according to the following criteria.

A+: Less than 20 V

A: from 20 V to less than 30 V

B: from 30 V to less than 50 V

C: 50 V or more

TABLE 1

| | Coating liquid for forming a protective layer | | Binder resin of charge transporting layer | | | | | | | | | | | |
|---|---|---|---|---|---|---|---|---|---|---|---|---|---|---|
| | | | | | Viscosity average | Unit 1 | | | Unit 2 | | | Unit 3 | | |
| | Kind of RCTM | Kind of SOL | Kind | SP value | molecular weight | Kind | Molar ratio | SP value | Kind | Molar ratio | SP value | Kind | Molar ratio | SP value |
| Example 1 | a-1 | IBA | PC copolymer (1) | 11.56 | 50,000 | (Z)-0 | 75 | 11.28 | (BP)-0 | 25 | 12.39 | | | |
| Example 2 | a-2 | IBA | PC copolymer (1) | 11.56 | 50,000 | (Z)-0 | 75 | 11.28 | (BP)-0 | 25 | 12.39 | | | |
| Example 3 | a-3 | IBA | PC copolymer (1) | 11.56 | 50,000 | (Z)-0 | 75 | 11.28 | (BP)-0 | 25 | 12.39 | | | |
| Example 4 | a-4 | IBA | PC copolymer (1) | 11.56 | 50,000 | (Z)-0 | 75 | 11.28 | (BP)-0 | 25 | 12.39 | | | |
| Example 5 | a-5 | IBA | PC copolymer (1) | 11.56 | 50,000 | (Z)-0 | 75 | 11.28 | (BP)-0 | 25 | 12.39 | | | |
| Example 6 | a-6 | IBA | PC copolymer (1) | 11.56 | 50,000 | (Z)-0 | 75 | 11.28 | (BP)-0 | 25 | 12.39 | | | |
| Example 7 | a-6 | IBA | PC copolymer (2) | 11.67 | 50,000 | (Z)-0 | 65 | 1128 | (BP)-0 | 35 | 12.39 | | | |
| Example 8 | a-6 | IBA | PC copolymer (3) | 11.46 | 50,000 | (Z)-0 | 80 | 11.28 | (BP)-0 | 10 | 12.39 | (F)-0 | 10 | 12.02 |
| Example 9 | a-6 | IBA | PC copolymer (4) | 11.44 | 50,000 | (Z)-0 | 85 | 11.28 | (BP)-0 | 15 | 12.39 | | | |
| Example 10 | a-6 | IBA | PC copolymer (5) | 11.52 | 50,000 | (Z)-0 | 70 | 11.28 | (BP)-1 | 30 | 12.07 | | | |
| Example 11 | a-6 | IBA | PC copolymer (6) | 11.65 | 50,000 | (Z)-0 | 50 | 11.28 | (F)-0 | 50 | 12.02 | | | |
| Example 12 | a-6 | IBA | PC copolymer (7) | 11.45 | 50,000 | (Z)-0 | 45 | 11.28 | (E)-0 | 55 | 11.59 | | | |

TABLE 1-continued

| | Coating liquid for forming a protective layer | | Binder resin of charge transporting layer | | | | | | | | | | | | |
|---|---|---|---|---|---|---|---|---|---|---|---|---|---|---|---|
| | | | | | Viscosity average | Unit 1 | | | Unit 2 | | | Unit 3 | | | |
| | Kind of RCTM | Kind of SOL | Kind | SP value | molecular weight | Kind | Molar ratio | SP value | Kind | Molar ratio | SP value | Kind | Molar ratio | SP value |
| Example 13 | a-6 | IBA | PC copolymer (9) | 11.63 | 50,000 | (A)-0 | 50 | 11.24 | (F)-0 | 50 | 12.02 | | | |
| Example 14 | a-6 | IBA | PC copolymer (10) | 11.51 | 50,000 | (A)-0 | 65 | 11.24 | (F)-0 | 35 | 12.02 | | | |
| Example 15 | a-7 | IBA | PC copolymer (1) | 11.56 | 50,000 | (Z)-0 | 75 | 11.28 | (BP)-0 | 25 | 12.39 | | | |
| Example 16 | a-8 | IBA | PC copolymer (1) | 11.56 | 50,000 | (Z)-0 | 75 | 11.28 | (BP)-0 | 25 | 12.39 | | | |
| Example 17 | a-6 | IBA | PC copolymer (14) | 11.47 | 50,000 | (Z)-0 | 40 | 11.28 | (E)-0 | 60 | 11.59 | | | |
| Example 18 | a-6 | IBA | PC copolymer (15) | 11.47 | 50,000 | (A)-0 | 70 | 11.24 | (F)-0 | 30 | 12.02 | | | |
| Example 19 | a-9 | IBA | PC copolymer (1) | 11.56 | 50,000 | (Z)-0 | 75 | 11.28 | (BP)-0 | 25 | 12.39 | | | |
| Example 20 | a-10 | IBA | PC copolymer (1) | 11.56 | 50,000 | (Z)-0 | 75 | 11.28 | (BP)-0 | 25 | 12.39 | | | |
| Example 21 | a-6 | EA | PC copolymer (1) | 11.56 | 50,000 | (Z)-0 | 75 | 11.28 | (BP)-0 | 25 | 12.39 | | | |
| Example 22 | a-6 | MIBK | PC copolymer (1) | 11.56 | 50,000 | (Z)-0 | 75 | 11.28 | (BP)-0 | 25 | 12.39 | | | |
| Example 23 | a-6 | di-n-propyl ketone | PC copolymer (1) | 11.56 | 50,000 | (Z)-0 | 75 | 11.28 | (BP)-0 | 25 | 12.39 | | | |
| Example 24 | a-6 | MEK | PC copolymer (1) | 11.56 | 50,000 | (Z)-0 | 75 | 11.28 | (BP)-0 | 25 | 12.39 | | | |

TABLE 2

| | Coating liquid for forming a protective layer | | Binder resin of charge transporting layer | | | | | | | | | | | | |
|---|---|---|---|---|---|---|---|---|---|---|---|---|---|---|---|
| | | | | | Viscosity average | Unit 1 | | | Unit 2 | | | Unit 3 | | | |
| | Kind of RCTM | Kind of SOL | Kind | SP value | molecular weight | Kind | Molar ratio | SP value | Kind | Molar ratio | SP value | Kind | Molar ratio | SP value |
| Comparative Example 1 | a-6 | IBA | b-1 | 11.28 | 50,000 | (Z)-0 | 100 | 11.28 | | | | | | |
| Comparative Example 2 | a-6 | IBA | PC copolymer (11) | 11.33 | 50,000 | (Z)-0 | 95 | 11.28 | (BP)-0 | 5 | 12.39 | | | |
| Comparative Example 3 | a-6 | IBA | b-2 | 11.24 | 40,000 | (A)-0 | 100 | 11.24 | | | | | | |
| Comparative Example 4 | a-6 | IBA | PC copolymer (12) | 11.32 | 50,000 | (A)-0 | 90 | 11.24 | (F)-0 | 10 | 12.02 | | | |
| Comparative Example 5 | a-6 | IBA | PC copolymer (13) | 11,82 | 50,000 | (A)-0 | 25 | 11.24 | (F)-0 | 75 | 12.02 | | | |

TABLE 3

| | Evaluation | | |
|---|---|---|---|
| | Scratch resistance | Blade curling | Residual potential ΔRp |
| Example 1 | A | Not generated | A |
| Example 2 | A | Not generated | A |
| Example 3 | A+ | Not generated | A |
| Example 4 | A+ | Not generated | A |
| Example 5 | A+ | Not generated | A |
| Example 6 | A+ | Not generated | A |
| Example 7 | A | Not generated | A |
| Example 8 | A | Not generated | A |
| Example 9 | A | Not generated | A |
| Example 10 | A | Not generated | A |
| Example 11 | A | Not generated | A |
| Example 12 | A | Not generated | A |
| Example 13 | A | Not generated | A |
| Example 14 | A | Not generated | A |
| Example 15 | B | Not generated | B |
| Example 16 | B | Not generated | B |
| Example 17 | A | Not generated | A |
| Example 18 | A | Not generated | A |
| Example 19 | A | Not generated | A+ |
| Example 20 | A | Not generated | A+ |
| Example 21 | A | Not generated | A |
| Example 22 | A | Not generated | A |
| Example 23 | A | Not generated | A |
| Example 24 | A | Not generated | A |

TABLE 3-continued

| | Evaluation | | |
|---|---|---|---|
| | Scratch resistance | Blade curling | Residual potential ΔRp |
| Comparative Example 1 | C | Generated | A |
| Comparative Example 2 | C | Generated | A |
| Comparative Example 3 | C | Generated | A |
| Comparative Example 4 | C | Generated | A |
| Comparative Example 5 | C | Generated | C |

From the results above, it can be seen that in the present Examples, the satisfactory results are obtained in the evaluation of all of scratch resistance, blade curling, and residual potential, as compared with Comparative Examples.

The details of the abbreviations shown in Tables are shown below.

[RCTM: reactive group-containing charge transporting material]

(a-1): Exemplary compound (I-a)-31

(a-2): Exemplary compound (I-b)-31

(a-3): Exemplary compound (I-c)-43 (see the following synthesis method)

(a-4): Exemplary compound (I-c)-52 (see the following synthesis method)

(a-5): Exemplary compound (II)-54

(a-6): Exemplary compound (II)-55

(a-7): Compound represented by the following structural formula CTM-1

(a-8): Compound represented by the following structural formula CTM-2

(a-9): Exemplary compound (II)-181

(a-10): Exemplary compound (II)-182

Synthesis of Exemplary Compound (I-c)-43

To a 500-ml three necked flask are added 68.3 g of 4,4'-bis(2-methoxycarbonylethyl)diphenylamine, 43.4 g of 4,4'-diiodo-3,3'-dimethyl-1,1'-biphenyl, 30.4 g of potassium carbonate, 1.5 g of copper sulfate pentahydrate, and 50 ml of n-tridecane, and the system is stirred for 20 hours while heating at 220° C. under a nitrogen flow. Thereafter, the temperature is lowered to room temperature, and 200 ml of toluene and 150 ml of water are added to the system to perform a liquid separation operation. The toluene layer is collected, 10 g of sodium sulfate is added thereto, followed by stirring for 10 minutes, and then sodium sulfate is filtered. A crude product formed by distillation of toluene under reduced pressure is purified by silica gel column chromatography using toluene/ethyl acetate as an eluent to obtain 56.0 g (yield of 65%) of (I-c)-43a.

To a 3-L three necked flask are added 43.1 g of (I-c)-43a and 350 ml of tetrahydrofuran, and an aqueous solution having 8.8 g of sodium hydroxide dissolved in 350 ml of water is added thereto, followed by heating and stirring at 60° C. for 5 hours. Thereafter, the reaction liquid is added dropwise to an aqueous solution of 1 L of water/40 ml of concentrated hydrochloric acid, and the precipitated solid is collected by suction filtration. This solid is made into a suspension state by further adding 50 ml of a mixed solvent of acetone/water (volume ratio of 40/60) thereto and stirred, and the solid is collected by suction filtration and dried in vacuum for 10 hours to obtain 36.6 g (yield of 91%) of (I-c)-43b.

To a 500-ml three necked flask are added 28.2 g of (I-c)-43b, 23.5 g of 4-chloromethylstyrene, 21.3 g of potassium carbonate, 0.09 g of nitrobenzene, and 175 ml of DMF(N,N-dimethylformamide), and the system is stirred for hours while heating at 75° C. under a nitrogen flow. Thereafter, the temperature is lowered to room temperature, and the reaction solution is subjected to a liquid separation operation by the addition of 200 ml of ethyl acetate/200 ml of water. The ethyl acetate layer is collected, 10 g of sodium sulfate is added thereto, followed by stirring for 10 minutes, and then sodium sulfate is filtered. A crude product formed by distillation of ethyl acetate under reduced pressure is purified by silica gel column chromatography using toluene/ethyl acetate as an eluent to obtain 37.8 g (yield of 85%) of (I-c)-43.

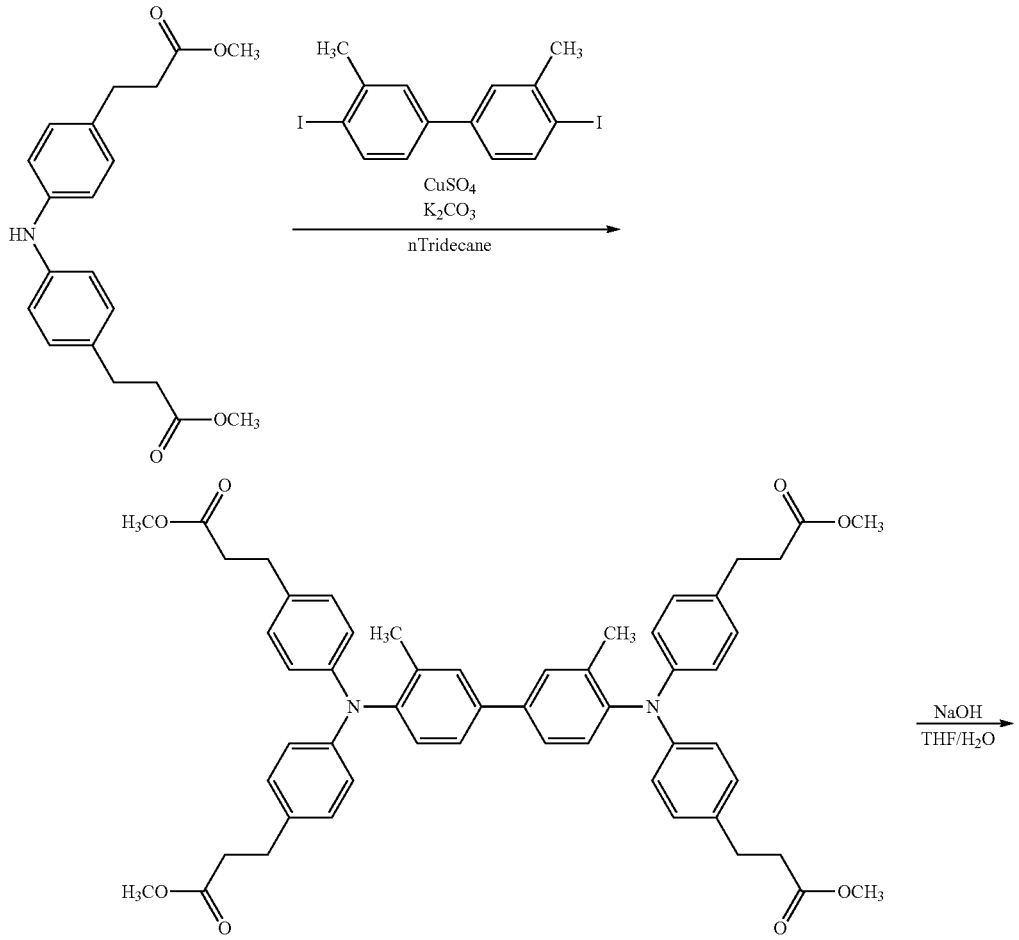

(I-c)-43a

-continued

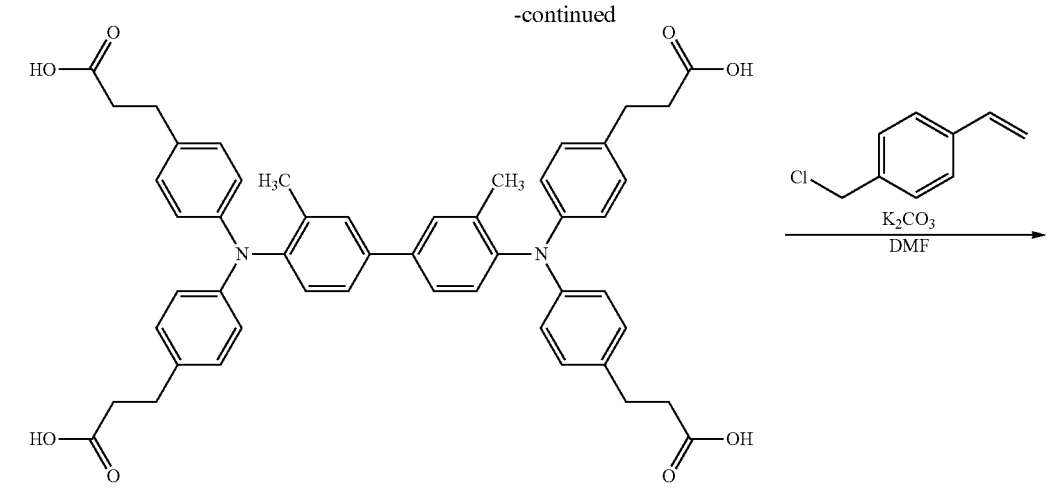

(I-c)-43b

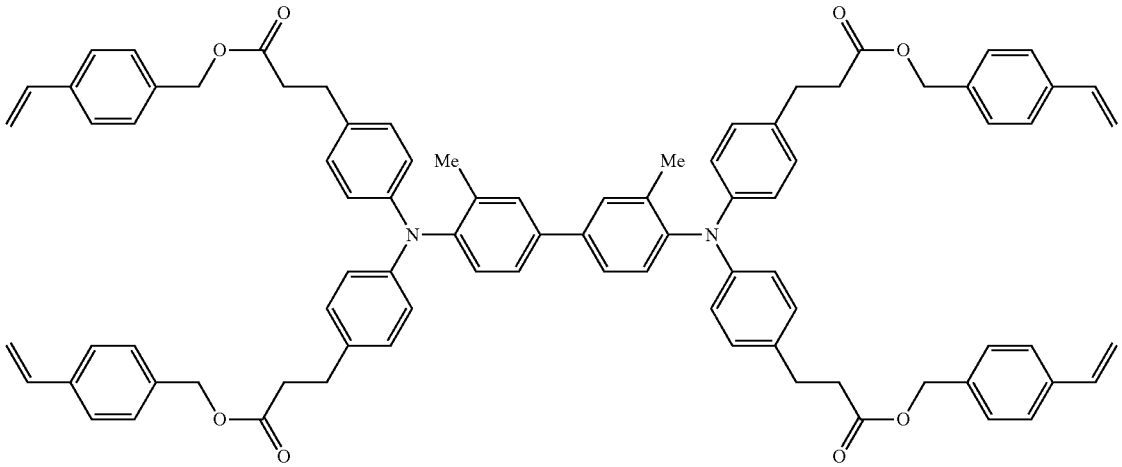

(I-c)-43

Synthesis of Exemplary Compound (I-c)-52

To a 500-ml flask are added 22 g of the following compound (2), 33 g of t-butoxypotassium, 300 ml of tetrahydrofuran, and 0.2 g of nitrobenzene, and a solution having 25 g of 4-chloromethylstyrene dissolved in 150 ml of tetrahydrofuran is slowly added dropwise thereto while stirring under a nitrogen air flow. After the end of dropwise addition, the mixture is heated and refluxed for hours, then cooled, poured into water, and extracted with toluene. The toluene layer is sufficiently washed with water and then concentrated, and the obtained oily substance is purified by silica gel column chromatography to obtain 29 g of an oily exemplary compound (I-c)-52.

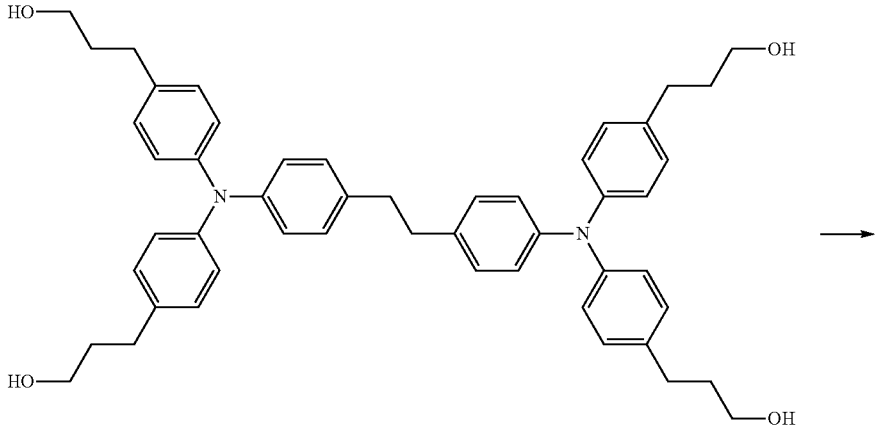

(2)

-continued

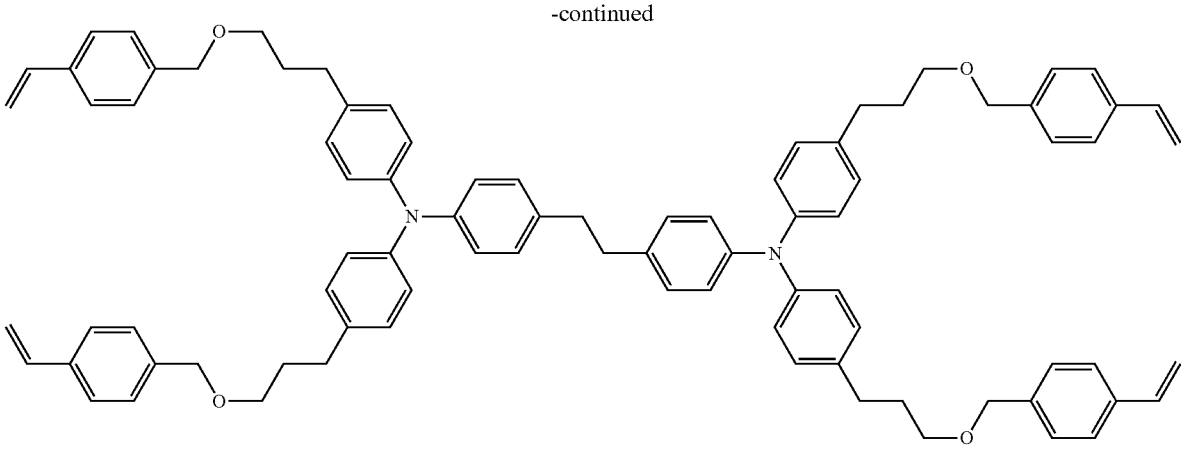

Furthermore, other exemplary compounds are synthesized according to the synthesis above.

(CTM-1)

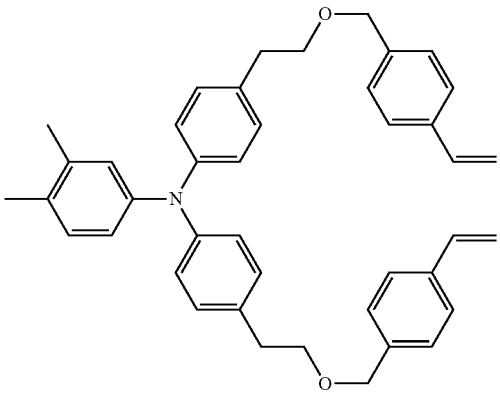

(CTM-2)

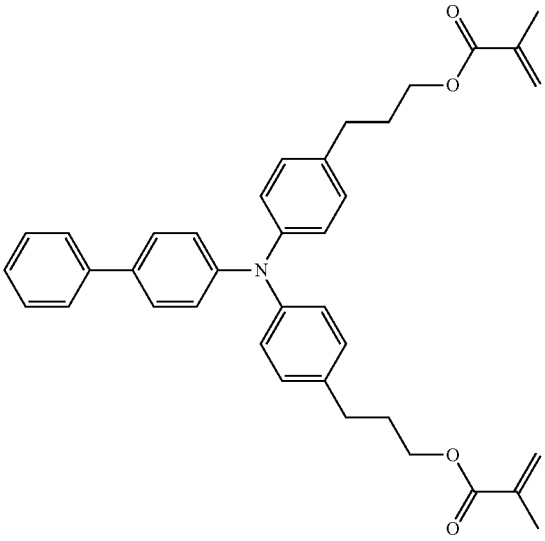

[SOL: Solvent]
IBA: Isobutyl acetate (SP value=8.5)
EA: Ethyl acetate (SP value=8.7)
MIBK: Methyl isobutyl ketone (SP value=8.7)
Di-n-propyl ketone: (SP value=8.8)
MEK: Methyl ethyl ketone (SP value=9.0)

[Binder Resins]

(b-1): PCZ-400 (bisphenol (Z) polycarbonate, manufactured by Mitsubishi Gas Chemical Company, inc.)

(b-2): C-1400 WP (bisphenol (A) polycarbonate, manufactured by Teijin Chemicals Ltd.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a charge generating layer provided on the conductive substrate;

a charge transporting layer provided on the charge generating layer; and an outermost surface layer provided on the charge transporting layer, wherein the charge transporting layer includes a charge transporting material and a polycarbonate copolymer having a solubility parameter as calculated by a Feders method of from 11.40 to 11.75, and the outermost surface layer includes a charge transporting material, fluorine-containing resin particles, and a fluorine-containing dispersant.

2. The electrophotographic photoreceptor according to claim 1, wherein the polycarbonate copolymer has repeating structural units having a solubility parameter as calculated by a Feders method of from 12.2 to 12.4.

3. The electrophotographic photoreceptor according claim 1, wherein the polycarbonate copolymer is a polycarbonate copolymer having repeating structural units represented by the following general formula (PC-1):

(PC-1)

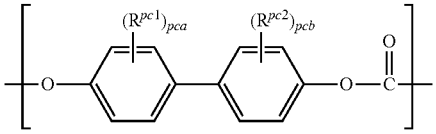

wherein $R^{pc1}$ and $R^{pc2}$ each independently represent a halogen atom, an alkyl group having 1 to 6 carbon atoms, a cycloalkyl group having 5 to 7 carbon atoms, or an aryl group having 6 to 12 carbon atoms; and pca and pcb each independently represent an integer of 0 to 4.

4. The electrophotographic photoreceptor according to claim 3, wherein the ratio of the repeating structural units represented by the general formula (PC-1) is from 20% by mole to 40% by mole, based on the polycarbonate copolymer.

5. The electrophotographic photoreceptor according to claim 1, wherein the polycarbonate copolymer is a polycarbonate copolymer having repeating structural units represented by the following general formula (PC-2):

(PC-2)

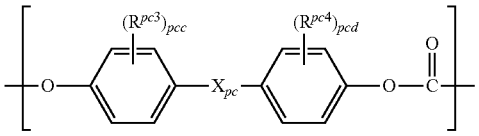

wherein $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms; pcc and pcd each independently represent an integer of 0 to 4; $X_{pc}$ represents —$CR^{pc5}R^{pc6}$—, a 1,1-cycloalkylene group having 5 to 11 carbon atoms, an α,ω-alkylene group having 2 to 10 carbon atoms, —O—, —S—, —SO—, or —$SO_2$—; and $R^{pc}5$ and $R^{pc6}$ each independently represent a hydrogen atom, a trifluoromethyl group, an alkyl group having 1 to 6 carbon atoms, or an aryl group having 6 to 12 carbon atoms.

6. The electrophotographic photoreceptor according to claim 5, wherein the ratio of the repeating structural units represented by the general formula (PC-2) is from 35% by mole to 55% by mole, based on the polycarbonate copolymer.

7. The electrophotographic photoreceptor according to claim 1, wherein the charge transporting material of the outermost surface layer is at least one selected from the reactive compounds represented by the following general formulae (I) and (II):

(I)

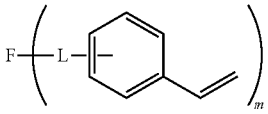

wherein F represents a charge transporting skeleton; L represents a divalent linking group including two or more selected from the group consisting of an alkylene group, an alkenylene group, —C(═O)—, —N(R)—, —S—, and —O—; R represents a hydrogen atom, an alkyl group, an aryl group, or an aralkyl group; and m represents an integer of 1 to 8, (II)

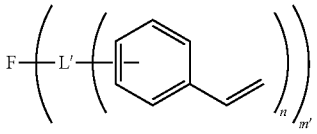

wherein F represents a charge transporting skeleton; L' represents an (n+1)-valent linking group including two or more selected from the group consisting of a trivalent or tetravalent group derived from an alkane or an alkene, and an alkylene group, an alkenylene group, —C(═O)—, N(R)—, —S—, and —O—; R represents a hydrogen atom, an alkyl group, an aryl group, or an aralkyl group; m' represents an integer of 1 to 6; and n represents an integer of 2 to 3.

8. The electrophotographic photoreceptor according to claim 7, wherein the reactive compound represented by the general formula (I) is at least one reactive compound selected from the reactive compounds represented by the following general formula (I-a), the following general formula (I-b), the following general formula (I-c), and the following general formula (I-d):

(I-a)

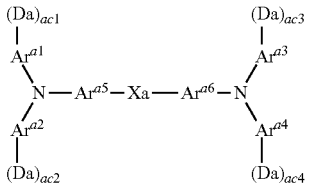

wherein $Ar^{a1}$ to $Ar^{a4}$ each independently represent a substituted or unsubstituted aryl group; $Ar^{a5}$ and $Ar^{a6}$ each independently represent a substituted or unsubstituted arylene group; Xa represents a divalent linking group formed by a combination of the groups selected from an alkylene group, —O—, —S—, and an ester; Da represents a group represented by the following general formula (IA-a); and ac1 to ac4 each independently represent an integer of 0 to 2, provided that the total number of Da is 1 or 2, (IA-a)

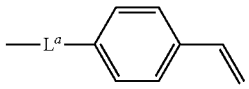

wherein $L^a$ is represented by *—$(CH_2)_{a0}$—O—$CH_2$— and represents a divalent linking group linked to a group represented by $Ar^{a1}$ to $Ar^{a4}$ at *; and a0 represents an integer of 1 or 2, (I-b)

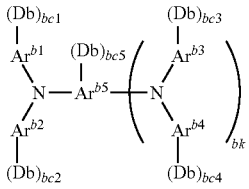

wherein $Ar^{b1}$ to $Ar^{b4}$ each independently represent a substituted or unsubstituted aryl group; $Ar^{b}5$ represents a substituted or unsubstituted aryl group, or a substituted or unsubstituted arylene group; Db represents a group represented by the following general formula (IA-b); bc1 to bc5 each independently represent an integer of 0 to 2; and bk represents 0 or 1, provided that the total number of Db is 1 or 2, (IA-b)

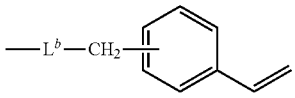

wherein $L^b$ includes a group represented by *—$(CH_2)_{bn}$—O— and represents a divalent linking group linked to a group represented by $Ar^{b1}$ to $Ar^{b5}$ at *; and bn represents an integer of 3 to 6, (I-c)

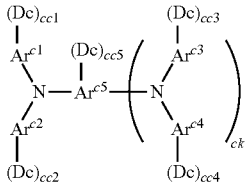

wherein $Ar^{c1}$ to $Ar^{c4}$ each independently represent a substituted or unsubstituted aryl group; $Ar^{c5}$ represents a substituted or unsubstituted aryl group, or a substituted or unsubstituted arylene group; Dc represents a group represented by the following general formula (IA-c); cc1 to cc5 each independently represent an integer of 0 to 2; and ck represents 0 or 1, provided that the total number of Dc is from 1 to 8, (IA-c)

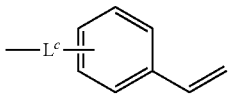

wherein $L^c$ represents a divalent linking group including one or more groups selected from the group consisting of the groups formed by a combination of —C(=O)—, —N(R)—, —S—, or —C(=O)—, and —O—, —N(R)—, or —S—; and R represents a hydrogen atom, an alkyl group, an aryl group, or an aralkyl group, (I-d)

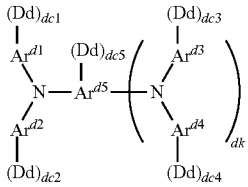

wherein $Ar^{d1}$ to $Ar^{d4}$ each independently represent a substituted or unsubstituted aryl group; $Ar^{d5}$ represents a substituted or unsubstituted aryl group, or a substituted or unsubstituted arylene group; Dd represents a group represented by the following general formula (IA-d); dc1 to dc5 each independently represent an integer of 0 to 2;

and dk represents 0 or 1, provided that the total number of Dd is from 3 to 8, (IA-d)

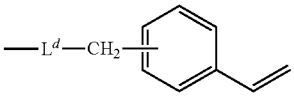

wherein $L^d$ includes a group represented by *—$(CH_2)_{dn}$—O— and represents a divalent linking group linked to a group represented by $Ar^{d1}$ to $Ar^{d5}$ at *; and do represents an integer of 1 to 6.

9. The electrophotographic photoreceptor according to claim 8, wherein the group represented by the general formula (IA-c) is a group represented by the following general formula (IA-c1):

(IA-c1)

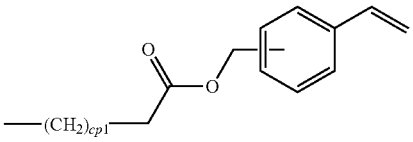

wherein cp1 represents an integer of 0 to 4.

10. The electrophotographic photoreceptor according to claim 7, wherein the compound represented by the general formula (II) is a compound represented by the following general formula (II-a):

(II-a)

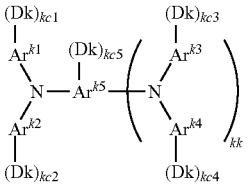

wherein $Ar^{k1}$ to $Ar^{k4}$ each independently represent a substituted or unsubstituted aryl group; $Ar^{k5}$ represents a substituted or unsubstituted aryl group, or a substituted or unsubstituted arylene group; Dk represents a group represented by the following general formula (IIA-a); kc1 to kc5 each independently represent an integer of 0 to 2; and kk represents 0 or 1, provided that the total number of DR is from 1 to 8, (IIA-a)

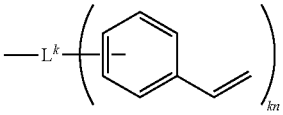

wherein $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—; R represents a hydrogen atom, an alkyl group, an aryl group, or an aralkyl group; and kn represents an integer of 2 to 3.

11. The electrophotographic photoreceptor according to claim 7, wherein the group linked to the charge transporting skeleton represented by F of the compound represented by the general formula (II) is a group represented by the following general formula (IIA-a1) or (IIA-a2):

(IIA-a1)

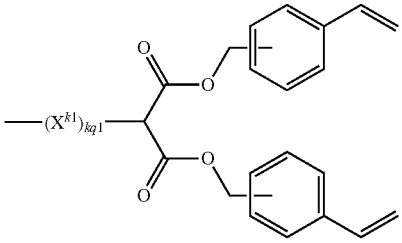

(IIA-a2)

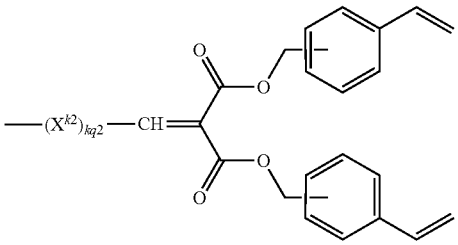

wherein $X^{k1}$ represents a divalent linking group; kq1 represents an integer of 0 or 1; $X^{k2}$ represents a divalent linking group; and kq2 represents an integer of 0 or 1.

12. The electrophotographic photoreceptor according to claim 7, wherein the group linked to the charge transporting skeleton represented by F of the compound represented by the general formula (II) is a group represented by the following general formula (IIA-a3) or (IIA-a3)

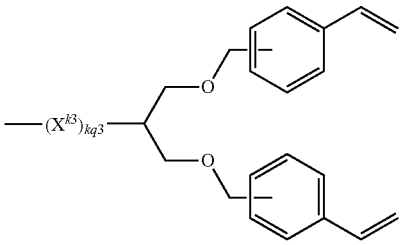

-continued (IIA-a4)

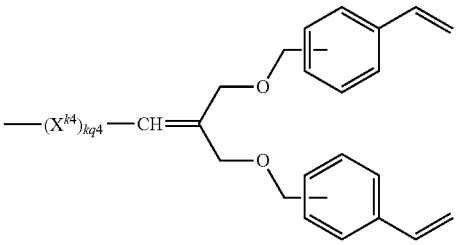

wherein $X^{k3}$ represents a divalent linking group; kq3 represents an integer of 0 or 1; $X^{k4}$ represents a divalent linking group; and kq4 represents an integer of 0 or 1.

13. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor by a toner to form a toner image; and a transfer unit that transfers the toner image formed on the surface of the electrophotographic photoreceptor onto a recording medium, wherein the electrophotographic photoreceptor is the electrophotographic photoreceptor according to claim 1.

14. A process cartridge attachable to or detachable from an image forming apparatus, wherein the process cartridge has an electrophotographic photoreceptor; and the electrophotographic photoreceptor is the electrophotographic photoreceptor according to claim 1.

* * * * *